US007581440B2

(12) United States Patent
Meek et al.

(10) Patent No.: US 7,581,440 B2
(45) Date of Patent: Sep. 1, 2009

(54) APPARATUS AND METHODS TO PERFORM DOWNHOLE MEASUREMENTS ASSOCIATED WITH SUBTERRANEAN FORMATION EVALUATION

(75) Inventors: Dale Meek, Sugar Land, TX (US); Julian J. Pop, Houston, TX (US); Robert W. Sundquist, The Woodlands, TX (US); Alain P. Dorel, Houston, TX (US); Thomas D. MacDougall, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 144 days.

(21) Appl. No.: 11/755,231

(22) Filed: May 30, 2007

(65) Prior Publication Data

US 2008/0115575 A1 May 22, 2008

Related U.S. Application Data

(60) Provisional application No. 60/860,401, filed on Nov. 21, 2006.

(51) Int. Cl.
*E21B 47/01* (2006.01)
*E21B 49/10* (2006.01)

(52) U.S. Cl. ..... 73/152.24; 73/152.03; 166/100; 166/264; 175/50

(58) Field of Classification Search ..... 73/152.03, 73/152.19, 152.22, 152.24, 152.26, 152.43, 73/152.46; 166/100, 250.01, 264; 175/50
See application file for complete search history.

(56) References Cited

U.S. PATENT DOCUMENTS 4,570,480 A 2/1986 Fontenot et al.
4,594,552 A * 6/1986 Grimaldi et al. ..... 324/375
4,800,753 A * 1/1989 Despax et al. ..... 73/152.39
5,095,745 A 3/1992 Desbrandes
5,184,508 A 2/1993 Desbrandes
5,233,866 A 8/1993 Desbrandes
5,335,542 A * 8/1994 Ramakrishnan et al. .. 73/152.08
5,473,939 A 12/1995 Leder et al.
5,789,669 A 8/1998 Flaum
5,791,414 A 8/1998 Skinner et al.
5,813,460 A 9/1998 Ringgenberg et al.
5,969,241 A 10/1999 Auzerais
6,157,893 A 12/2000 Berger et al.
6,164,126 A 12/2000 Ciglenec et al.
6,230,557 B1 5/2001 Ciglenec et al.
6,478,096 B1 11/2002 Jones et al.
6,564,883 B2 * 5/2003 Fredericks et al. ..... 175/50
6,581,455 B1 6/2003 Berger et al.
6,585,045 B2 * 7/2003 Lee et al. ..... 166/252.5

(Continued)

*Primary Examiner*—John Fitzgerald
(74) *Attorney, Agent, or Firm*—Dave R. Hofman; Matthias Abrell; Darla P. Fonseca

(57) ABSTRACT

A system for testing a subterranean formation penetrated by a well includes a downhole tool configured to be coupled to a work string that includes a tool body having a longitudinal bore for circulating a fluid and at least one aperture configured to receive at least one module. The system further includes a plurality of modules that are each configured to engage the at least one aperture and at least one cavity configured for receiving a probe, and a plurality of probes that each include at least one orifice configured for testing the formation, wherein a first of the plurality of probes has a first configuration and a second of the plurality of probes has a second configuration.

21 Claims, 22 Drawing Sheets

U.S. PATENT DOCUMENTS 6,640,908 B2 11/2003 Jones et al.
6,729,399 B2 5/2004 Follini et al.
6,837,314 B2 1/2005 Krueger et al.
6,986,282 B2 1/2006 Ciglenec et al.
7,021,405 B2 * 4/2006 Proett et al. ..... 175/65
7,114,562 B2 10/2006 Fisseler et al.
7,204,309 B2 4/2007 Segura et al.
7,260,985 B2 * 8/2007 Gilbert et al. ..... 73/152.24
7,394,257 B2 * 7/2008 Martinez et al. ..... 324/356
2003/0173115 A1 * 9/2003 Krueger et al. ..... 175/59
2004/0035199 A1 2/2004 Meister et al.
2004/0079527 A1 4/2004 Meister et al.
2005/0109538 A1 5/2005 Fisseler et al.
2005/0257611 A1 * 11/2005 Fogal et al. ..... 73/152.22
2005/0257630 A1 11/2005 Gilbert et al.
2006/0000606 A1 * 1/2006 Fields et al. ..... 166/264
2008/0066535 A1 * 3/2008 Vasques et al. ..... 73/152.17
2008/0066536 A1 * 3/2008 Goodwin et al. ..... 73/152.24
2008/0115574 A1 * 5/2008 Meek ..... 73/152.03

* cited by examiner

APPARATUS AND METHODS TO PERFORM DOWNHOLE MEASUREMENTS ASSOCIATED WITH SUBTERRANEAN FORMATION EVALUATION

CROSS REFERENCE TO RELATED APPLICATIONS

This application is a non-provisional application of U.S. Provisional Patent Application 60/860,401, filed Nov. 21, 2006, the content of which is incorporated herein by reference for all purposes.

FIELD OF THE DISCLOSURE

The present disclosure relates generally to testing conducted in wells penetrating subterranean formations and, more particularly, to improved extendable probes and extension means.

BACKGROUND

Drilling, completion, and production of reservoir wells involves monitoring of various subsurface formation parameters. For example, parameters of reservoir pressure and permeability of the reservoir rock formations are often measured to evaluate a subsurface formation. Fluid may be drawn from the formation and captured to measure and analyze various fluid properties of a fluid sample. Monitoring of such subsurface formation parameters can be used, for example, to determine the formation pressure changes along the well trajectory or to predict the production capacity and lifetime of a subsurface formation.

Traditional downhole measurement systems sometimes obtain these parameters through wireline logging via a formation tester tool. A formation tester tool may alternatively be coupled to a drill string in-line with a drill bit (e.g., as part of a bottom hole assembly) and even a directional drilling subassembly. The drill string often includes one or more stabilizer(s) to engage a formation wall during drilling to substantially reduce or eliminate vibration, wandering, and/or wobbling of the drill bit and the drill string during drilling operations.

A typical formation tester tool engages a formation wall to obtain measurements of the subsurface formation parameters. Therefore, measurement instruments or probes used to generate the subsurface formation parameters are sometimes configured to protrude from the drill string sufficiently to engage the formation wall. The amount of protrusion from the drill string is typically sufficient for the probes to meet or extend beyond the diameter of the stabilizer, which is typically configured to engage or about to engage the formation wall.

In some systems, each time a drill bit is selected or adjusted to drill a particular diameter well, the formation tester tool may also need to be replaced. One motivation for replacing the formation tester tool may be that the tester tool comprises an integral stabilizer no longer suitable for drilling a well of the selected diameter. A new formation tester tool is selected having an integral, larger diameter stabilizer to engage the wall of the larger diameter well. The formation tester tool may also need to be replaced so that its measurement instruments or probes extend further and engage the wall of the larger diameter well. In these systems, a drilling operation often requires a plurality of different formation tester tools to accommodate any of a number of well diameters. This requirement affects, for example, the cost of the service delivery.

SUMMARY

In accordance with one aspect of the disclosure, a system for testing a subterranean formation penetrated by a well is disclosed. The system includes a downhole tool, a plurality of modules, and a plurality of probes. The tool is configured to be coupled to a work string and includes a body having a longitudinal bore for circulating a fluid and at least one aperture configured to receive at least one module. The plurality of modules are each configured to be received by the at least one aperture and have at least one cavity configured to receive a probe. The plurality of probes each have at least one orifice configured for testing the formation, wherein a first of the plurality of probes has a first configuration and a second of the plurality of probes has a second configuration.

In accordance with one aspect of the disclosure, a system for testing a subterranean formation penetrated by a well is disclosed. The system includes a downhole tool, a probe, an actuator, a resilient member) a first valve and a second valve. The tool is configured to be coupled to a work string that includes a body having a longitudinal bore for circulating a fluid and at least one probe cavity configured to receive a probe. The probe includes a piston that slideably engages the probe cavity, such that the probe piston and the probe cavity at least partially form a retracting chamber and an extending chamber. The actuator is fluidly coupled to the probe actuating chamber via a fluid passage and is configured to vary the pressure in the actuating chamber. The resilient member is operatively coupled to the probe and is configured to store energy when the probe is projected from the downhole tool. The first valve is fluidly coupled to the probe retracting chamber and is configured to open when power is removed from the vale, and the second valve is fluidly coupled to the actuating chamber and is configured to vent the pressure in the actuating chamber when power is removed from the valve.

In accordance with one aspect of the disclosure, a method of testing a subterranean formation penetrated by a well is disclosed. The method includes providing a downhole tool that is configured to receive a probe module and selecting a probe module from a plurality of probe modules configured to be coupled to the downhole tool, wherein each probe module includes a probe having a probe configuration different from the probe configuration of other of the plurality of probe modules. The method further includes coupling the selected probe module to the downhole tool, coupling the downhole tool to a work string, lowering the downhole tool in the underground formation, and testing the underground formation using the probe.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
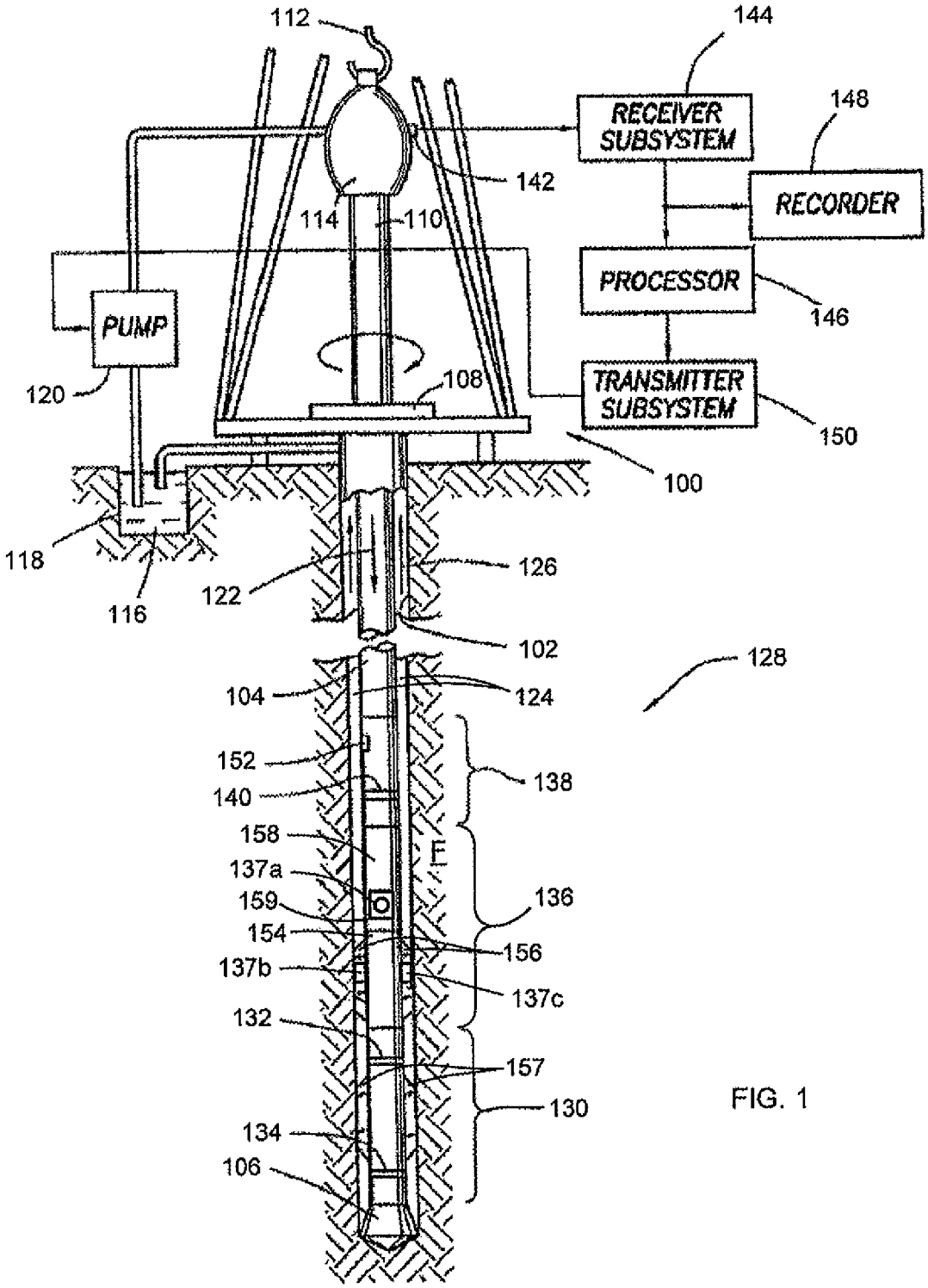
FIG. 1 is an elevational view including a block diagram of a drilling rig and drill string that may incorporate the example apparatus described herein.

FIG. 1 shows a drilling system and related environment. Land-based platform and derrick assembly 100 are positioned over a wellbore 102 penetrating a subsurface formation F. The wellbore 102 is formed by rotary drilling in a manner that is well known. However, those of ordinary skill in the art, given the benefit of this disclosure, will appreciate that the present invention also finds application in directional drilling applications as well as rotary drilling, and is not limited to land-based rigs. A drill string 104 is suspended within the wellbore 102 and includes a drill bit 106 at its lower end. The drill string 104 is rotated by a rotary table 108, energized by means not shown, which engages a kelly 110 at the upper end of the drill string 104. The drill string 104 is suspended from a hook 112, attached to a traveling block (not shown), through the kelly 110 and a rotary swivel 114, which permits rotation of the drill string 104 relative to the hook 112.

A drilling fluid 116 is stored in a pit 118 formed at the well site. A pump 120 delivers the drilling fluid 116 to the interior of the drill string 104 via a port in the rotary swivel 114, inducing the drilling fluid 116 to flow downwardly through the interior of the drill string 104 as indicated by directional arrow 122. The drilling fluid 116 exits the drill string 104 via ports in the drill bit 106 to lubricate the drill bit 106 and then circulates upwardly through the region between an outer surface of the drill string 104 and the wall of the wellbore 102, called the annulus 124, as indicated by direction arrows 126. The drilling fluid 116 is referred to herein as drilling mud when it enters the annulus 124 and flows through the annulus 124. The drilling mud typically includes the drilling fluid 116 mixed with formation cuttings and other formation material. The drilling mud carries formation cuttings up to the surface as the drilling mud is routed to the pit 118 for recirculation and so that the formation cuttings and other formation material can settle in the pit 118.

The drilling fluid 116 performs various functions to facilitate the drilling process, such as lubricating the drill bit 106 and transporting cuttings generated by the drill bit 106 during drilling. The cuttings and/or other solids mixed with the drilling fluid 116 create a "mudcake" that also performs various functions, such as coating the borehole wall.

The dense drilling fluid 116 conveyed by the pump 120 is used to maintain the drilling mud in the annulus 124 of the wellbore 102 at a pressure (i.e., an annulus pressure ("$A_p$")) that is typically higher than the pressure of fluid in the surrounding formation F (i.e., a pore pressure ("$P_p$")) to prevent formation fluid from passing from the surrounding formation F into the borehole. In other words, the annulus pressure ($A_p$) is maintained at a higher pressure than the pore pressure ($P_p$) so that the wellbore 102 is "overbalanced" ($A_p > P_p$) and does not cause a blowout. The annulus pressure ($A_p$) is also usually maintained below a given level to prevent the formation surrounding the wellbore 102 from cracking and to prevent the drilling fluid 116 from entering the surrounding formation F. Thus, downhole pressures are typically maintained within a given range.

The drill string 104 further includes a bottom hole assembly 128 near the drill bit 106 (e.g., within several drill collar lengths from the drill bit). The bottom hole assembly 128 includes capabilities for measuring, processing, and storing information, as well as communicating with surface equipment. The bottom hole assembly 128 includes, among other things, measuring and local communications apparatus 130 for determining and communicating measurement information associated with the formation F surrounding the wellbore 102. The communications apparatus 130, including a transmitting antenna 132 and a receiving antenna 134, is described in detail in U.S. Pat. No. 5,339,037, commonly assigned to the assignee of the present application, the entire contents of which are incorporated herein by reference.

The bottom hole assembly 128 further includes a formation tester 136 that may comprise one or more drill collars such as drill collars 154 and 158. Each of the collars 154 and 158 includes respective breakable connectors (e.g., the breakable connectors 301*a* and 301*b* of FIG. 3A) to breakably or detachably couple the collars 154 and 158 to one another and/or to other collars of the bottom hole assembly 128. As used herein, detachable connectors are connectors that are capable of being attached to one another and detached or separated from one another. In other example implementations, the collars 154 and 158 may be a unitary piece (e.g., may be formed using one collar). Yet in other example implementations, such as described below in connection with FIGS. 3A-3D, a tool collar having a plurality of threads on a portion of an outer diameter surface is configured to receive a stabilizer sleeve (e.g., a stabilizer sleeve 302 of FIGS. 3A-3C) having stabilizer blades and a plurality of threads on a portion of an inner diameter surface that enable mechanically coupling the stabilizer sleeve to the tool collar.

The formation tester 136 includes one or more measurement probe(s) 137*a-c* configured to perform measurement operations. The probe 137*a* may be located preferably, but not necessarily, on a raised portion 159 (e.g., a pad) of an outside diameter of the formation tester 136. Alternatively, the probes 137*b* and 137*c* may be located in a stabilizer blade 156 of the formation tester 136. Alternatively or additionally, probes may be anywhere on the formation tester 136.

The bottom hole assembly 128 further includes a surface/local communications subassembly 138. As known in the art, the surface/local communications subassembly 138 may comprise a downhole generator (not shown) commonly referred to as a "mud turbine" that is powered by the drilling fluid 116 flowing downwardly through the interior of the drill string 104 in a direction generally indicated by arrow 122. The downhole generator can be used to provide power to various components in the bottom hole assembly 128 during circulation of the drilling fluid 116, for immediate use or for recharging batteries located in the bottom hole assembly 128.

The subassembly 138 further includes an antenna 140 used for local communication with the apparatus 130, and also includes a known type of acoustic communication system (not shown) that communicates with a similar system (not shown) at the earth's surface via signals carried in the drilling fluid 116 or drilling mud. Thus, the surface communication system in the subassembly 138 includes an acoustic transmitter that generates an acoustic signal in the drilling fluid 116 or drilling mud that includes information of measured downhole parameters.

One suitable type of acoustic transmitter employs a device known as a "mud siren" (not shown). A mud siren may include a slotted stator and a slotted rotor that rotates and repeatedly interrupts the flow of the drilling fluid 116 or drilling mud to establish a desired acoustic wave signal in the drilling fluid 116. The driving electronics in the subassembly 138 may include a suitable modulator, such as a phase shift keying (PSK) modulator, which conventionally produces driving signals for the mud siren. For example, the driving signals can be used to apply appropriate modulation to the mud siren.

The acoustic signals transmitted by the acoustic communication system are received at the surface by transducers 142. The transducers 142 (e.g., piezoelectric transducers) convert the received acoustic signals to electronic signals. The outputs of the transducers 142 are coupled to an uphole receiving subsystem 144, which demodulates the transmitted signals. An output of the receiving subsystem 144 is then coupled to a processor 146 and a recorder 148.

An uphole transmitting system 150 is also provided, and is operative to control interruption of the operation of the pump 120 in a manner that is detectable by transducers 152 in the subassembly 138. In this manner, the subassembly 138 and the uphole equipment can communicate via two-way communications as described in greater detail in U.S. Pat. No. 5,235,285, the entire contents of which are incorporated herein by reference.

In the illustrated example of FIG. 1, the bottom hole assembly 128 is further equipped with one or more stabilizer sections. The stabilizer sections comprise stabilizer blades or protuberances 156 and 157 that are used to address the tendency of the bottom hole assembly 128 to wobble and become decentralized as it rotates within the wellbore 102, resulting in deviations in the direction of the wellbore 102 from the intended path (for example, a straight vertical line). Such deviation can cause excessive lateral forces on the drill string sections as well as the drill bit 106, thereby producing accelerated wear. The stabilizer blades 156 and 157 are configured to overcome this action and centralize the drill bit 106 and, to some extent, the drill string 104, within the wellbore 102. The stabilizer blades 156 and 157 may be integral with the drill collar 154, or they may be bolted on the drill 154. In some example implementations, the thickness and/or shape of the stabilizer blades 156 and 157 may be selected based on the type of drilling operation to be performed and/or the desired handling or performance of the bottom hole assembly 128 during the drilling operation.

The order in which the local communications apparatus 130, the formation tester 136, and the surface/local communications subassembly 138, are depicted on the bottom hole assembly 128 in FIG. 1 is only one example implementation. In other example implementations, the components 130, 136, 138, of the bottom hole assembly 128 may be rearranged or one or more components may be removed or added. In addition, the bottom hole assembly 128 may include fewer or more of any one or more of the components 130, 136, 138, and/or any other components not shown. The example methods and apparatus described herein are also not restricted to drilling operations. Persons of ordinary skill in the art will appreciate that the example apparatus and methods described herein can also be advantageously used during, for example, well testing or servicing. Further, the example methods and apparatus, in general, can be implemented in connection with testing conducted in wells penetrating subterranean formations and in connection with applications associated with formation evaluation tools conveyed downhole by any known means.

Figure 2:
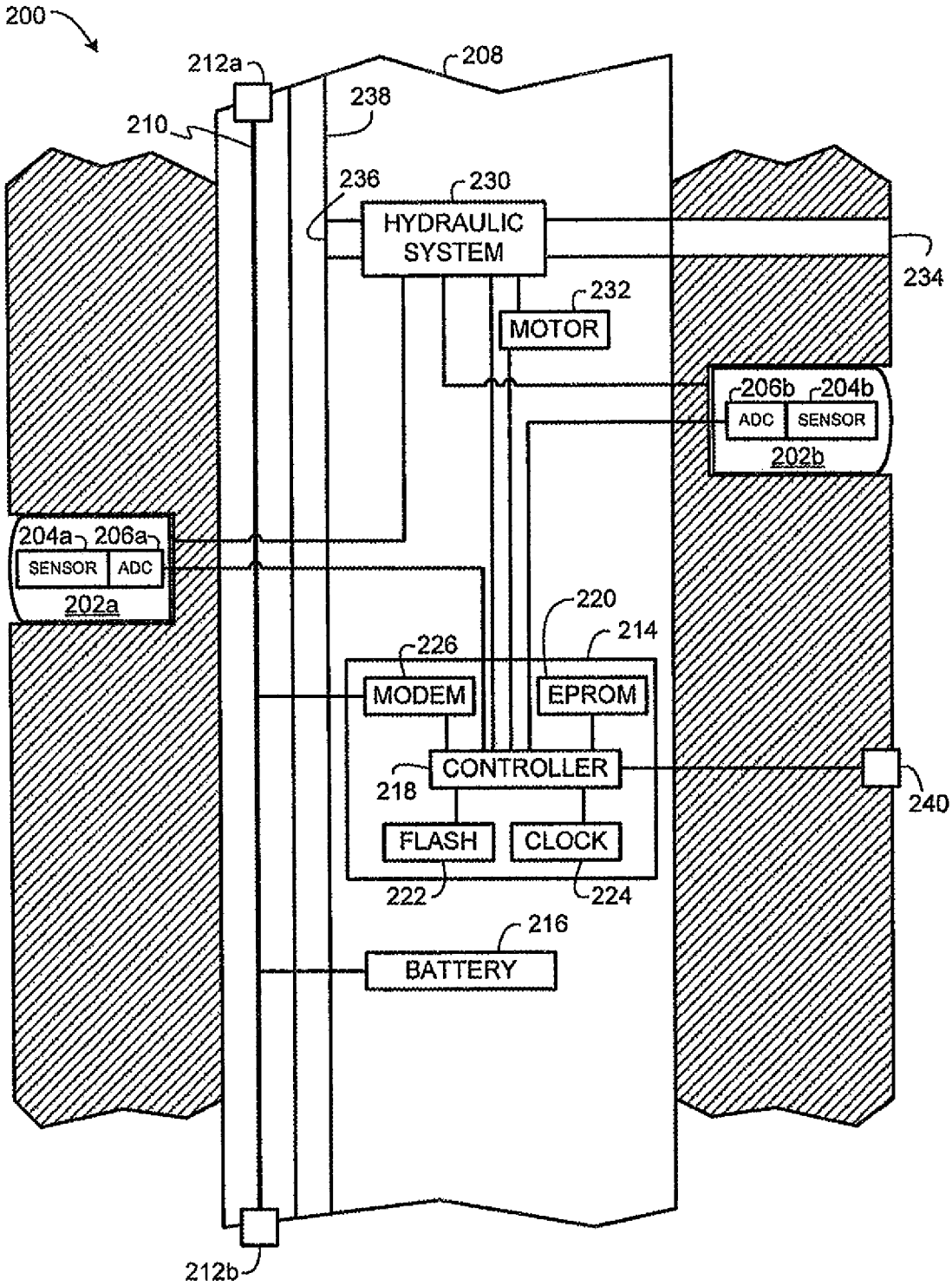
FIG. 2 depicts a block diagram that may be used to implement a logging while drilling tool of FIG. 1.

FIG. 2 depicts a block diagram of a formation tester 200 that may be used to implement, for example, the formation tester 136 of FIG. 1. In the illustrated example of FIG. 2, lines shown connecting blocks in FIG. 2 represent hydraulic or electrical connections, that may comprise one or more flow lines or one or more wires or conductive paths respectively.

To perform downhole measurements and tests, the formation tester 200 is provided with probes 202*a* and 202*b*. In an example implementation, each of the probes 202*a-b* includes a respective sensor 204*a-b* and may include an analog-to-digital converter (ADC) 206*a-b*. One or both of the probes 202*a* and 202*b* may be configured to be stationary within the formation tester 200. The sensors 204*a-b* may be configured to measure formation parameters (e.g., resistivity, porosity, density, pressure, sonic velocity, natural radioactivity, or any other measurement). Alternatively or additionally, the probes 202*a* and 202*b* may be provided with actuators, such as coils or antennae, radioactive sources, piezo electrical actuators, etc. In some cases, the probes 202*a* and 202*b* may be configured to facilitate the performance of different types of measurements. For example, the measurement probe 202*a* may be configured to facilitate measuring a formation parameter while the measurement probe 202*b* may be configured to facilitate measuring another different formation parameter. In other cases, the probes 202*a-b* may be configured to perform the same type of measurement.

Example probe systems and/or example probe modules that may be used to implement measurement probe are described in greater detail below. For example, the probes 202*a* and 202*b* may be implemented using measurement/pad modules (e.g., the measurement/pad module of FIGS. 3A-3D).

In another example implementation, the probes 202*a* and 202*b* are preferably configured to protrude from the formation tester 200, each of which may be substantially similar or identical to the measurement probes 137*a*, 137*b* and 137*c* of FIG. 1. Probes 202*a* and 202*b* are typically configured to recess in a cavity of the formation tester during drilling and to protrude from the formation tester 200 toward a borehole wall when a measurement is desired. Thus, the probes 202*a* and 202*b* facilitate the placement of tool components close to the borehole wall.

The probes 204*a* and 204*b* may be equipped with position sensors or displacement sensor (e.g., analog potentiometers, digital encoders, etc.) to determine and/or substantially continuously monitor the distances by which the probes 204*a* and 204*b* are extended from the formation tester 200. Additionally or alternatively, the amount of hydraulic fluid used by a hydraulic system 230 to displace the probes 204*a* and 204*b* may be used for tracking or monitoring the extension distances of the probes 204*a* and 204*b*. This hydraulic fluid amount may be estimated using, for example, motor revolution sensors on an optional motor 232. Thus, the probes 202*a* and 202*b* may be used as a mechanical caliper to make a measurement of the borehole diameter. Alternatively or additionally, the probes 202*a* and 202*b* may be used for measuring rock elastic modulus and rock strength.

In another example implementation, the formation tester 200 may be configured to determine the formation pore pressure ("$P_p$"). The probes 202*a* and 202*b* are preferably configured to protrude from the formation tester 200 and seal a portion of the formation wall. As shown, each of the probes 202*a-b* includes a pressure sensor 204*a-b* and may include an analog-to-digital converter (ADC) 206*a-b*. The sensors 204*a* and 204*b* may be quartz gages, but other known pressure gages may be used. The sensors 204*a* and 204*b* are in fluid communication with the sealed portion of the borehole wall through at least a fluid inlet in the probes 202*a-b* respectively. Usually, the hydraulic system 230 comprises a pump or a piston that is energized by the motor 232 for drawing formation fluid into the probe.

In some cases, each of the probes 202*a-b* includes a drawdown piston between the hydraulic system 230 and a respective probe inlet. The drawdown pistons may be equipped with position sensors or displacement sensors (e.g., analog potentiometers, digital encoders, etc.) to determine and/or substantially continuously monitor their position within the probes 204*a* and 204*b*.

Example probe systems and/or example probe modules that may be used to implement a pressure probe are described in greater detail below. For example, the probes 202*a* and 202*b* may be implemented using probe modules (e.g., the probe module 702 of FIGS. 14 and 15).

In yet another example implementation, at least one of the probes 202*a-b* may be used to sample formation fluid. This probe is preferably configured to protrude from the formation tester 200 and seal a portion of the borehole or formation wall. In this example, the hydraulic system 230 is used to draw formation fluid through the probes 202*a-b* into the formation tester 200. The hydraulic system 230 may comprise a pump driven by, for example, the motor 232, and one or more sample cavity(ies) to capture a sample of formation fluid and to carry the sample to the surface where further analysis of the retrieved fluid sample may be performed. The fluid sample is preferably taken as a representative sample of the area of the well from which the sample was drawn using known systems and methods.

Example probe systems and/or example probe modules that may be used to implement a sampling probe are described in greater detail below. For example, the sampling probe may be implemented using the probe module 602*a* of FIG. 6.

As described below, the probes 202*a-b* may be implemented using one or more removably insertable probe modules (e.g., the probe module 702 of FIGS. 7 and 8). A removably insertable probe module may be modular and may be insertable into an opening (not shown) formed in the formation tester 200. The removably insertable probe module may include mechanical, electrical, and/or hydraulic interfaces that are relatively easily connectable to corresponding interfaces on the formation tester 200. In this manner, the bottom hole assembly 128 (FIG. 1) need not be completely disassembled and reassembled to connect different modules each time different instrumentation (e.g., different probes or different sensors) is required to perform different measurements of a formation (e.g., the formation F of FIG. 1). Instead, an interchangeable probe module can be removed from the formation tester 200 and replaced using another interchangeable probe module having different measurement capabilities, different dimensions (e.g., probe length), etc.

In alternative example implementations, the probes 202*a-b* and pads (e.g., the pad 159 of FIG. 1) can be part of a pad/probe module that is removably insertable in or mountable to the formation tester 200.

In yet other example implementations, measurement modules may not have sensors (e.g., the sensors 204*a-b*) mounted on an extendable probe, but may instead have sensors that are part of the measurement modules and the measurement modules may be removably insertable in or mountable to the formation tester 200. In some cases, respective pads may be integrally formed the measurement modules, and each of the sensors 204*a-b* may be located substantially flush with respect to the outer surface of a respective pad.

To provide electronic components and hydraulic components to control the probes 202*a-b* and obtain test and measurement values, the formation tester 200 is provided with a chassis 208 that includes a tool bus 210 configured to transmit electrical power and communication signals. The chassis 208 also includes an electronics system 214 and a battery 216 electrically coupled to the tool bus 210. The chassis 208 further includes the hydraulic system 230 and the optional motor 232.

The tool bus 210 includes tool bus interfaces 212*a-b* to couple the tool bus 210 to tool buses of other collars to transfer electrical power and/or information signals between collars. For example, the tool bus 210 may be used to electrically connect the formation tester 200 to a surface/local communications subassembly such as, for example, the surface/local communications subassembly 138 in FIG. 1. Thus, the formation tester 200 may receive power generated by a turbine located in the surface/local communications subassembly 138. Additionally, the formation tester 200 may and send and/or receive data from the surface via the subassembly 138 and the modem 226.

To operate the probes 202*a-b*, the chassis 208 is provided with the hydraulic system 230 coupled to the motor 232 via, for example, a gearbox (not shown). Motor 232 may be of any known kind such as, for example, a brushless direct-current ("DC") motor, a stepper motor, etc. The hydraulic system 230 and the motor 232 may be used to extend and retract the probes 202*a-b* relative to the formation tester 200 toward and away from the wall of the wellbore (e.g., the wellbore 102 of FIG. 1).

In the illustrated example, the hydraulic system 230 is fluidly coupled to an annulus pressure ($A_p$) port 234 to sense the pressure of drilling mud in the annulus 124 of the wellbore 102 (FIG. 1). The hydraulic system 230 is also shown fluidly coupled to an internal pressure ($I_p$) port 236 to sense the pressure of drilling fluid (e.g., the drilling fluid 116 of FIG. 1) that flows through a fluid passage 238 in the formation tester 200. In some example implementations, the hydraulic system 230 may use the annulus and internal fluid pressures instead of or in addition to the motor 232 to extend and/or retract the probes 202*a* and 202*b*, for example as described below in connection with FIGS. 19-21.

The battery 216 and/or the subassembly 138 provide electrical power to the motor 232 that, in turn, provides mechanical power to the hydraulic system 230. Additionally or alternatively, the pressure differential between the annulus and internal fluid pressures provide hydraulic power to the hydraulic system 230. In some cases, it may be advantageous to configure the formation tester 200 so that the hydraulic system 230 is capable of operating during circulation of the drilling fluid 116 and/or when circulation of the drilling fluid 116 has stopped. Thus, the formation tester 200 is preferably capable of making a measurement while a circulation pump is on and/or a measurement while a circulation pump is off. For example, the hydraulic system 230 may include an accumulator to store hydraulic energy during circulation of the drilling fluid 116 for later use, as described below in connection with FIGS. 19-21. An accumulator may also be used to store hydraulic energy over a long period of time to reduce the peak electrical consumption of the formation tester 200 as described below in connection with FIG. 14.

Figure 7:
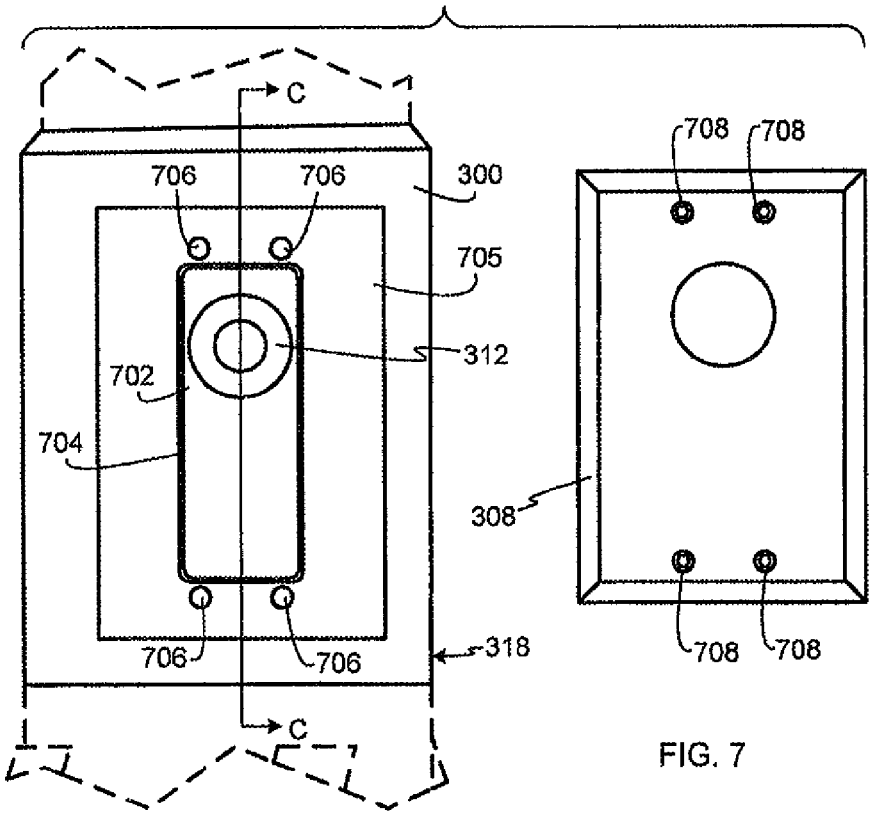
FIG. 7 illustrates the example tool collar of FIGS. 3A-3D having a removable probe module inserted therein.
Figure 8:
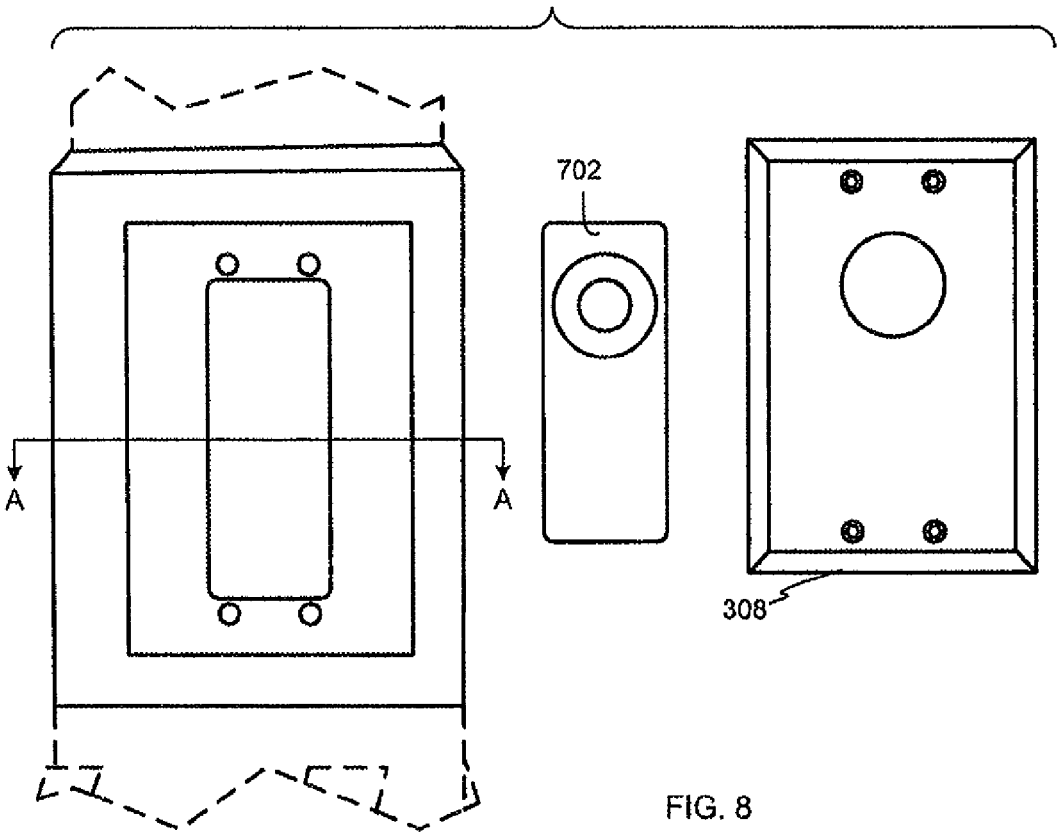
FIG. 8 illustrates an exploded diagram in which the probe module of FIG. 7 is removed from the tool collar.

Although the hydraulic system 230 is shown as being implemented in the chassis 208, in some example implementations, one or more portions of the hydraulic system 230 may be implemented in probe modules (e.g., the probe module 702 of FIGS. 7 and 8). Example hydraulic systems that may be used to implement the hydraulic system 230 are described in detail below.

The electronics system 214 is provided with a controller 218 (e.g. a CPU and Random Access Memory) to implement test and measurement routines (e.g., to control the probes 202*a-b*, etc.). To store machine accessible instructions that, when executed by the controller 218, cause the controller 218 to implement test and measurement routines or any other routines, the electronics system 214 is provided with an electronic programmable read only memory (EPROM) 220. In the illustrated example, the controller 218 is configured to receive digital data from various sensors in the formation tester 200. The controller 218 is also configured to execute different instructions depending on the data received. The instructions executed by the controller 218 may be used to control some of the operations of the formation tester 200. Thus, the formation tester 200 is preferably, but not necessarily, configured to sequence some of its operations (e.g. probe movement) according to sensor data acquired in situ.

In an example implementation, the electronics system 214 may be configured to adjust the force exerted on the formation surface by the probes 202*a* and 202*b* based on the data collected by the sensors 204*a* and 204*b*. In addition, the electronics system 214 can be configured to maintain the setting force of the probes 202*a* and 202*b* against the formation surface while the formation tester 200 is moved up and down or rotated to obtain measurements at different locations of the formation surface.

Additionally or alternatively, the electronics system 214 may drive a motor controller (e.g., a stepper controller, a revolutions controller, etc.) and collect data from motor revolution sensors that enable tracking or monitoring the extension distances of the probes 204*a* and 204*b*.

In some example implementations, the electronics system 214 may include controllers (e.g., pulse-width-modulation ("PWM") controllers) for controlling hydraulic fluid flow to the probes 204*a* and 204*b* with substantially high precision. For example, a PWM controller may be used to control opening and closing of hydraulic fluid line valves (e.g., solenoid valves) to control the extension/retraction of the probes 204*a* and 204*b*.

Examples of close loop sequencing that may be used to control the operations of formation tester 200 are described in detail below in connection with FIG. 18.

To store, analyze, process and/or compress test and measurement data, or any kind of data, acquired by formation tester 200 using, for example, the sensors 204*a-b*, the electronics system 214 is provided with a flash memory 222. To generate timestamp information corresponding to the acquired test and measurement information, the electronics system 214 is provided with a clock 224. The timestamp information can be used during a playback phase to determine the time at which each measurement was acquired and, thus, the depth at which the formation tester 200 was located within a wellbore (e.g., the wellbore 102 (FIG. 1) when the measurements were acquired. To communicate information when the formation tester 200 is still downhole, the electronics system 214 is provided with a modem 226 that is communicatively coupled to the tool bus 210 and the subassembly 138. In the illustrated example, the formation tester 200 is also provided with a read-out port 240 to enable retrieving measurement information stored in the flash memory 222 when the testing tool is brought to surface. The read-out probe 240 may be an electrical contact interface or a wireless interface that may be used to communicatively couple a data collection device to the formation tester 200 to retrieve logged measurement information stored in the flash memory 222.

Although the components of FIG. 2 are shown and described above as being communicatively coupled and arranged in a particular configuration, persons of ordinary skill in the art will appreciate that the components of the formation tester 200 can be communicatively coupled and/or arranged different from what is shown in FIG. 2 without departing from the scope of the present disclosure. Also, although the formation tester 200 is shown with two probes 202*a-b*, any number of probes may be used in the formation tester 200.

Figure 3A:
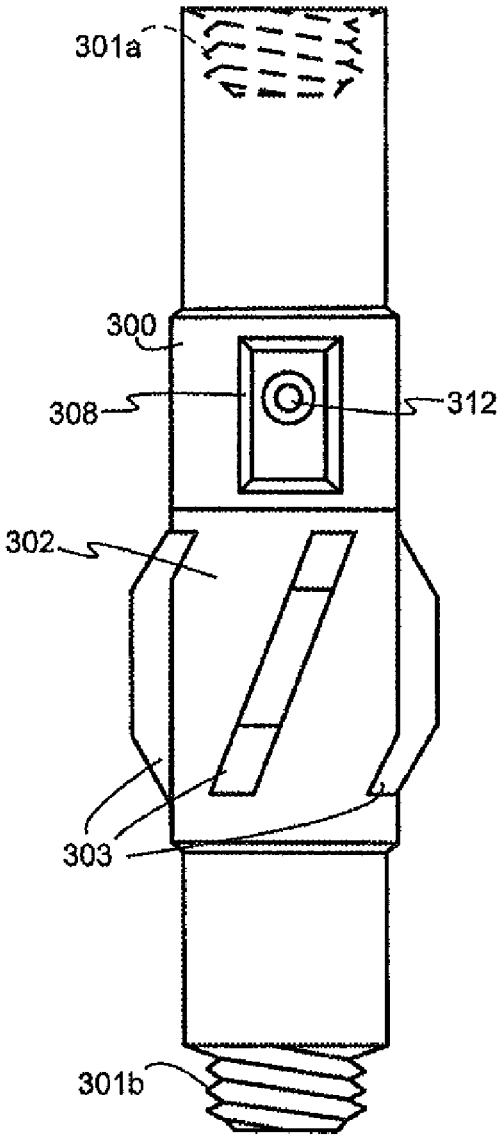
FIG. 3A depicts a first side view and FIG. 3B depicts a second side view of an example tool collar that may be used to implement the example tool collar of FIG. 1.
Figure 3B:
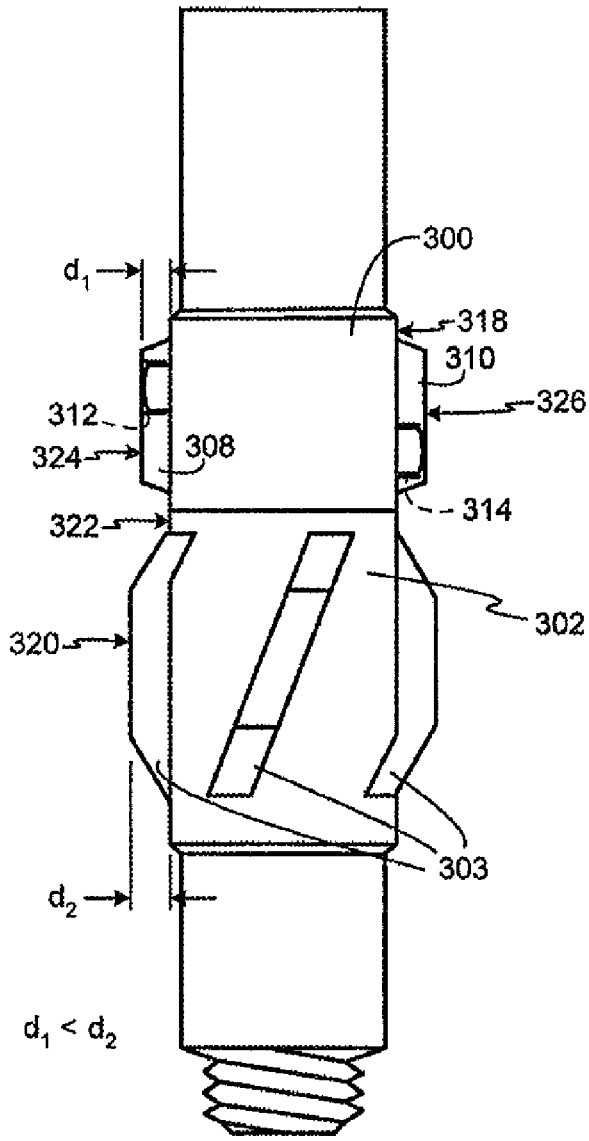

FIG. 3A depicts a first side view and FIG. 3B depicts a second side view of an example formation tester 300 that may be used to implement the example formation tester 136 of FIG. 1. As shown in FIG. 3A, the example formation tester 300 is provided with breakable connectors 301*a* and 301*b* to enable coupling the example formation tester 300 to a drill string (e.g., the drill string 104 of FIG. 1) or work string. The breakable connectors 301*a* and 301*b* are shown, by way of example, as threaded sections. However, any other type of breakable connector may be used instead.

Figure 3C:
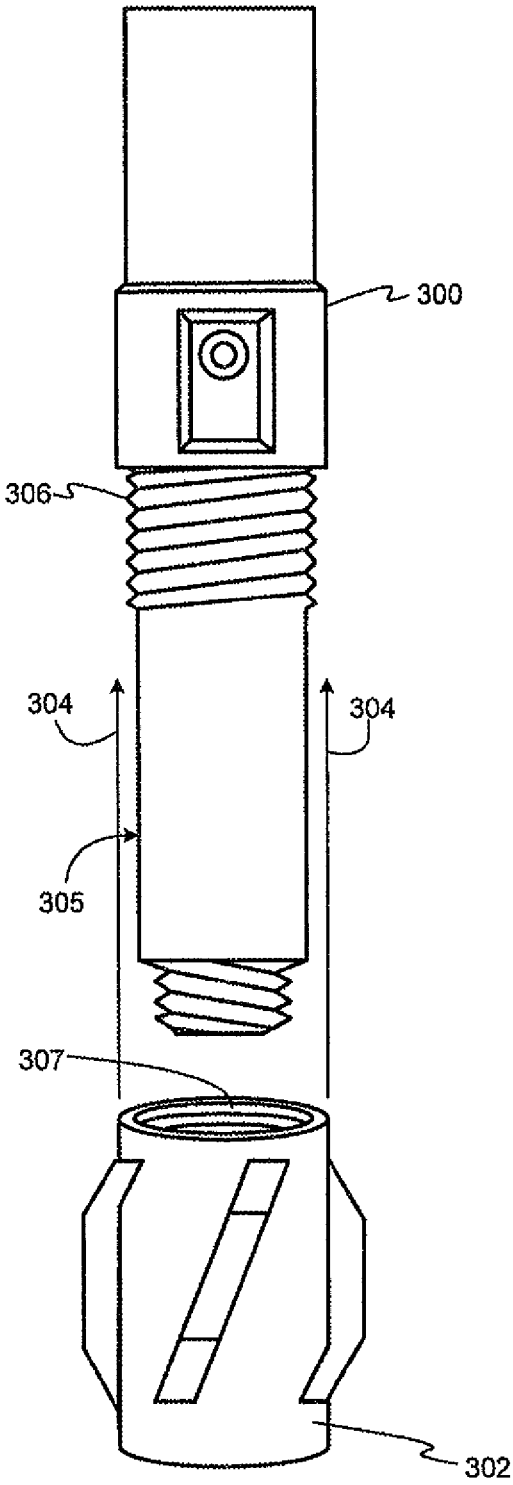
FIG. 3C depicts an exploded view of a stabilizer sleeve configured to be coupled to the tool collar of FIGS. 3A and 3B.

The example formation tester 300 is coupled to a stabilizer subassembly, in this case a stabilizer sleeve 302 (e.g., a screwon stabilizer sleeve). The example stabilizer sleeve 302 includes stabilizer blades 303, which may be substantially similar or identical to the example stabilizer blades 156 and 157 of FIG. 1. As shown in FIG. 3C, the stabilizer sleeve 302 is configured to be removably attached to the formation tester 300 by sliding the stabilizer sleeve 302 onto a portion of the formation tester 300 in a direction generally indicated by arrows 304 so that the formation tester 300 and the stabilizer sleeve 302 are in substantial coaxial alignment. To enable removably attaching the stabilizer sleeve 302 to the formation tester 300, the formation tester 300 includes an outer surface 305 (e.g., an outer diameter surface) and is provided with a plurality of threads 306 on a portion of the outer diameter surface 305 and the stabilizer sleeve 302 includes an inner surface (e.g., an inner diameter surface) is provided with a plurality of threads 307 on at least a portion thereof The plurality of threads 306 of the formation tester 300 are configured to threadingly engage the plurality of threads 307 of the stabilizer sleeve 302 to enable mechanically coupling the stabilizer sleeve 302 to the formation tester 300. In other example implementations, the stabilizer sleeve 302 may be configured to be coupled to the formation tester 300 via fastening interfaces or fastening elements other than threads.

In yet other example implementations, the stabilizer subassembly may comprise a collar with stabilizer blades coupled thereto or integral with the collar. This stabilizer subassembly may be substantially similar or identical to the collar 154 and the stabilizer blades 156 of FIG. 1. The stabilizer subassembly is configured to be coupled to a downbole tool similar or identical to the collar 158 of FIG. 1. In yet other example implementation, the stabilizer subassembly may comprise a reamer for enlarging the well.

The formation tester 300 is provided with example pads 308 and 310 having respective example measurement probes 312 and 314. The pads 308 and 310 and the probes 312 and 314 are removably coupled to the formation tester 300 as shown in FIGS. 7 and 8. In this manner, the formation tester 300 can accept a plurality of different pads and/or probes. In the illustrated example, the pads 308 and 310 do not function as stabilizer blades (e.g., the stabilizer blades 303).

In an example implementation, the lengths of the probes 312 and 314 may then be selected from a plurality of different probe lengths based on the desired offset (e.g., distance $d_1$ of FIG. 3B) of the probes 312 and 314 from an outer surface 318 of the formation tester 300. For example, the length of the probes 312 and 314 may be selected so that the distance $d_1$ is less than a distance $d_2$ from which an outer surface 320 of the stabilizer blade 303 is offset from an outer surface 322 of the stabilizer sleeve 302. In other example implementations, the thickness of the measurement pads 308 and 310 may be selected so that the distance $d_1$ is substantially similar or equal to the distance $d_2$. The thickness of the pads 308 and 310 may then be selected from a plurality of different pad thicknesses based on length of the selected probes 312 and 314.

In addition, some pads may be implemented using pads that can be extended or retracted relative to an outer surface (e.g., the surface 318) of a tool collar using electrical, hydraulic, and/or mechanical devices. For example, the pads may be extended and retracted using powered devices (e.g., hydraulic or electrical actuators, motors, etc.). In this manner, the pads may contact the formations in cases for which such contact facilitates or is beneficial for performing a measurement.

In a typical drilling application, a stabilizer subassembly (e.g., the stabilizer sleeve 302) is often selected based on the size of a drill bit assembly (e.g., the drill bit 106 of FIG. 1), which dictates the diameter of a wellbore (e.g., the wellbore 102 of FIG. 1). For instance, in the illustrated example of FIG. 1, the drill collar 154 is selected so that the stabilizer blades 156 protrude a distance (e.g., the distance $d_2$ of FIG. 3B) sufficiently offset from an outer surface (e.g., the outer surface 318) of the drill collar 154 to ensure substantially continuous contact between the stabilizer blades 156 and a formation surface of the wellbore 102. In this manner, the drill collar 154 can substantially reduce or prevent wobble in the bottom hole assembly 128.

Formation measurements sometimes require measurement probes (e.g., the measurement probes 312 and 314) to extend toward and contact a formation surface of a wellbore (e.g., the wellbore 102 of FIG. 1) or to extend relatively close to the formation surface without physically contacting the formation surface. In the illustrated example of FIG. 3B, the pads 308 and 310 protrude a distance $d_1$ that may be substantially similar to or less than the distance $d_2$ associated with the stabilizer sleeve 302 to facilitate extending the probes 312 and 314 to a formation surface by minimizing the travel distance required by the probes 312 and 314 to reach the formation surface but still protecting the probes. That is, as shown in FIG. 3B, in a non-measurement (retracted) position, the probes 312 and 314 can protrude from the formation tester 300 away from the outer surface 318 and be preferably, but not necessarily, positioned below outer pad surfaces 324 and 326 of the pads 308 and 310 so that the pads 308 and 310 protect the probes 312 and 314 during drilling. Then, during a measurement process, the probes 312 and 314 can be extended from within the pads 308 and 310 to a formation surface to, for example, draw formation material into the formation tester 300. In the illustrated example, the amount of travel length required for the probes 312 and 314 to extend during a measurement process is reduced by the extra initial length of the selected probes 312 and 314 beyond the outer surface 318 of the formation tester 300, and the protuberance of the selected probes 312 and 314 beyond respective ones of the outer surfaces 324 and 326 of the pads 308 and 310 when in a retracted position can be substantially reduced and/or eliminated by the extra thickness of the pads 308 and 310.

In some example implementations, the example apparatus and methods described herein may be implemented using a measurement/pad module that does not include an extendable probe. Formation measurements sometimes require measurement sensors to be located close to the formation surface of the wellbore. In this case, the plurality of measurement/pad modules may have sensors (not shown), located preferably, but not necessarily, below respective ones of the outer surface 324 and 326 of the pads 308 and 310, so that the pads 308 and 310 substantially protect the sensors during drilling. The pads 308 and 310 may also be configured to protrude a distance $d_1$ from an outer surface (e.g., the outer surface 318) of the drill collar 154. When the stabilizer sleeve 302 is replaced with another stabilizer sleeve (or with a wear band or slick sleeve) having a different offset distance $d_2$ (or a different outermost circumference), the pads 308 and 310 can be changed as described below in connection with FIGS. 7 and 8 so that the distance $d_1$ (FIG. 3B) is substantially similar to or less than the distance $d_2$ (FIG. 3B).

Figure 3D:
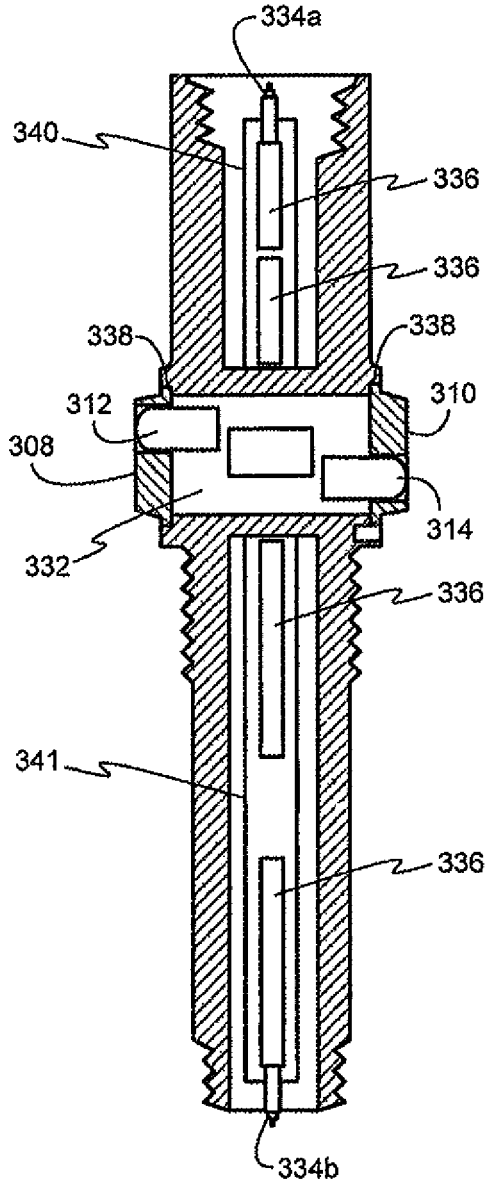
FIG. 3D depicts a cross-sectional view of the tool collar of FIGS. 3A-3C.

In the illustrated example of FIG. 3D, a cross-sectional view of the formation tester 300 shows that the pads 308 and 310 are separate from a probe module 332 that includes the probes 312 and 314 so that the pads 308 and 310 and the probes 312 and 314 can be replaced using other pads and other probes without replacing the probe module 332. However, in other example implementations, the pads 308 and 310 and the probes 312 and 314 can be part of a pad/probe module that is removably insertable in or mountable to the formation tester 300. In this case, the pad/probe module together with the probes 312 and 314 can be replaced using other pad/probe modules. Alternatively, the pad 308 and the probe 312 can form a first pad/probe module and the pad 310 and the probe 314 can form a second pad/probe module. In the illustrated example of FIG. 3D, the formation tester 300 includes recesses 338 formed therein to receive respective ones of the pads 308 and 310. However, in some example implementations, recesses need not be provided to couple the pads 308 and 310 to a formation tester.

Also shown in FIG. 3D, the formation tester includes a tool bus interfaces 334*a-b* substantially similar or identical to the tool bus interfaces 212*a-b* of FIG. 2. The tool bus (not shown) connects the tool bus interfaces 334*a-b* and runs through an upper mandrel chassis 340 and a lower mandrel chassis 341. The upper mandrel chassis 340 and the lower mandrel chassis 341 are configured to hold a plurality of components 336 (e.g., some or all of the components 218, 220, 222, 224, and 226 of the electronics system 214 of FIG. 2), a battery (e.g., the battery 216 of FIG. 2), components of a hydraulic system (e.g., the hydraulic system 230 of FIG. 2), and/or a motor (e.g., the motor 232 of FIG. 2). The upper mandrel chassis 340 and/or the lower mandrel chassis 341 typically include mechanical, electrical, and/or hydraulic interfaces that are relatively easily connectable to corresponding interfaces in the probe module 332, as further described below, for example, in connection with FIGS. 11 and 12.

Figure 4:
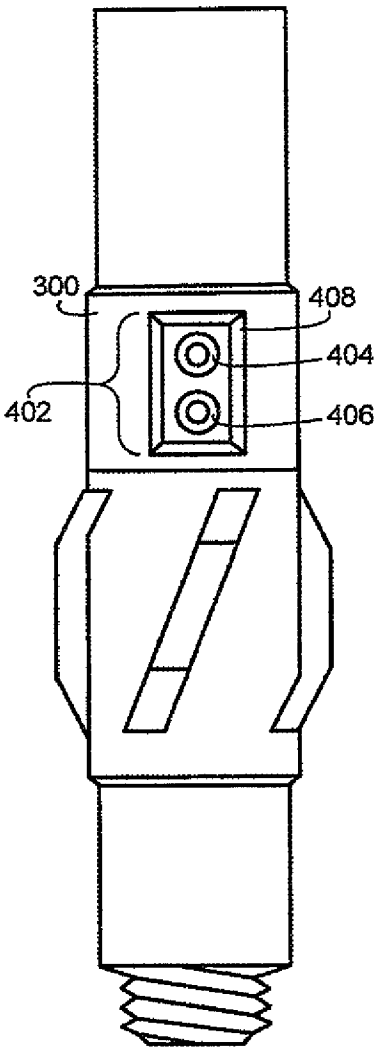
FIG. 4 depicts the example tool collar of FIGS. 3A-3C having an example probe module implemented using a two-probe-per-pad configuration.

Probe modules (e.g., the probe module 332 of FIG. 3D) may also be interchanged with other probe modules having different sensor types or other different characteristics (e.g., shape, number of probe openings or inlets, etc.). For example, different probe modules may accommodate different probe sizes. FIG. 4 depicts the example formation tester 300 of FIGS. 3A-3D having an example probe module 402 that is implemented using a two-probe-per-side probe module that includes two probes 404 and 406 recessed in a pad 408 and configured to, for example, measure formation fluid mobility. Each of the probes 404 and 406 may be provided to perform the same or different types of measurements and the probes 404 and 406 may be configured to operate independent of one another (e.g., extend and retract independent of one another and perform measurement operations independent of one another).

Figure 5:
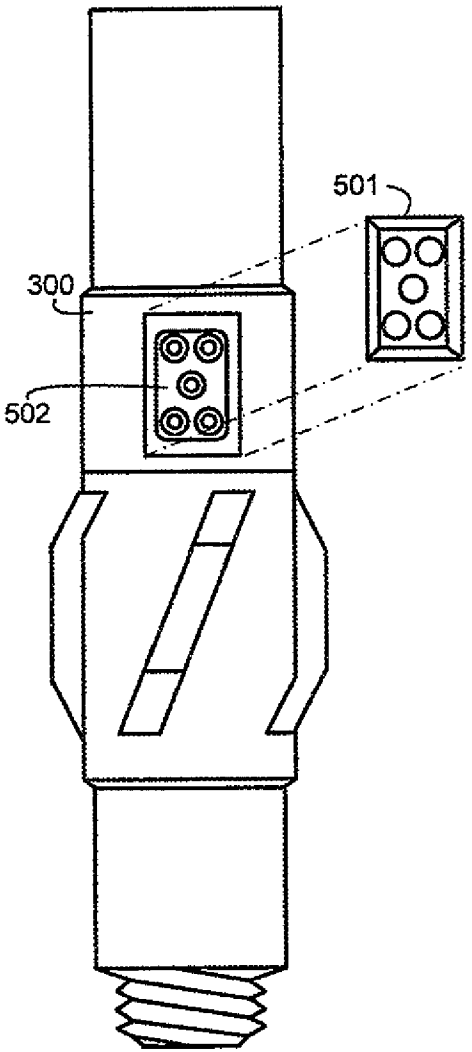
FIG. 5 depicts the example tool collar of FIGS. 3A-3D having another example probe module implemented using a five-probe-per-pad configuration.

FIG. 5 depicts a pad 501 removed from the formation tester 300, which, in the illustrated example, includes an example probe module 502 that is implemented using a multiple-probe-per-pad configuration. The probe module 502 may be configured to extend and retract its probes simultaneously. Inlets of the probes may be connected to a single flow line and a single pressure sensor to, for example, measure an average response of a formation over a distributed area.

Figure 6:
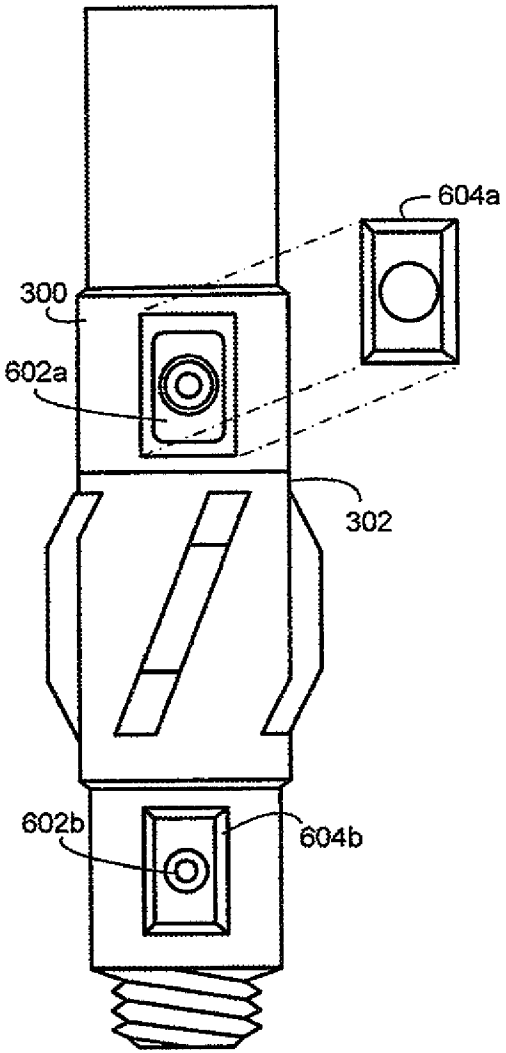
FIG. 6 depicts an example tool collar having probe modules located at opposing ends of a stabilizer sleeve.

FIG. 6 depicts an example configuration of the formation tester 300 having probe modules 602*a-b* and respective probe pads 604*a-b* located at opposing ends (e.g., above and below) of the stabilizer sleeve 302. The example configuration of FIG. 6 enables the same or different types of measurements to be performed simultaneously at different depths of a wellbore (e.g., the wellbore 102 of FIG. 1). In addition, placing probe modules and pads on the formation tester 300 as shown in FIG. 6 enables any number of different types of measurements to be performed simultaneously or at different times. In the illustrated example, the probe assembly 602*a* includes a guard probe and the probe assembly 602*b* includes a pressure probe similar to probe 1600 of FIG. 17. The guard probe of the probe assembly 602*a* has a first peripheral inlet configured to draw mud filtrate that may have infiltrated the formation along a wellbore (e.g., the wellbore 102 of FIG. 1), and a second, central inlet so that formation fluid samples drawn by the central inlet of the probe assembly 602*a* are substantially clean (e.g., the formation fluid samples drawn by the central inlet are relatively cleaner than they would otherwise be without the use of the guard probe provided by the probe assembly 602*a*).

Although FIGS. 4, 5, and 6 show circular probes, the probes could have any other shape (e.g., an elliptical or elongated shape). Also, although FIGS. 4, 5, and 6 depict a drill string portion having one tool collar (e.g., the formation tester 300) in other example implementations, a drill string may have any number of tool collars.

FIG. 7 illustrates a partially assembled view of the example formation tester 300 of FIGS. 3A-3D) having a probe module 702 removably inserted therein that includes the probe 312 of FIGS. 3A, 3B, and 3D and FIG. 8 illustrates an exploded view in which the probe module 702 is removed from the formation tester 300. In the illustrated example, the pad 308 of FIGS. 3A, 3B, and 3D is separate from the probe module 702 and is removed from the formation tester 300. However, in other example implementations, the pad 308 is part of or integral with the probe module 702.

As shown in FIGS. 7 and 8, the formation tester 300 is provided with an opening 704 (e.g., a slot an aperture, etc.) into which the probe module 702 can be removably inserted. In addition, the formation tester 300 is provided with an area 705 on the outer surface 318 of the formation tester 300 substantially surrounding a perimeter formed by the opening 704. The area 705 is configured to receive the pad 308. Threaded apertures or holes 706 are formed on the outer surface 318 in the area 705 that can be used to fasten the pad 308 to the formation tester 300 using fastening elements 708 (e.g., screws 708) to, for example, hold the probe module 702 in the opening 704. Although the probe module 702 is shown in FIGS. 7 and 8 as being removable from the formation tester 300, in some example implementations, the probe module 702 may be integral with the formation tester 300. However, an operator may interchange the pad 308 with other pads as desired.

Figure 9:
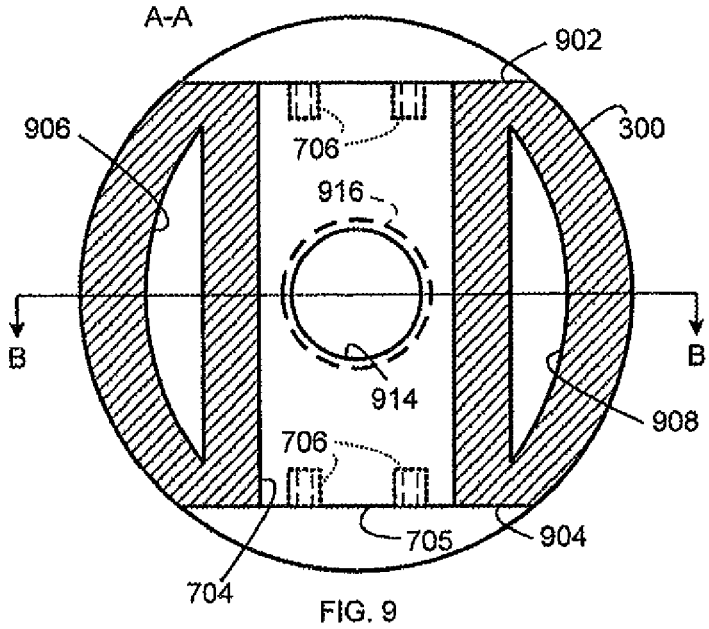
FIG. 9 is a cross-sectional view A-A of the example tool collar of FIG. 8.
Figure 10:
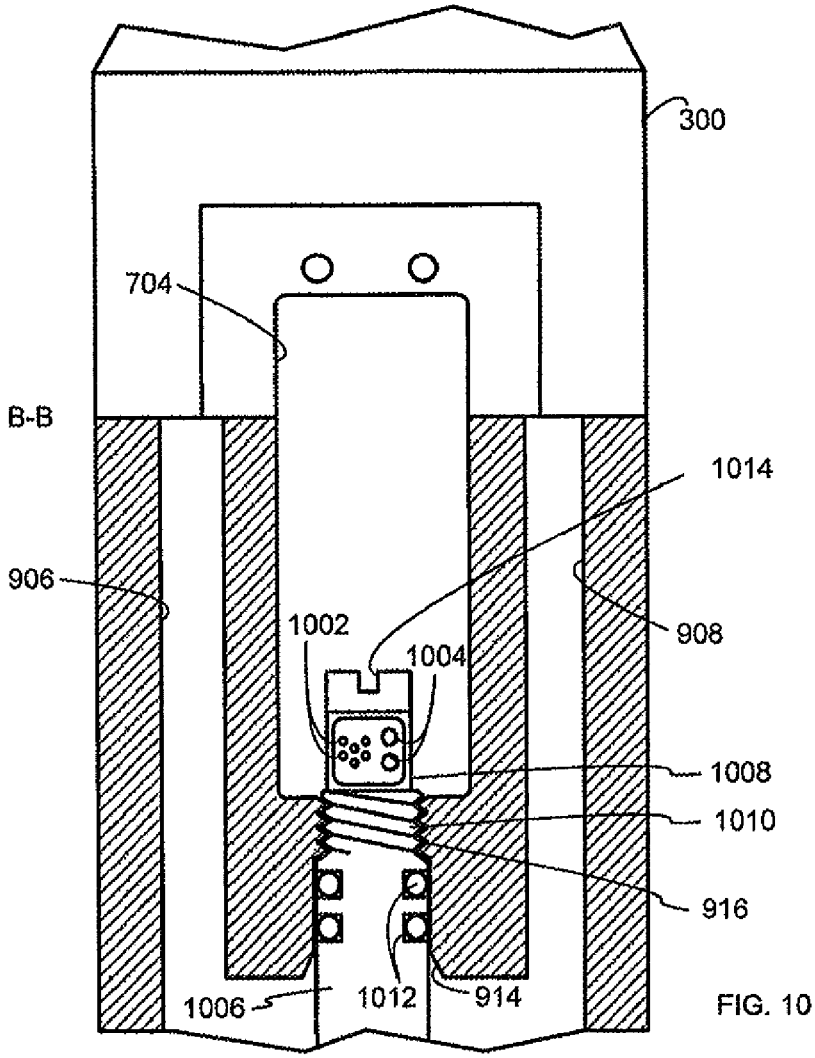
FIG. 10 is a partial cross-sectional view B-B of the example tool collar of FIGS. 7 and 8 and depicts an example rotatable connector used to provide electrical and hydraulic connectors to the probe module of FIGS. 7 and 8.

FIG. 9 is a cross-sectional view A-A and FIG. 10 is a partial cross-sectional view B-B of the example formation tester 300 of FIGS. 7 and 8. The example formation tester 300 includes recesses 902 and 904 (FIG. 9) to receive respective ones of the pads 308 and 310 (FIG. 3B) and the opening 704 to receive the probe module 702 (FIGS. 7 and 8). In the illustrated example, the recess 904 is formed in the area 705. In the illustrated example of FIG. 9, the opening 704 is shown as extending through the example formation tester 300. However, in other example implementations, the opening 704 may extend from the outer surface 318 (FIG. 3B) of the formation tester 300 toward a central or longitudinal axis of the formation tester 300 only partially into the example formation tester 300.

To enable drilling fluid (e.g., the drilling fluid 116 of FIG. 1) to flow through a drill string (e.g., the drill string 104 of FIG. 1), the example formation tester 300 is provided with drilling fluid passageways 906 and 908 (FIGS. 9 and 10) formed on either side of and adjacent to the opening 704. The fluid passageways 906 and 908 extend along a length of the formation tester 300 substantially parallel to a central or longitudinal axis of the formation tester 300 and are configured to hydraulically connect annular passageways within a drill string (e.g., the drill string 104 of FIG. 1) through which drilling fluid (e.g., the drilling fluid 116 of FIG. 1) flows toward a drill bit (e.g., the drill bit 106 of FIG. 1). To receive electrical connectors 1002 and/or hydraulic connectors 1004 (FIG. 10) from for example, a chassis (e.g., the mandrel chassis 340 or 341 of FIG. 3D), the example formation tester 300 is provided with a passageway 914 (FIGS. 9 and 10) extending along a length of the formation tester 300 substantially parallel to a central or longitudinal axis of the formation tester 300 and substantially parallel and adjacent to the fluid passageways 906 and 908. In the illustrated example, the passageway 914 is coaxial with the central or longitudinal axis of the example formation tester 300.

As shown in FIG. 10, the passageway 914 is configured to receive a chassis 1006 having a rotatable connector 1008 rotatably mounted thereon. The rotatable connector 1008 includes the electrical connectors 1002 and the hydraulic connectors 1004. In the illustrated example, the passageway 914 includes a threaded portion 916 (FIGS. 9 and 10), and the chassis 1006 includes a threaded portion 1010 configured to be threadingly coupled to the threaded portion 916 of the passageway 914. To prevent the drilling fluid 116 from flowing into the opening 704, the chassis 1006 is provided with o-rings 1012. To align electrical and hydraulic connectors (not shown) of the probe module 702 with the electrical connectors 1002 and the hydraulic connectors 1004, the rotatable connector 1008 is provided with a keyway 1014, To assemble the probe module 702 (FIGS. 7 and 8) with the formation tester 300, the chassis 1006 can first be threadingly coupled to the formation tester 300 causing the rotatable connector 1008 to extend into the opening 704. The probe module 702 can then be inserted and slid into the opening 704. The rotatable connector 1008 can be rotated to align the keyway 1014 with a key of the probe module 702 so that the electrical connectors 1002 and the hydraulic connectors 1004 align with electrical and hydraulic connectors of the probe module 702. Note that although six electrical connectors are shown in FIG. 10, the rotatable connector 1008 may include any desired number of electrical connectors. Note also that although two hydraulic connectors are shown in FIG. 10, the rotatable connector 1008 may include any desired number of hydraulic connectors. Upon insertion of the probe module 702, electric wires (not shown) in the chassis 1006 that are terminated at the electrical connectors 1002 are connected to electric wires (not shown) in the probe module 702. The electrical connectors may include a pin socket assembly as well known in the art. Also, hydraulic or flow lines (not shown) in the chassis 1006 that are terminated at the hydraulic connectors 1002 are connected to hydraulic or flow lines (not shown) in the probe module 702. The hydraulic connectors may comprise a hydraulic stabber well known in the art. Further details of the connectors can be found in FIGS. 12 and 13. The pad 308 (FIGS. 3A, 3B, 3D, 7, and 8) can then be placed over the probe module 702 and fastened to the formation tester 300.

Figure 11:
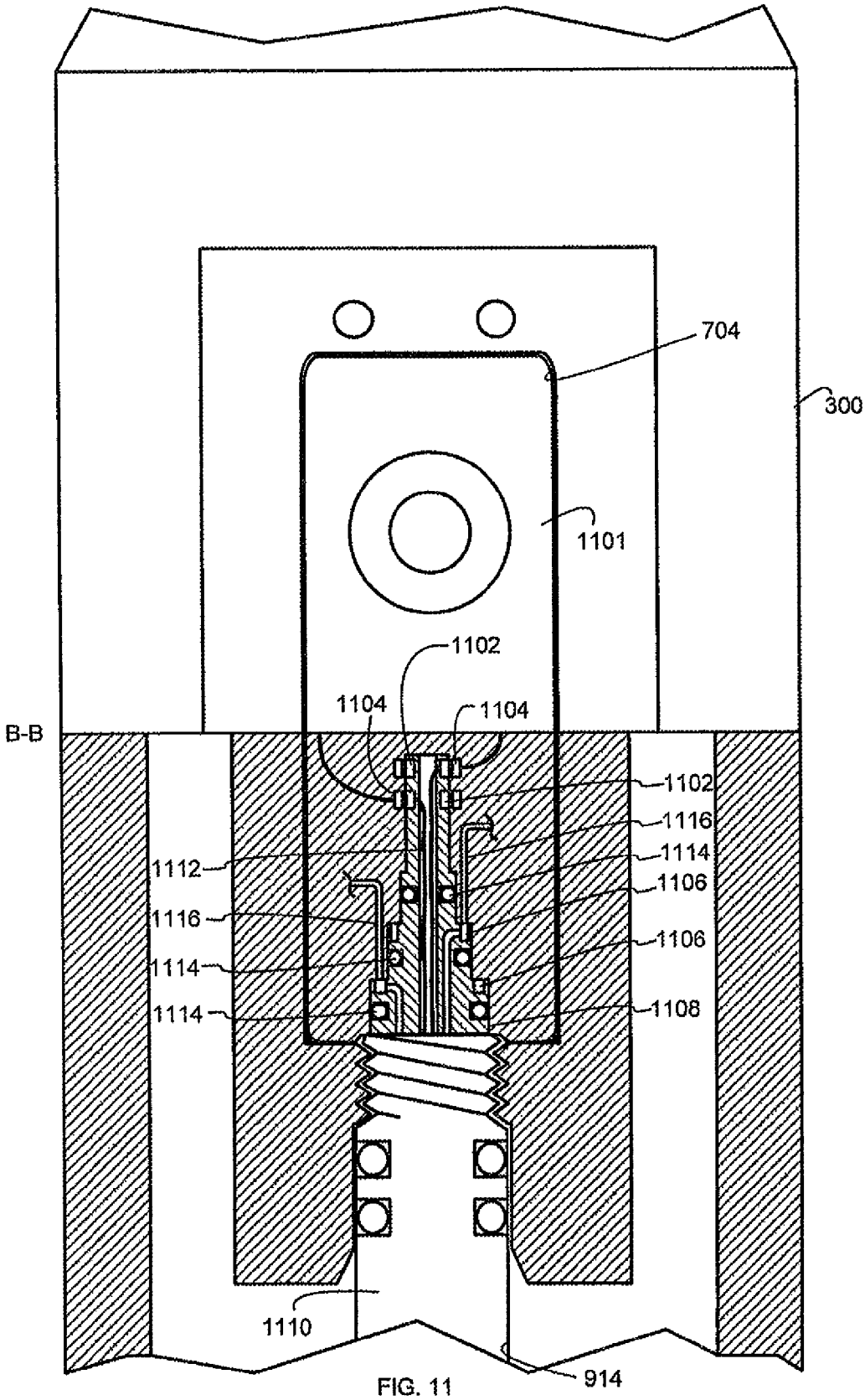
FIG. 11 depicts an alternative example implementation in which a coaxial connector is used to provide electrical and hydraulic connectors.

FIG. 11 depicts an alternative example implementation of electrical and hydraulic connectors in which an example probe module 1101 is configured to electrically and fluidly engage a coaxial connector 1108 having electrical connectors 1102 and hydraulic connectors 1106. In the illustrated example, the coaxial connector 1108 is coupled to a chassis 1110 substantially similar or identical to the mandrel chassis 340 or 341 of FIG. 3D. In the illustrated example, the electrical connectors 1102 are provided on a surface of the coaxial connector 1108 and are configured to engage corresponding electrical connectors 1104 of the probe module 1101. Wires 1112 electrically coupled to the electrical connectors 1102 are routed through a passage in the coaxial connector 1108 and are provided to transfer communication signals and/or electric power through the electrical connectors 1102 and 1104 and from, for example, an electronics system (e.g., the electronics system 214 of FIG. 2) and/or a battery (e.g., the battery 216 of FIG. 2) to components in the probe module 1101. The hydraulic connectors 1106 are implemented using annular grooves (i.e., annular grooves 1106) provided about the coaxial connector 1108 between o-rings 1114 and are configured to fluidly engage similar annular grooves of the probe module 1101 and fluidly connect fluid passageways fluidly coupled to hydraulic components in the chassis 1110 to passageways 1116 formed in the probe module 1101 and fluidly coupled to components in the probe module 1101 including, for example, a compensator (e.g., a compensator 1436 of FIG. 10), and/or an extending chamber (e.g., an extending chamber 1482*a* of FIG. 10) used to move a probe.

As the coaxial connector 1108 is inserted into and engages the probe module 1101, the electrical connectors 1102 engage their respective electrical connectors 1104 and the annular grooves 1106 engage respective grooves that fluidly couple fluid passageways in the chassis 1110 to the fluid passageways 1116. In the illustrated example of FIG. 11, the coaxial connector 1108 configuration enables first inserting the probe module 1114 into the opening 704 and subsequently inserting and threadingly coupling the chassis 1110 (and, thus, the coaxial connector 1108) into the passageway 914 to electrically couple the electrical connectors 1102 and 1104 and to fluidly couple fluid passageway in the chassis 110 to the fluid passageways 1116.

Figure 12:
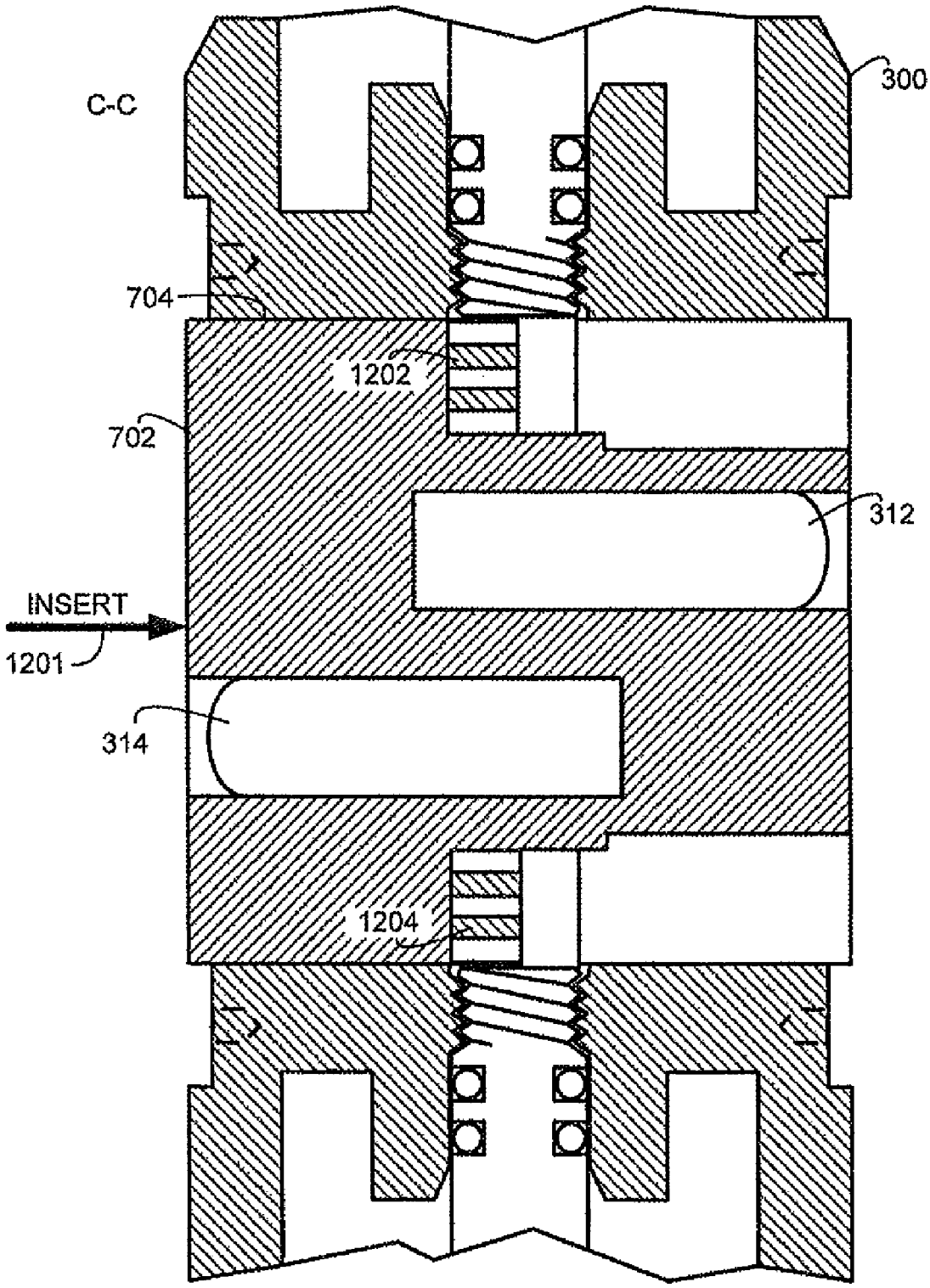
FIG. 12 is another cross-sectional view C-C of the example tool collar of FIGS. 7 and 8 in which the example probes of FIGS. 7 and 8 are provided using an integrally formed probe module.

FIG. 12 is another cross-sectional view C-C of the example formation tester 300 of FIGS. 7 and 8. In the illustrated example, the probe module 702 is implemented using an integrally formed probe module that includes both of the example probes 312 and 314. In this manner, inserting the probe module 702 into the opening 704 in a direction generally indicated by arrow 1201 provides the example formation tester 300 with both of the example probes 312 and 314 simultaneously.

Figure 13:
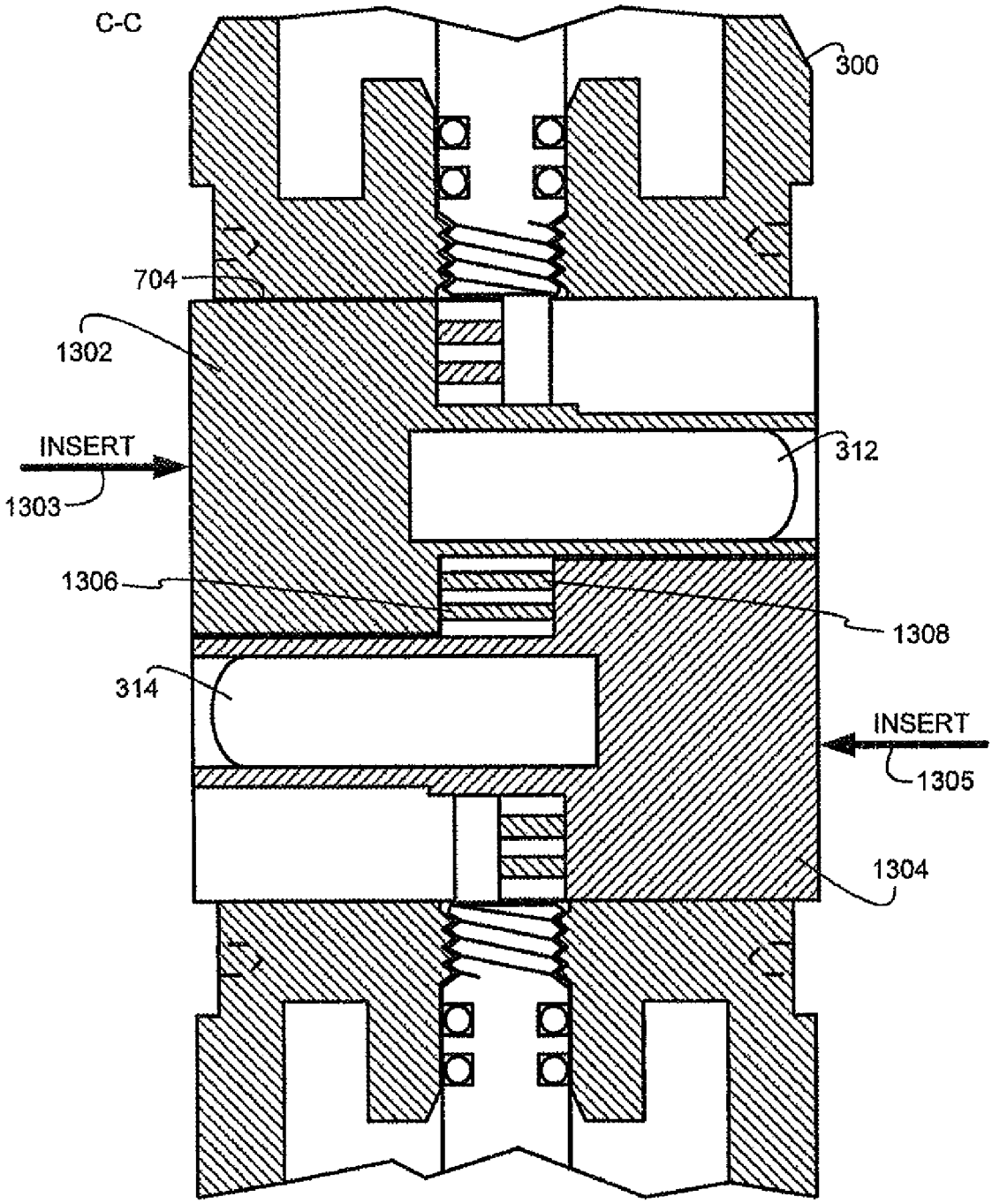
FIG. 13 illustrates the cross-sectional view C-C of the example tool collar of FIGS. 7 and 8 in which each of the example probes of FIGS. 7 and 8 is provided via a separate and respective probe module.

In an alternative example implementation shown in FIG. 13, a first example probe module 1302 includes the example probe 312 and a second example probe module 1304 includes the example probe 314. In the illustrated example of FIG. 13, the probe module 1302 may be removably inserted into the opening 704 in a direction generally indicated by arrow 1303 and the probe module 1304 may be removably inserted into the opening 704 in a direction generally indicated by arrow 1305. In addition, each of the probe modules 1302 and 1304 may be interchangeable with each other.

As shown in FIG. 12, electrical and hydraulic interfaces 1202 and 1204 are provided on respective ends of the example probe module 702 to electrically and fluidly couple the example probe module 702 to other drill string segments (e.g., the upper chassis 340 and the lower chassis 341 of FIG. 3D). The electrical and hydraulic interfaces 1202 and 1204 include, for example, conductive pins (not shown) to engage the electrical socket 1002 (FIG. 10) of the rotatable connector 1008 and fluid couplings (e.g., hydraulic fittings) to engage the hydraulic connectors 1004 (FIG. 10) of the rotatable connector 1008.

As shown in FIG. 13, to electrically and hydraulically connect the first probe module 1302 to the second probe module 1304, each of the first and second probe modules 1302 and 1304 is provided with a respective electrical and hydraulic interface 1306 and 1308. The electrical and hydraulic interfaces 1306 and 1308 are configured to electrically and fluidly couple to one another to enable electrical current flow and hydraulic fluid flow between the first and second probe modules 1302 and 1304.

Figure 14:
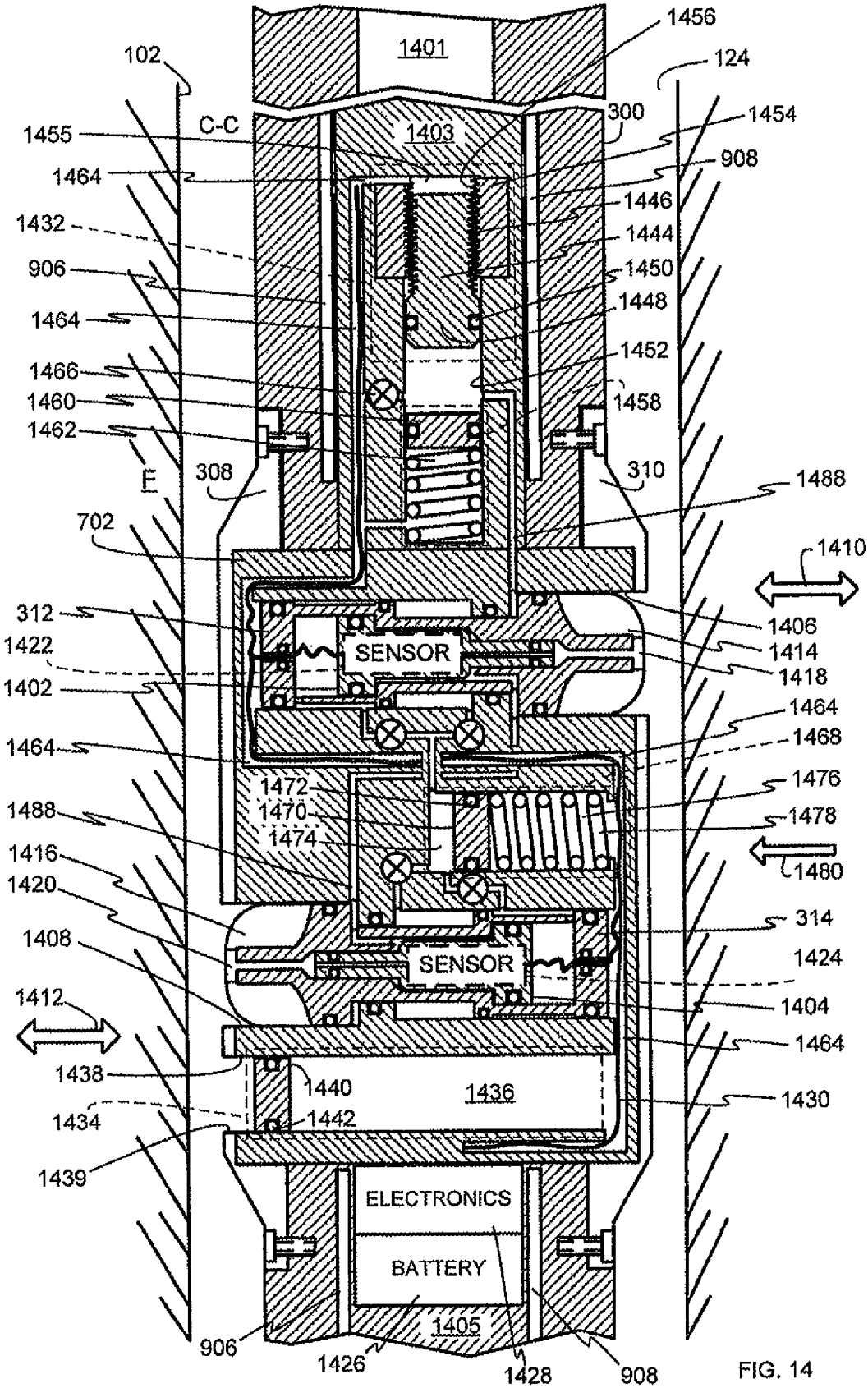
FIGS. 14 and 15 illustrate detailed diagrams of the example probe module 702 removably inserted in the example tool collar of FIGS. 3A-3D.
Figure 15:
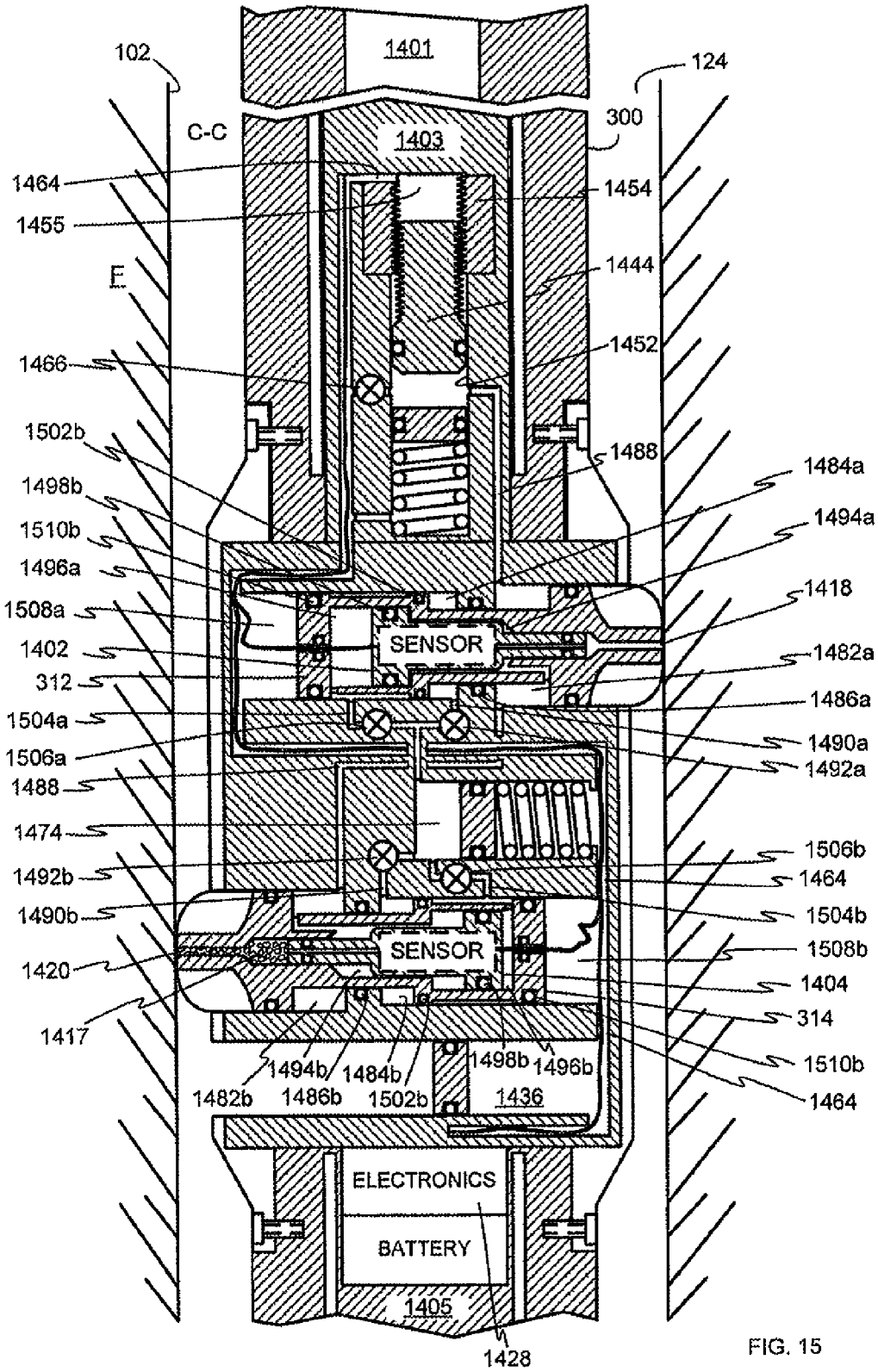

FIGS. 14 and 15 illustrate detailed cross-sectional (section C-C) diagrams of the example probe module 702 removably inserted in the example formation tester 300 of FIGS. 3A-3D. As shown in FIGS. 14 and 15, the probe module 702 is held in place in part by the pads 308 and 310 that are fastened to the formation tester 300. Also shown is an annular passageway 1401 that enables drilling fluid (e.g., the drilling fluid 116 of FIG. 1) to flow through the formation tester 300. The annular passageway 1401 is split to form passageways 906 and 908 of FIG. 9 around an upper chassis 1403, a lower chassis 1405, and the probe module 702. The upper chassis 1403 may be substantially similar or identical to the upper chassis 340 of FIG. 3D and may be configured to hold or contain, for example, hydraulic components (e.g., an actuator 1432 and an accumulator 1458). Although not shown in FIGS. 14 and 15 for clarity, the upper chassis may be fluidly and/or electrically connected to the probe module 702 using, for example, the rotatable connector 1008 as discussed above in connection with FIGS. 10 and 12 or the coaxial connector 1108 as discussed above in connection with FIG. 11. Of course, any other type of connector may be used. The lower chassis 1405 may be substantially similar or identical to the lower chassis 341 of FIG. 3D and may be configured to hold or contain, for example, an electronics module 1428 and a battery 1426. Although not shown in FIGS. 14 and 15 for clarity, the lower chassis 1405 may also be fluidly and/or electrically coupled to the probe module 702 in a similar way as the upper chassis is coupled to the probe module 702. Although portions and components of the example probe module 702 are shown in a particular arrangement in other example implementations the components of the example probe module 702 may be rearranged while maintaining connections and functional relationships therebetween to implement the same functionality as described below in connection with FIGS. 14 and 15.

To perform measurements associated with the formation F, the probe module 702 is provided with drawdown pistons 1402 and 1404 located within respective ones of the measurement probes 312 and 314. The probes 312 and 314 are configured to extend and retract relative to respective probe openings 1406 and 1408 of the probe module 702 during a measurement process in directions generally indicated by arrows 1410 and 1412. In addition, to draw formation material into the probes 312 and 314, each of the drawdown pistons 1402 and 1404 is configured to move relative to its respective probe 312 and 314 in the directions generally indicated by the arrows 1410 and 1412. To engage a formation surface of a wellbore (e.g., the wellbore 102 of FIG. 1) and form a seal between the formation surface and the probes 312 and 314 to facilitate drawing the formation material into the probes 312 and 314, each of the probes 312 and 314 is provided with a respective packer or seal 1414 and 1416 made of, for example, a substantially deformable elastomeric material. In an alternative example implementation, the probes 312 and 314 may be configured to perform measurements without engaging a formation surface.

In the illustrated example, the drawdown pistons 1402 and 1404 are preferably, but not necessarily, equipped with position sensors or displacement sensors (e.g., analog potentiometers, digital encoders, etc.) (not shown) to determine and/or substantially continuously monitor their position within the probes 312 and 314.

In the illustrated example of FIG. 14, the probes 312 and 314 are shown in a retracted, home position at which the packers 1414 and 1416 are within the probe openings 1406 and 1408. In the illustrated example of FIG. 15, the probes 312 and 314 are shown in an extended, measurement position in which the packers 1414 and 1416 are extended away from the openings 1406 and 1408. Also in FIG. 15, the drawdown piston 1402 is shown in an extended, home position. However, to draw formation fluid from the formation surface through a formation fluid port 1418 into the probe 312, the drawdown piston 1402 is configured to be retracted relative to the probe 312. For example, the drawdown piston 1404 of the probe 314 is shown in a retracted position drawing formation fluid 1417 into the probe 314 via formation fluid port 1420.

To perform measurements, the probe module 702 is provided with sensors 1422 and 1424 (FIG. 14) located within respective ones of the drawdown pistons 1402 and 1404. The sensors 1422 and 1424 may be implemented using, for example, pressure sensors, temperature sensors, etc. The sensors 1422 and 1424 may be the same or different sensor types. In the illustrated example, the sensors 1422 and 1424 are electrically and/or communicatively coupled to a battery 1426 (FIG. 14) and an electronics system 1428 (FIG. 14) via cables 1430 (FIG. 14). In this manner, the cables 1430 may be used to provide electrical power to the sensors 1422 and 1424 from, for example, the battery 1426. In addition, the cables 1430 may also be used to communicate control information between the electronics system 1428 and electrical components in the upper chassis 1403 of the formation tester 300 and/or in the probe module 702, and communicate measurement information to the electronics system 1428. A common serial bus protocol (e.g., RS-485) or a controller area network ("CAN") bus protocol may be used in combination with the electronics system 1428 to communicate control information and/or measurement information. The electronics system 1428 may be substantially similar or identical to the electronics system 214 of FIG. 2.

The components of the example probe module 702 are configured to extend and retract the probes 312 and 314 and the drawdown pistons 1402 and 1404 using energy associated with an actuator 1432 that is preferably, but not necessarily, compensated to annulus pressure $A_p$. Annulus pressure $A_p$ refers to the pressure of drilling mud in the annulus 124. To pressurize, for example, clean oil or hydraulic oil in the formation tester 300 to the annulus pressure $A_p$, the probe module 702 is provided with a compensator 1434 having an annulus pressure chamber 1436 filled with the clean oil or hydraulic oil and separated from drilling mud by a piston or bellow 1440 having an o-ring 1442. In the illustrated example of FIGS. 14 and 15, the pad 308 is shown as having an aperture 1439 formed therethrough to enable drilling mud to flow into the annulus fluid port 1438.

To receive the probes 312 and 314 when the probes 312 and 314 are retracted, the probe module 702 is provided with back chambers 1508*a* and 1508*b*. The probes 312 and 314 are provided with respective o-rings 1510*a* and 1510*b* to sealingly separate the back chambers 1508*a* and 1508*b* from the drawdown piston control chambers 1496*a* and 1496*b*. The fluid line 1464 fluidly couples the back chambers 1508*a* and 1508*b* to the annulus pressure chamber 1436 of the compensator 1434.

In the illustrated example, the actuator 1432 is implemented using a lead screw configuration. For example, a motor (not shown) that is substantially similar or identical to the motor 232 (FIG. 2) is coupled to an actuator screw or ram 1444 preferably, but not necessarily, via a gearbox (not shown). A nut 1454 may be fixedly coupled to the chassis. In addition, an end of the screw 1444 may be coupled via a ball joint (not shown) to a flange 1448 that forms a piston-like structure having an o-ring 1450 that sealingly engages an actuation chamber 1452 to generate hydraulic pressure. The motor can be activated and deactivated using an electronic control circuit (e.g., the electronics system 1428) to move the actuator ram or screw 1444. A back chamber 1455 formed by the screw 1444, the nut 1454, and the upper chassis 1403 is preferably, but not necessarily, filled with hydraulic oil and is fluidly coupled to the annulus pressure chamber 1436 of the compensator 1434 via an annulus pressure fluid line 1464. Thus, the flange 1448 is pressure compensated at an annular pressure $A_p$. The actuation chamber 1452 is fluidly coupled to the probe module 702 via a power fluid line 1488. A solenoid valve 1466 is disposed between the actuation chamber 1452 and the annulus pressure fluid line 1464 to selectively discharge or vent the hydraulic pressure generated in the actuation chamber 1452. Preferably, the solenoid valve 1466 is closed when energized, and is open when de-energized. In this manner, the pressure in the actuation chamber 1452 is equal to the pressure (e.g., a compensator pressure) of the annulus pressure chamber 1436 when the solenoid valve 1466 is de-energized. The motor may then be activated to rotate in a reverse direction to reset the actuator screw 1444 in its initial position.

The pressure in the actuation chamber 1452 may be sensed by a pressure sensor and transmitted to the electronics system 1428. The electronics system 1428 can then use the value indicative of the pressure to determine and/or control the amount of force the packers 1414 and 1416 exert against the formation surface and to control the motion (e.g., extension and retraction) of the drawdown pistons 1402 and 1404.

To relatively quickly pull down or retract the drawdown pistons 1402 and 1404 to generate a relatively high flow rate of the formation fluid 1417 into the probes 312 and 314, the formation tester 300 is provided with an accumulator 1458 that can be charged by the actuator 1432. The accumulator 1458 includes a piston 1460 and a coil spring 1462. As the motor moves the actuator screw 1444 toward the accumulator 1458, and the hydraulic fluid in the actuation chamber 1452 is prevented from discharging by expelling fluid into the power fluid line 1488, the hydraulic fluid pushes against the piston 1460 causing the coil spring 1462 to compress and store energy. In this manner, the energy stored in the accumulator 1458 can subsequently be used to achieve a high flow rate in power fluid line 1488 to, for example, relatively quickly pull down or retract the drawdown pistons 1402 and 1404. Specifically, a relatively quick extension of the coil spring 1462 causes a relatively quick dispersion of hydraulic fluid that might not be achievable when the motor alone is used. In some example implementations, the accumulator 1458 may be eliminated.

To store energy to retract the probes 312 and 314 into the probe openings 1406 and 1408 and/or maintain the probes 312 and 314 in a retracted position and/or to extend the drawdown pistons 1402 and 1404 with the probes 312 and 314, the probe module 702 is provided with a retractor 1468. The retractor 1468 includes a piston 1470 having an o-ring 1472 that sealingly separates a retractor storage chamber 1474 from a retractor spring chamber 1476, which is fluidly coupled to the annulus pressure chamber 1436 of the compensator 1434 via the annular pressure flow line 1464. The retractor spring chamber 1476 includes a coil spring 1478 inserted therein that provides a force against the piston 1470 in a direction generally indicated by arrow 1480.

To extend and retract the probes 312 and 314 based on the actuator 1432, the accumulator 1458, and the retractor 1468, the probe module 702 is provided with respective extending chambers 1482*a* and 1482*b* (FIG. 15) and respective retracting chambers 1484*a* and 1484*b* (FIGS. 14 and 15) for each of the probes 312 and 314. The extending chambers 1482*a-b* are sealingly separated from the retracting chambers 1484*a-b* by respective o-rings 1486*a* and 1486*b*. The extending chambers 1482*a-b* are fluidly coupled to the actuation chamber 1452 via a power fluid line 1488. The retracting chambers 1484*a-b* and the retractor storage chamber 1474 are fluidly coupled via respective control fluid lines 1490*a* and 1490*b*.

Solenoid valves 1492*a* and 1492*b* are provided along the control fluid lines 1490*a-b* to control the flow of hydraulic fluid between the retractor storage chamber 1474 and the retracting chambers 1484*a-b*. In the illustrated example, the solenoid valves 1492*a* and 1492*b* may be configured to be normally open (when de-energized.).

To extend and retract the drawdown pistons 1402 and 1404 relative to the probes 312 and 314, the probes 312 and 314 and the drawdown pistons 1402 and 1404 form respective drawdown piston actuating chambers 1494*a* and 1494*b* (FIG. 15) and respective drawdown piston control chambers 1496*a* and 1496*b* (FIG. 15). Each of the drawdown pistons 1402 and 1404 is provided with a respective o-ring 1498*a* and 1498*b* (FIG. 15) to sealingly separate the drawdown piston actuating chambers 1494*a-b* from the drawdown piston control chambers 1496*a-b*. In addition, to sealingly separate the drawdown piston control chambers 1496*a-b* from the retracting chambers 1484*a-b*, the probes 312 and 314 are provided with o-rings 1502*a* and 1502*b*.

Each of the drawdown piston control chambers 1496*a-b* is fluidly coupled to the retractor storage chamber 1474 via respective control fluid lines 1504*a* and 1504*b*. The probe module 702 is provided with a solenoid control valve 1506*a* at the control fluid line 1504*a* and a solenoid control valve 1506*b* at the control fluid line 1504*b* to control fluid flow between the retractor storage chamber 1474 and the drawdown piston control chambers 1496*a-b*. In the illustrated example, the solenoid valves 1506*a* and 1506*b* may be configured to be normally open (when de-energized).

To protect the probes 312 and 314 during a drilling operation, the retractor 1468 and the solenoid valves 1492*a-b*, 1506*a-b*, and 1466 are configured to cause the probes 312 and 314 to remain in a retracted position and the drawdown pistons 1402 and 1404 to remain in an extended position when electrical power is removed from valves 1492*a-b*, 1506*a-b*, and 1464 during, for example, normal operation or a power failure. In this manner, when power is removed from the valves 1492*a-b*, 1506*a-b*, and 1464 during a drilling operation, the probes 312 and 314 do not inadvertently or unintentionally extend, which would otherwise cause the probes 312 and 314 to be damaged when subjected to the forces of a drill string (e.g., the drill string 102 of FIG. 1) against a formation surface while drilling. In particular, energy stored in the coil spring 1478 can be used to retract the probes 312 and 314 and/or cause the probes 312 and 314 to remain in a retracted position. For example, in the event of a power failure, the solenoid valve 1466 opens, thereby, equalizing the pressure in the power fluid line 1464 to the annular pressure $A_p$. The solenoid valves 1492*a-b* open allowing fluid to flow from the retractor storage chamber 1474 to the retracting chambers 1484*a-b* via the flow lines 1490*a-b*. As the energy stored in the coil spring 1478 causes the coil spring 1478 to push against the piston 1470, the piston 1470 causes fluid to flow from retractor storage chamber 1474 to the retracting chambers 1484*a-b*, which causes the volumes of the retracting chambers 1484*a-b* to increase and/or prevents the volumes of the retracting chamber 1484*a-b* from decreasing. In turn, the probes 312 and 314 retract and/or remain in a retracted position for at least the amount of time during which power is removed from the solenoid valves 1492*a-b* or for at least the duration of a power failure.

The energy stored in the coil spring 1478 can also be used to extend the drawdown pistons 1402 and 1404 and/or ensure that the drawdown pistons 1402 and 1404 remain in an extended position. For example, in the event of a power failure, the solenoid valves 1506*a-b* open allowing fluid to flow from the retractor storage chamber 1474 to the drawdown piston control chambers 1496*a-b* via the flow lines 1504*a-b*. As the energy stored in the coil spring 1478 causes the coil spring 1478 to push against the piston 1470, the piston 1470 causes fluid to flow from retractor storage chamber 1474 to the drawdown piston control chambers 1496*a-b*, which causes the volumes of the drawdown piston control chambers 1496*a-b* to increase and/or prevents the volumes of the drawdown piston control chambers 1496*a-b* from decreasing. In turn, the drawdown pistons 1402 and 1404 extend and/or remain in an extended position for at least the duration of the power failure.

Figure 16:
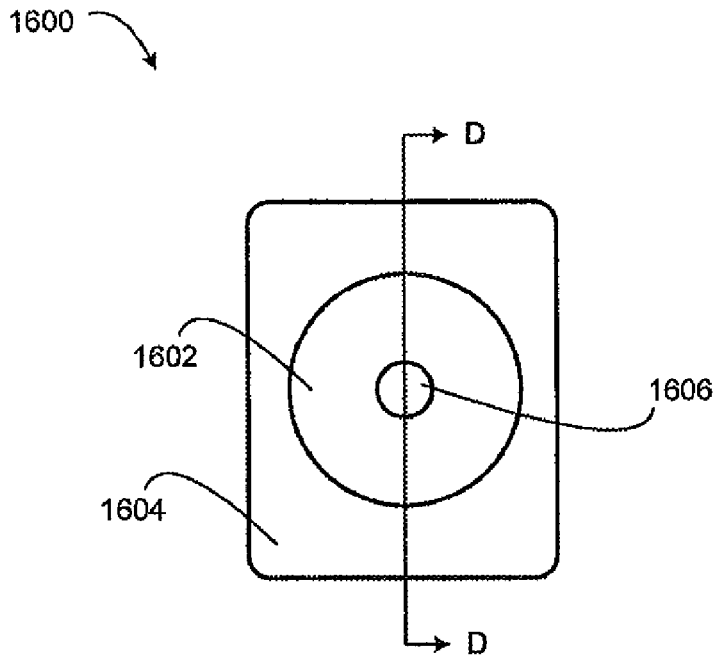
FIG. 16 is a front view and FIG. 17 is a cross-sectional side view of an alternative example probe having a shroud that can be used to implement the example probe module of FIGS. 14 and 15.
Figure 17:
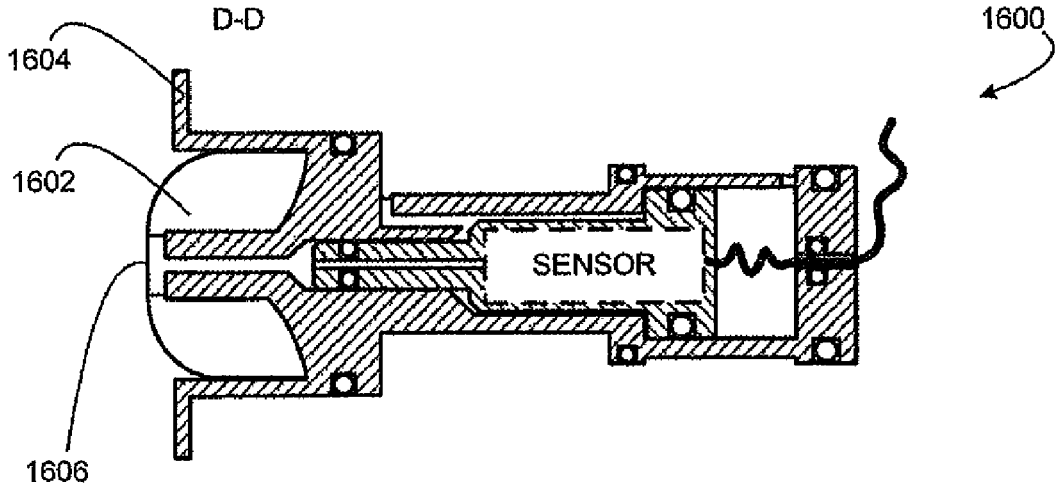

FIG. 16 is a front view and FIG. 17 is a cross-sectional side view of another example probe 1600 that can be used instead of the example probes 312 and 314 (FIGS. 14 and 15) to implement the example probe module 702. The example probe 1600 includes a seal or packer 1602 and a shroud 1604 surrounding packer 1602. In the illustrated example, the shroud 1604 is configured to create a seal against the formation surface of the wellbore 102 (FIGS. 1, 14, and 15) when the probe 1600 is in an extended position. In this manner, the shroud 1604 can locally isolate the formation from the annulus 124 to substantially reduce or eliminate the infiltration of drilling mud in the formation. In another example implementation, the shroud 1604 can compact the formation around the probe to substantially reduce or eliminate erosion or disintegration of the formation. Although the shroud 1604 is shown as rectangular, the shroud 1604 may be implemented using any other shape.

Figure 18:
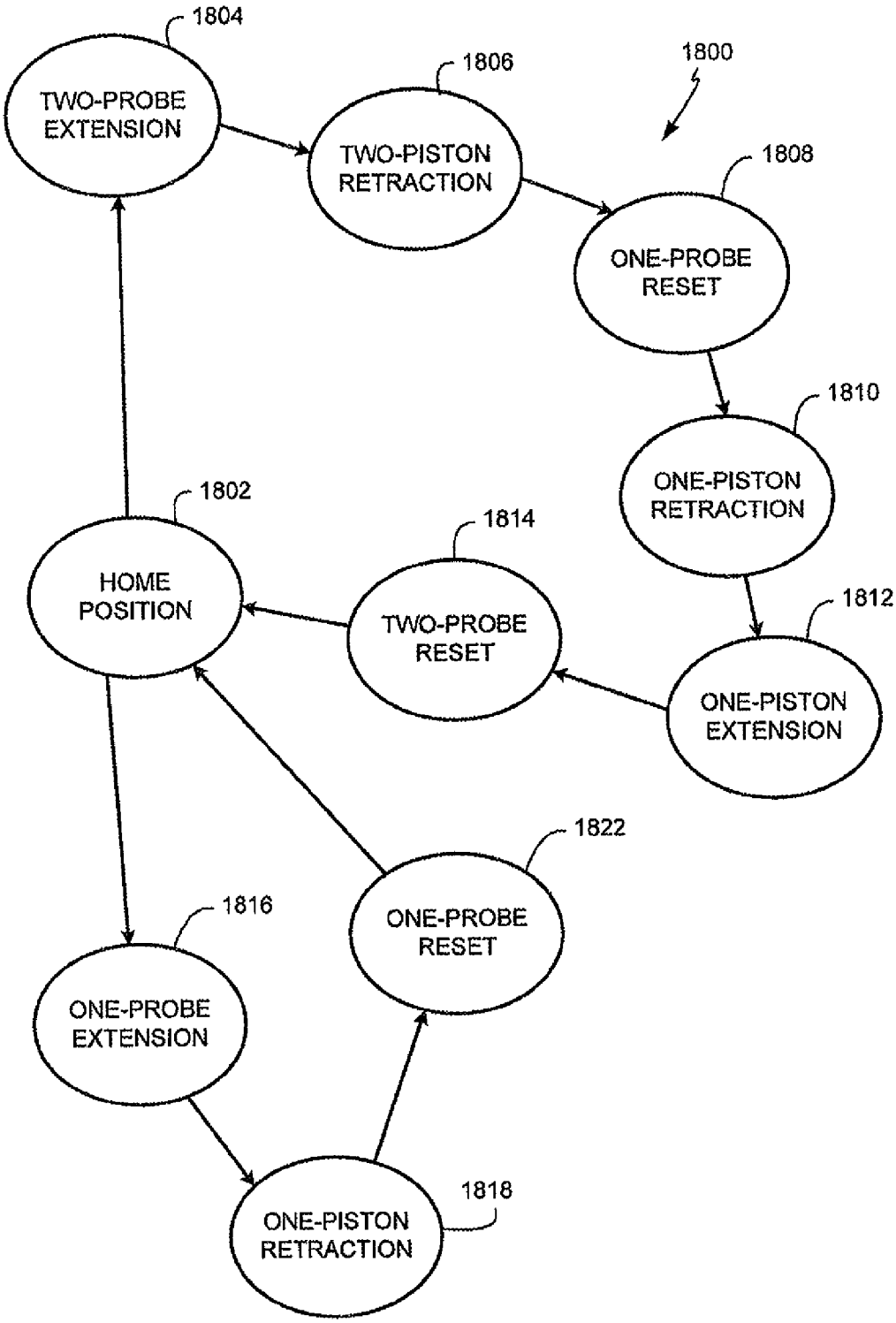
FIG. 18 depicts a state diagram representing an example method of operating the example probe module of FIGS. 14 and 15.

FIG. 18 depicts a state diagram 1800 representing an example method of operating the example probe module 702 of FIGS. 14 and 15. The state diagram 1800 shows a plurality of states arranged in an example state transition sequence to show different ways of operating the probes 312 and 314 and pistons 1402 and 1404 of FIGS. 14 and 15. Although the state diagram 1800 shows a particular state transition sequence, the example probe module 702 may be operated using other state transition sequences. In addition, although the state diagram 1800 may show a previous state transitioning to a next state, the transition may not indicate the existence of a dependency between the previous and next states. In addition, other state transition sequences may be implemented by removing one or more states of FIG. 18 or adding states or changing the order and sequence of the state transitions.

During a home position state 1802, the example probes 312 and 314 are retracted within the probe module 702 so that the packers 1414 and 1416 are within their respective probe openings 1406 and 1408 as shown in FIG. 14. As shown in FIG. 18, the independent controllability of the probes 312 and 314 and the drawdown pistons 1402 and 1404 can be used to disable one of the probes 312 and 314 and its respective drawdown piston 1402 and 1404 to extend battery life by only operating one of the probes 312 and 314. One of the probes 312 and 314 may also be disabled for any other reason such as, for example, to substantially reduce or eliminate the risk of damaging one or both of the probes 312 and 314 in substantially complex or risky operations.

The home position state 1802 may be the state when the drillstring 104 is used for drilling. The state transition sequence may be programmed in the electronics system 1428 or may be initiated from the surface using the two-way telemetry system described with respect to FIG. 1 or a combination of programming and initiation from the surface.

In an example implementation, the two-probe extension state 1804 or the one-probe extension state 1816 may be triggered when the drilling operation pauses during, for example, a stand connection at the platform 100 (FIG. 1). A surface operator using the uphole transmitting system 150 and controlling the interruption of the operation of the pump 120 in a manner that is detectable by the transducers 152 in the subassembly 138 may initiate any of the extension states 1804 or 1816. Alternatively, downhole logic may detect a drilling pause by monitoring, for example, the drillstring rotation, the flow of drilling fluid 122, and/or other drilling parameters to control the extension states 1804 and 1816. In some example implementations, one or more probe(s) may be extended during drilling to obtain measurements at different locations of the formation surface. In other example implementations, the electronic system 1428 is configured to receive digital data from various sensors in the tool. In addition, the electronic system 1428 may be configured to execute different instructions depending on the data received. The instructions executed by the electronics system 1428 (e.g., by the controller 218) may be used to control some of the state transitions. Thus, the formation tester 300 is preferably, but not necessarily configured to perform some of its operations (e.g. probe movement) in, for example, a sequential manner based on sensor data acquired in situ.

During a two-probe extension state 1804, both of the probes 312 and 314 are extended toward a formation surface of the wellbore 102. To extend the probes 312 and 314, the electronics system 1428 causes the closure of valves 1466 and causes the motor to actuate and extend the actuator screw or ram 1444 (FIG. 15) to increase the hydraulic fluid pressure in the power fluid line 1488. Preferably, but not necessarily, the electronics system 1428 drives a motor controller (e.g., a stepper controller, a revolutions controller, etc.). Additionally or alternatively, the number of motor revolutions may be measured and transmitted to the electronics system 1428. The number of motor revolutions enables the computation of the fluid volume displaced by the motor, which in turn enables tracking or monitoring the extension distances of the probes 312 and 314. A pressure sensor in communication with the electronics system 1428 may be used to monitor the pressure in the power fluid line 1488.

To enable the probes 312 and 314 to extend using the pressure in the power fluid line 1488, the electronics system 1428 opens the solenoid valves 1492*a-b* to allow hydraulic fluid to flow out of the retracting chambers 1484*a-b* and into the retractor storage chamber 1474. As hydraulic fluid flows out of the retracting chambers 1484*a-b*, the volume of the retracting chambers 1484*a-b* decreases and hydraulic fluid flows from the power fluid line 1488 into the extending chambers 1482*a-b* to increase the volume of the extending chambers 1482*a-b* and cause the probes 312 and 314 to extend as shown in FIG. 15. As the actuator screw or ram 1444 and the probes 312 and 314 extend, hydraulic fluid flows from the annulus pressure chamber 1436 of the compensator 1434 and from the retractor spring chamber 1476 to the back chambers 1508*a-b* and the actuator back chamber 1455 via the annulus pressure fluid line 1464 as the volumes of the chambers 1436 and 1476 decrease and the volumes of the chambers 1508*a-b* and 1455 increase. The complete extension of the probes 312 and 314 against the borehole wall may be detected by a pressure sensor (not shown) (e.g., a pressure sensor in the power fluid line 1488) and a displacement sensor (not shown) in the probes 312 and 314. A relatively significant increase of pressure in the power flow line and/or a relatively significant decrease of the displacement speed of the probes 312 and 314 may indicate that the probes 312 and 314 are in engagement with or pressed against the formation surface of the borehole. When the probes 312 and 314 are extended, the electronics system 1428 closes the solenoid valves 1492*a-b* to maintain the probes 312 and 314 in the extended position.

In some example implementations, the electronics system 1428 may include pulse-width-modulation ("PWM") controllers for controlling hydraulic fluid flow to the probes 312 and 314 with substantially high precision. For example, a PWM controller may be used to control the opening of solenoid valves 1492*a-b* to control the extension of the probes 312 and 314. In this manner, the electronics system 1428 may be configured to independently control the extension speed of each of the probes 312 and 314 by selectively controlling the degree of opening of a respective one of the solenoid valves 1492*a-b*.

In addition, the electronics system 1428 can be configured to maintain and/or control the setting force of the packers 1414 and 1416 against the formation surface to a predetermined level while, for example, the formation tester 300 is moved up and down or rotated to obtain measurements at different locations of the formation surface. The pressure level in the retracting chamber 1484*a* and/or the retracting chamber 1484*b* as well as the pressure level in the power fluid line 1488 may be communicated to the electronics system 1428. A controller (e.g., the controller 218 of FIG. 2) in the electronics system 1428 can then analyze these pressure levels and control the motor rotation and/or the degree of opening of the solenoid valve 1492*a* and/or the solenoid valve 1492*b* based on the analyzed pressure levels using, for example, close loop control techniques known in the art. In this manner, the setting force of the packer 1414 and/or the packer 1416 against the formation surface can be adjusted. The valve 1492*a* and/or the valve 1492*b* may then be closed to maintain the position of the probe 312 and/or the probe 314 in a substantially fixed position.

During a two-piston retraction state 1806, the drawdown pistons 1402 and 1404 are retracted to draw the formation fluid 1417 into the probes 312 and 314. In FIG. 15, the drawdown piston 1404 is shown retracted. To retract both of the drawdown pistons 1402 and 1404, the electronics system 1428 causes the motor to actuate and extend the actuator screw or ram 1444 (FIG. 15) to increase the hydraulic fluid pressure in the power fluid line 1488. The electronics system 1428 opens the solenoid valves 1506*a-b* to allow hydraulic fluid to flow from the drawdown piston control chambers 1496*a-b* and into the retractor storage chamber 1474 via the control fluid lines 1504*a-b*. As hydraulic fluid is expelled from the drawdown piston control chambers 1496*a-b*, the volumes of the drawdown piston control chambers 1496*a-b* decrease and hydraulic fluid from the power fluid line 1488 and the extending chambers 1482*a-b* flows into the drawdown piston actuating chambers 1494*a-b*. At the same time, the volumes of the drawdown piston actuating chambers 1494*a-b* increase causing the drawdown pistons 1402 and 1404 to pull or retract toward the drawdown piston control chambers 1496*a-b*. When the drawdown pistons 1402 and 1404 are sufficiently retracted, the electronics system 1428 may close the solenoid valves 1506*a-b* to cause the drawdown pistons 1402 and 1404 to remain in the retracted position. The retraction of the drawdown pistons 1402 and 1404 may be stopped before a fill stroke is achieved, and the retraction can be restarted later.

The electronics system 1428 may also be coupled to devices (not shown) used to measure the distances of extension and retraction of the drawdown pistons 1402 and 1404 relative to the probes 312 and 314. The position (e.g., a position measured in motor revolutions) of any of the drawdown pistons 1402 and 1404 may be monitored with a displacement sensor (e.g., an analog potentiometer, a digital encoder, etc.) either directly coupled to or indirectly coupled to one or both of the drawdown pistons 1402 and 1404.

In an example implementation, the electronics system 1428 can substantially continuously monitor the extension/retraction distances of the drawdown pistons 1402 and 1404 and use the measured distances to independently control the extension/retraction speeds of the drawdown pistons 1402 and 1404 and/or to determine the volume of the formation fluid 1417 in the probes 312 and 314. In another example implementation, the electronics system 1428 can substantially continuously monitor the pressure level measured by the sensors 1422 and 1424 and adjust the amount of opening of the valves 1506*a-b* based on the measured pressure to, for example, achieve a predetermined pressure level in the formation fluid 1417.

The control of the extension/retraction of the drawdown pistons 1402 and 1404 may be achieved by independently controlling the opening of the valves 1506*a-b* by, for example, partially energizing the valves using a PWM controller. The amount of opening of the valves 1506*a-b* may be adjusted using close loop control techniques known in the art.

If a high flow rate of the formation fluid 1417 into the probes 312 and 314 is desired, the motor can actuate the actuator screw or ram 1444 further to store hydraulic pressure in the accumulator 1458 (FIG. 14) while the solenoid valves 1506*a-b* and 1466 are closed. In this manner, when the electronics system 1428 opens the solenoid valves 1506*a-b*, the coil spring 1462 (FIG. 14) of the accumulator 1458 expands quickly to relatively quickly expel hydraulic fluid from the actuation chamber 1452 and into the drawdown piston actuating chambers 1494*a-b*, thereby causing the drawdown pistons 1402 and 1404 to relatively quickly retract or pull down and creating a high flow rate of the formation fluid 1417 into the probes 302 and 304.

The pressure measured by sensors 1422 and/or 1424 can be continuously monitored by the electronics system 1428 during and following a piston retraction state when any of the pistons 1402 and 1404 remain in the retracted position (sometimes referred to as a build-up phase). These pressure data may be processed downhole to extract the formation pore pressure and other parameters of interest using known methods. The formation pore pressure is then preferably sent to the surface by telemetry to, for example, make a drilling decision, or the pore pressure can be used downhole to control a subsequent state. Alternatively, the pressure data may be compressed and sent by telemetry to the surface, and the formation pore pressure and/or any other parameters can be extracted at the surface.

In some example implementations, the analysis of the pressure measured by the sensor 1422 and/or the sensor 1424 may indicate that one or both of the probes 312 and 314 needs to be reset. The analysis of the pressure measured by the sensors 1422 and/or 1424 may be performed downhole by the electronics system 1428. Alternatively or additionally, the data collected by the sensor 1422 and/or the sensor 1424 may be compressed and sent to a surface operator by telemetry for analysis. The data may be processed and/or displayed by the processor 146. A command may be sent to the testing tool 300 to reset one or both of the probes 312 and 314. During an example one-probe reset state 1808, the solenoid valves 1492*b* and 1506*b* are opened while the solenoid valves 1492*a* and 1506*a* remain closed. The electronics system 1428 may cause the motor to retract the actuator screw or ram 1444 to draw hydraulic fluid out of the drawdown piston actuating chambers 1494*b* into the actuation chamber 1452 or may vent the pressure in the actuation chamber 1452 by opening the valve 1466. When the valve 1506*b* is open, hydraulic fluid also flows from the retractor storage chamber 1474 into the drawdown piston control chambers 1496*b* via the valve

1506*b*. The drawdown piston 1404 is extended away from the drawdown piston control chambers 1496*b* to expel the formation fluid 1417 and/or debris from the probes 314. Retracting the actuator screw or ram 1444 and/or opening the valve 1466 also enables hydraulic fluid to flow out of the extending chambers 1482*b* and into the actuation chamber 1452. When the valve 1492*a* is open, hydraulic fluid also flows from the retractor storage chamber 1474 into the retracting chamber 1484*b* via the valve 1492*b* to retract the probe 314 into the opening 1408, thus reducing the volume of the back chamber 1508*b*. When the drawdown piston 1404 is extended, the electronics system 1428 may close the solenoid valve 1506*b* to prevent hydraulic fluid from flowing out of the drawdown piston control chamber 1496*b* and to maintain the drawdown piston 1404 in an extended position.

The electronics system 1428 may then cause the motor to actuate and extend the actuator screw or ram 1444 (FIG. 15) to increase the hydraulic fluid pressure in the power fluid line 1488, which can cause the probe 314 to extend again toward a formation surface of the wellbore 102. In addition, the setting force of the packers 1416 against the formation surface can be adjusted and the valve 1492*b* can be closed to maintain the probe 314 in a substantially fixed position, In addition, the electronics system 1428 may be configured to control operation (e.g., extraction and retraction) of the drawdown pistons 1402 and 1404 in a sequential manner to enable one of the probes 312 and 314 to generate a pressure disturbance in the formation fluid 1417 that is subsequently measured by the other one of the probes 312 and 314. For example, in a one-piston retraction state 1810, one of the pistons 1402 and 1404 is retracted to draw the formation fluid 1417 into a respective one of the probes 312 and 314 while both of the probes 312 and 314 are in an extended position. In the illustrated example of FIG. 15, the drawdown piston 1404 is shown retracted. To retract the drawdown piston 1404, the electronics system 1428 opens the solenoid valve 1506*b* while keeping the solenoid valve 1506*a* closed. In this manner, the drawdown piston 1404 retracts to draw the formation fluid 1417 as described above in connection with the two-piston retraction state 1806 while the other drawdown piston 1402 remains extended without drawing the formation fluid 1417 as shown in FIG. 15. When the drawdown piston 1404 is retracted, the electronics system 1428 closes the solenoid valve 1506*b* to maintain the drawdown piston 1404 retracted.

The pressure measured by the sensor 1422 and/or the sensor 1424 can be continuously monitored by the electronics system 1428 during and following a piston retraction state 1810. These pressure data may be processed downhole to extract horizontal and/or vertical formation permeability and other parameters of interest. The formation permeability measurement values may then be sent to the surface by telemetry to, for example, make a drilling decision) or the formation permeability measurement values can be used downhole to control a subsequent state. Alternatively, the pressure data may be compressed and sent by telemetry to the surface, and the formation permeability and/or any other parameters can be extracted at the surface.

In a one-piston extension state 1812, the drawdown piston 1404 is extended to expel the formation fluid 1417 from the probe 314. The electronics system 1428 may cause the motor to retract the actuator screw or ram 1444 to draw hydraulic fluid into the actuation chamber 1452 or may vent the pressure in the actuation chamber 1452 by opening the valve 1466. To extend the drawdown piston 1404, the electronics system 1428 opens the solenoid valve 1506*b* to allow hydraulic fluid to flow into the drawdown piston control chamber 1496*b* causing the drawdown piston 1404 to extend. When the drawdown piston 1404 is extended, the electronics system 1428 may close the solenoid valve 1506*b* to maintain the drawdown piston 1404 in an extended condition.

In a two-probe reset state 1814, both of the probes 312 and 314 are retracted into the example formation tester 300 to a home position as shown in FIG. 14. Also, both of the drawdown pistons 1402 and 1404 are extended into respective probes 312 and 314 to, for example, remove debris introduced in the fluid port 1418 and/or the fluid port 1420 during a piston retraction state. In the two-probe reset state 1814, the electronics system 1428 opens the solenoid valve 1466 to vent the pressure in the actuation chamber 1452 and in the power fluid line 1488.

To extend both of the drawdown pistons 1402 and 1404 away from the drawdown piston control chambers 1496*a-b* and to expel the formation fluid (and/or debris) 1417 from the probes 312 and 314, the electronics system 1428 opens the solenoid valves 1506*a-b* to allow hydraulic fluid to flow from the retractor storage chamber 1474 into the drawdown piston control chambers 1496*a-b*. As hydraulic fluid is drawn out of the drawdown piston actuating chambers 1494*a-b*, the volumes of the drawdown piston actuating chambers 1494*a-b* decrease and the volumes of the drawdown piston control chambers 1496*a-b* increase causing the drawdown pistons 1402 and 1404 to extend.

To retract the probes 312 and 314, the electronics system 1428 opens the solenoid valves 1492*a-b* to enable hydraulic fluid to flow into the retracting chambers 1484*a-b* from the retractor storage chamber 1474. Specifically, as the coil spring 1478 (FIG. 14) of the retractor 1468 (FIG. 14) extends, the retractor 1468 displaces the hydraulic fluid into the retracting chambers 1484*a-b* via the control fluid lines 1490*a-b*. Hydraulic fluid flows out of the extending chambers 1482*a-b* and into the actuation chamber 1452. Hydraulic fluid also flows from the actuation chamber and the extending chambers 1482*a-b* into the annulus pressure chamber 1436 of the compensator 1434 via the annulus pressure fluid line 1464. As hydraulic fluid flows out of the extending chambers 1482*a-b*, the volumes of the extending chambers 1482*a-b* decrease and fluid flows from the retractor storage chamber 1474 into the retracting chambers 1484*a-b*, thereby increasing the volumes of the retracting chambers 1484*a-b*.

In the two-probe reset state 1814, the electronics system 1428 also causes the motor to retract the actuator screw or ram 1444. When the probes 312 and 314 are retracted, the electronics system 1428 may close the solenoid valves 1492*a-b* to maintain the probes 312 and 314 retracted at the home position state 1802. When the drawdown pistons 1402 and 1404 are extended, the electronics system 1428 closes the solenoid valves 1506*a-b* preventing hydraulic fluid from flowing out of the drawdown piston control chambers 1496*a-b* and maintaining the drawdown pistons 1402 and 1404 in an extended condition.

In the illustrated example of FIG. 18, the example probe module 702 (FIGS. 16 and 17) can transition from the home position state 1802 to a one-probe extension state 1816 in which one of the probes 312 and 314 is extended. To extend the probe 314, the electronics system 1428 closes the solenoid valve 1466 and causes the motor 1454 (FIG. 15) to actuate and extend the actuator screw or ram 1444 (FIG. 15) to increase the hydraulic fluid pressure in the power fluid line 1488. To enable the probe 314 to extend using the pressure in the power fluid line 1488, the electronics system 1428 opens the solenoid valve 1492*b*. However, the electronics system 1482 keeps the solenoid valve 1492*a* closed to prevent fluid from flowing out of the retracting chamber 1484*a*. When the probe 314 is extended, the electronics system 1428 may close the solenoid valve 1492*b* to maintain the probe 314 in the extended position.

In a one-piston retraction state 1818, the drawdown piston 1404 is retracted to draw the formation fluid 1417 into the probes 314. To retract the drawdown piston 1404, the electronics system 1428 maintains the solenoid valve 1466 closed, and the motor extends the actuator screw or ram 1444 to displace hydraulic fluid into the drawdown piston actuating chamber 1494*b*. If a high flow rate of the formation fluid 1417 into the probe 314 is desired, the accumulator 1458 can be used as described above in connection with the two-piston retraction 1806 to store energy and relatively quickly release the energy to relatively quickly pull or retract the drawdown piston 1404. The electronics system 1428 opens the solenoid valve 1506*b* to allow hydraulic fluid to flow from the drawdown piston control chamber 1496*b* and into the retractor storage chamber 1474 via the control fluid lines 1504*b*. However, the electronics system 1428 keeps the solenoid valve 1506*a* closed to prevent hydraulic fluid from flowing out of the drawdown piston control chamber 1496*a*, thereby causing the drawdown piston 1402 to remain extended. When the drawdown piston 1404 is sufficiently retracted as shown in FIG. 15, the electronics system 1428 may close the solenoid valve 1506*b* to maintain the drawdown piston 1404 in the retracted state. The retraction of the drawdown piston 1404 may be stopped before the full stroke is achieved, and restarted later.

The electronics system 1428 may be configured to acquire pressure data from the sensor 1424 to determine whether the packer 1416 is properly sealingly engaged to the formation surface of the wellbore 102 (FIG. 1). The electronics system 1428 may also be configured to adjust the force exerted on the formation surface by the packer 1416 during the one-piston retraction state 1818 to overcome leaks between the packer and the formation surface when detected by the sensors 1424.

The electronics system 1428 may also be configured to acquire pressure data from the sensor 1424 and to determine testing parameters based on the pressure data. For example, the pressure data collected during the one-piston retraction state 1818 may be analyzed and a desirable drawdown pressure and/or a desirable drawdown speed may be computed based on the analyzed pressure data.

In an example implementation, during the one-piston retraction state 1818, the electronics system 1428 can substantially continuously monitor the retraction (or extension) distance of the drawdown piston 1404 and use the measured distance to adjust the retraction speed of the drawdown piston 1404 to a desired drawdown speed computed based on the data acquired in state 1818. In another example implementation, the electronics system 1428 can substantially continuously monitor the pressure level measured by the sensor 1424 and adjust the level of opening of the valve 1506*b* based on the pressure level to, for example, achieve the desired drawdown pressure computed based on the data acquired in state 1818. The control of the retraction of the drawdown piston 1404 may be achieved by controlling the opening of the valve 1506*b* by, for example, partially energizing the valves using a PWM controller. The amount of opening of the valve 1506*b* may be adjusted using close loop control techniques known in the art.

During a one-probe reset state 1822, the probe 314 is retracted into the example formation tester 300 and the drawdown piston 1404 is extended into the probe 314. The electronics system 1428 opens the solenoid valves 1492*b* and 1506*b*. However, the electronics system 1428 keeps the solenoid valve 1492*a* and 1506*a* closed to prevent extension of the probe 312 and retraction of drawdown piston 1402. As the coil spring 1478 (FIG. 14) of the retractor 1468 (FIG. 14) extends, the retractor 1468 displaces the hydraulic fluid to move the system back to a home position as shown in FIG. 14. In the one-probe reset state 1822, the electronics system 1428 may also cause the motor 1454 to retract the actuator screw or ram 1444.

Figure 19:
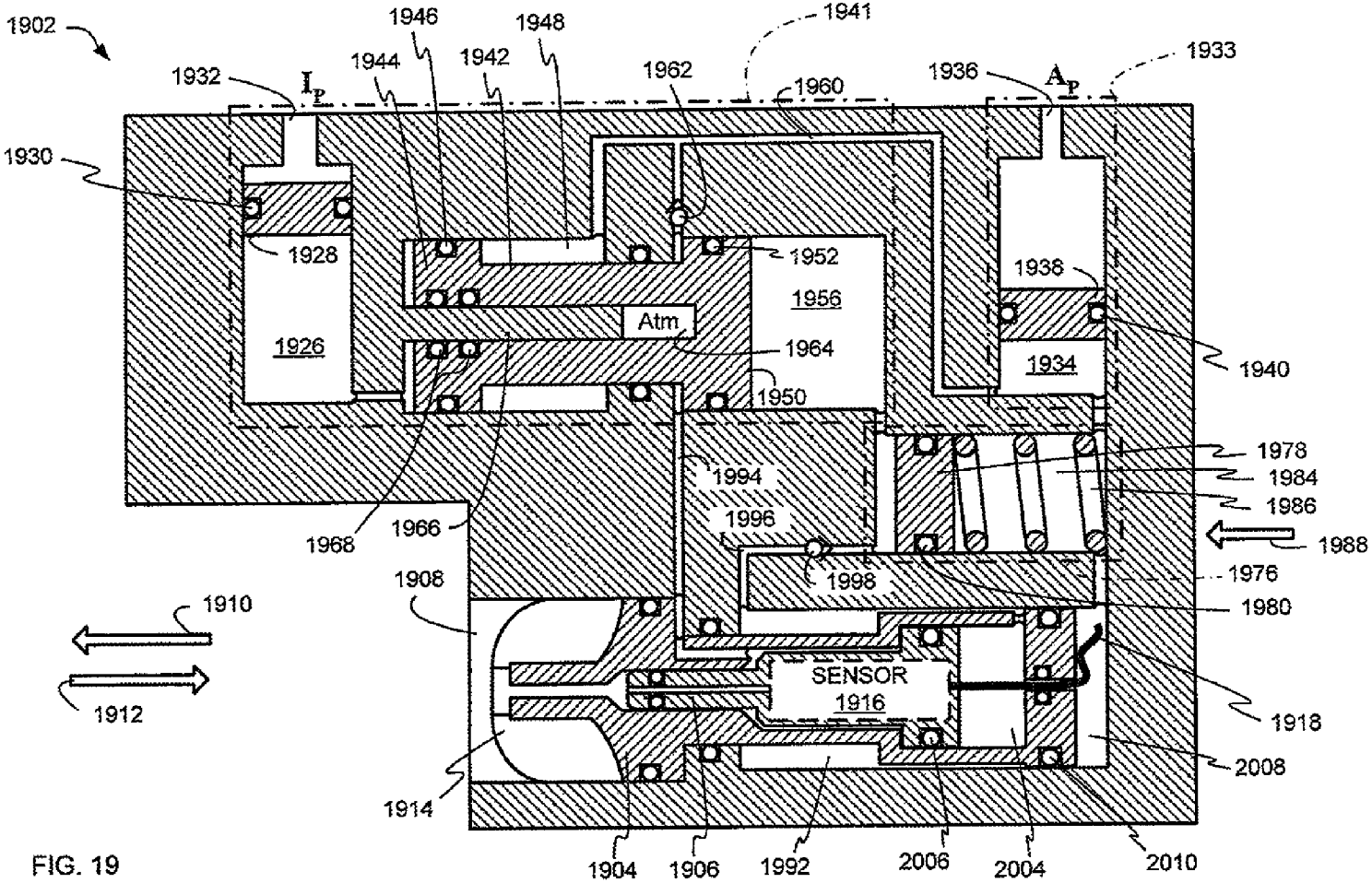
FIGS. 19 through 21 illustrate detailed diagrams of an example probe system that may be implemented within (e.g., integral with) a tool collar in a fixed or non-removable configuration or that may be used to implement a probe module removably insertable into a tool collar.
Figure 20:
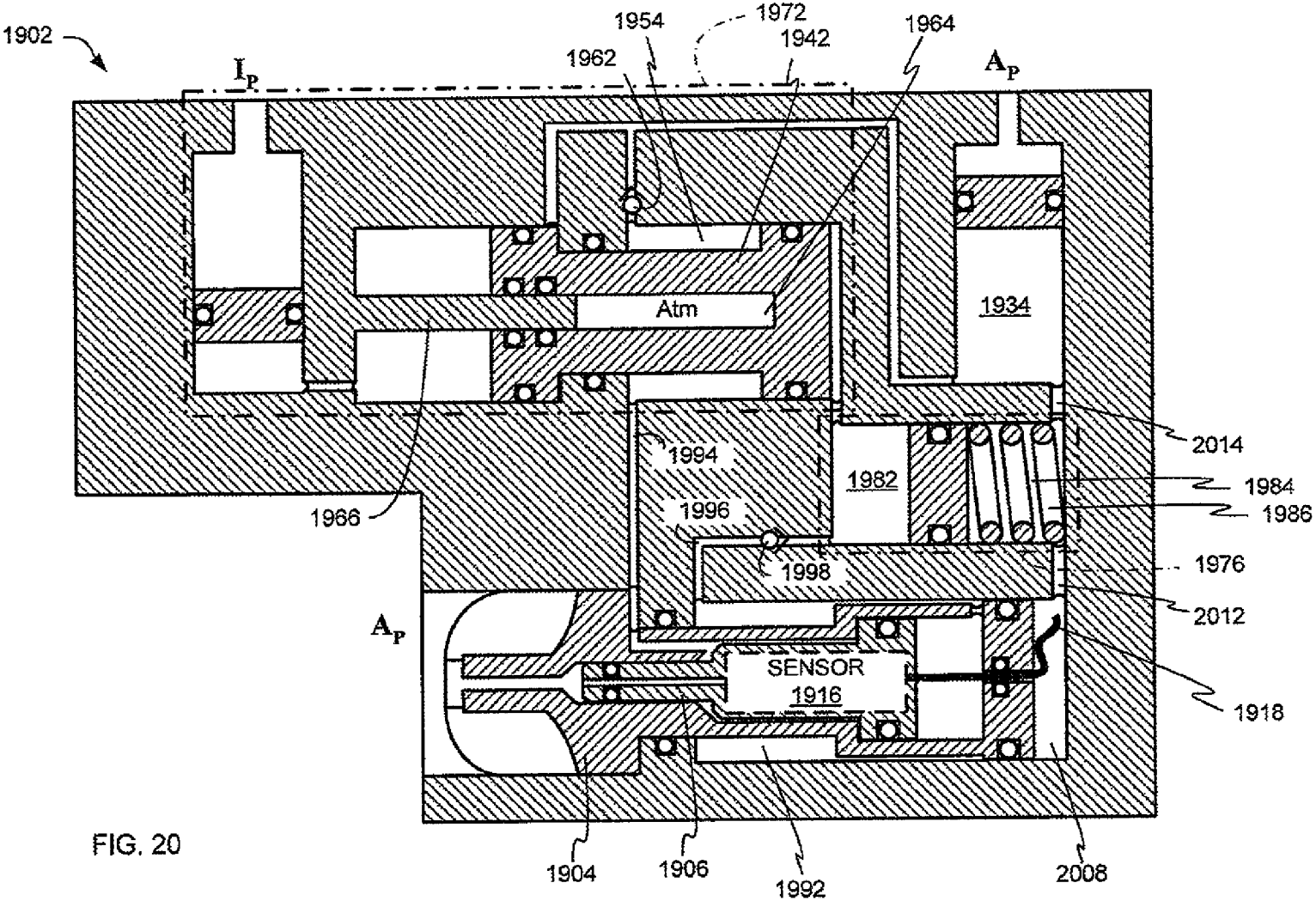
Figure 21:
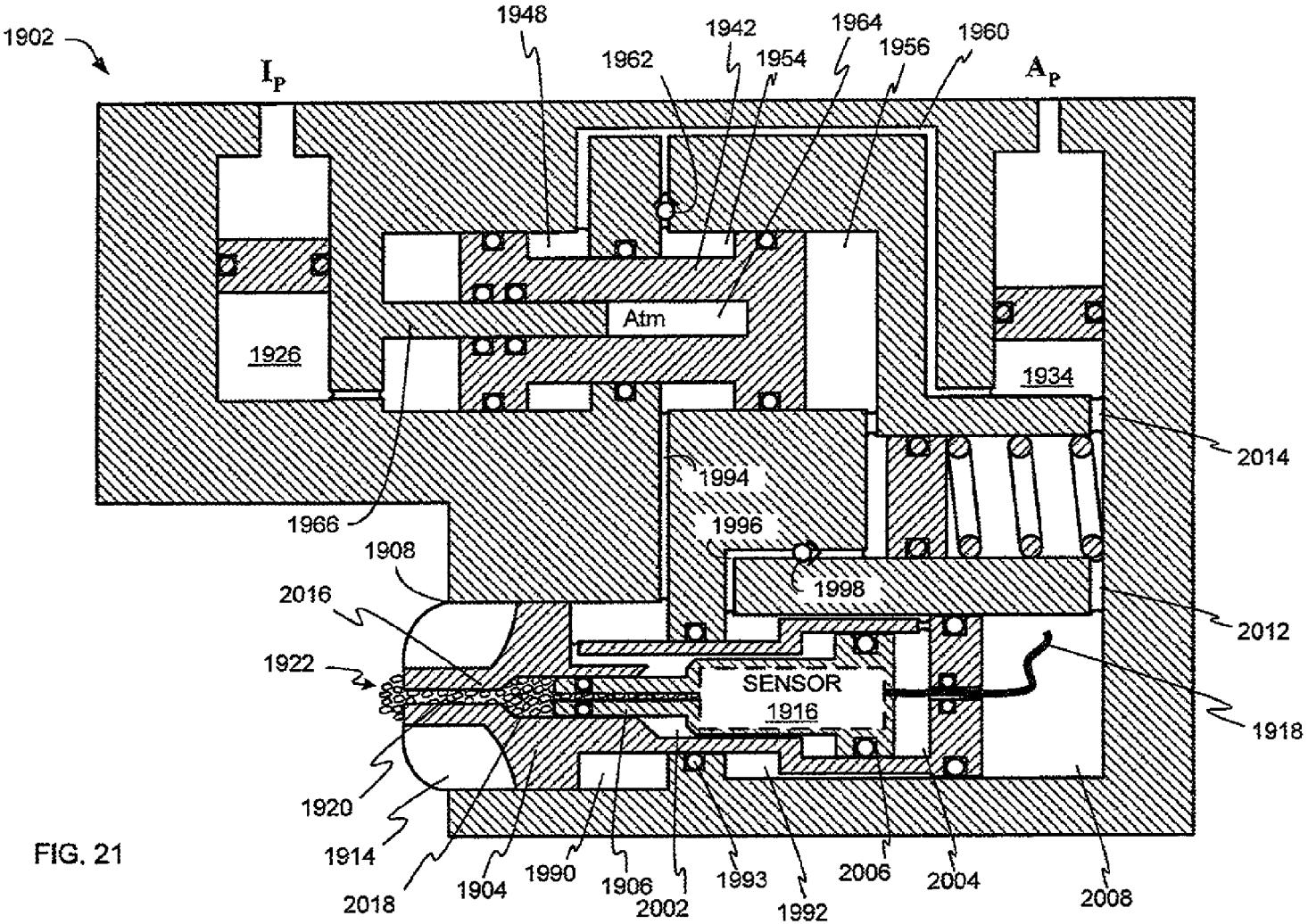

FIGS. 19 through 21 illustrate detailed diagrams of an example probe system 1902 that may be implemented within (e.g., integral with) a tool collar (e.g., the formation tester 300 of FIGS. 3A and 3B) in a fixed or non-removable configuration. Alternatively, the example probe system 1902 may be used to implement a removably insertable probe module (e.g., the probe module 702 of FIGS. 14 and 15). In the illustrated example, the components of the probe system 1902 are shown in a schematic representation for purposes of discussion to show the relationships between the various components. However, the components of the probe system 1902 may be rearranged while maintaining connections and functional relationships therebetween to implement the same functionality as described below in connection with the schematic illustrations of FIGS. 19-21.

To perform measurements associated with a formation (e.g., the formation F of FIG. 1), the probe system 1902 is provided with an example probe 1904 and a drawdown piston 1906 located within the probe 1904. The probe 1904 is configured to extend and retract relative to a probe opening 1908 of the probe system 1902 during a measurement process in directions generally indicated by arrows 1910 and 1912. The drawdown piston 1906 is configured to move relative to the probe 1904 in the directions generally indicated by the arrows 1910 and 1912 to draw formation material into the probe 1904. To engage a formation surface of a wellbore (e.g., the wellbore 102 of FIG. 1) and form a seal between the formation surface and the probe 1904 to facilitate drawing the formation material into the probe 1904, the probe 1904 is provided with a packer or seal 1914.

In the illustrated example of FIG. 19, the probe 1904 is shown in a retracted, home position at which the packer 1914 is within the probe opening 1908. In the illustrated example of FIG. 21, the probe 1904 is shown in an extended, measurement position in which the packer 1914 extends away from the opening 1908. In addition, the drawdown piston 1906 is shown in a retracted position that draws formation material 1920 through a formation fluid port 1922 into the probe 1904.

To perform measurements of the formation material 1920, the probe system 1902 is provided with a sensor 1916 located within the drawdown piston 1906. The sensor 1916 may be implemented using, for example, a pressure sensor, and/or a temperature sensor. In the illustrated example, the sensor 1916 is communicatively coupled to an electronic system (e.g., the electronics 218 of FIG. 2) via wires or cable 1918 to communicate measurement information to the electronic system for storage.

The components of the probe system 1902 are configured to extend and retract the probe 1904 and the drawdown piston 1906 using energy associated with annulus pressure ($A_p$) and drill string internal pressure ($I_P$). Annulus pressure $A_p$ refers to the pressure of formation material and other material (e.g., drilling mud) in the annulus (e.g., the annulus 124 of FIG. 1). Drill string internal pressure $I_p$ refers to the pressure of drilling fluid (e.g., the drilling fluid 116 of FIG. 1) flowing through an internal passage (e.g., the passages 906 and 908 of FIGS. 9 and 10) of the drill string 104.

To sense the drill string internal pressure $I_p$, the probe system 1902 is provided with an internal pressure chamber 1926 (FIG. 19) that is filled with hydraulic fluid. A piston or bellow 1928 having an o-ring 1930 sealingly separates the internal pressure chamber 1926 from an internal fluid port 1932. Drilling fluid (e.g., the drilling fluid 116 of FIG. 1) flows through the internal fluid port 1932 and generates a force against the piston 1928. To sense the annulus pressure $A_p$, the probe system 1902 is provided with a compensator 1933 that includes an annulus pressure chamber 1934 (FIG. 19) and an annulus fluid port 1936 sealingly separated by a piston or bellow 1938 having an o-ring 1940. Drilling mud flows through the annulus fluid port 1936 and generates a force against the piston 1938.

To store energy associated with the annulus pressure $A_p$ and the internal pressure $I_p$ to extend the measurement probe 1904, the probe system 1902 is provided with an actuator 1941. The actuator 1941 includes an actuator ram 1942 having a first flange 1944 (i.e., a first force element) that forms a piston-like structure having an o-ring 1946 that sealingly separates a balancing chamber 1948 from the internal pressure chamber 1926. The actuator ram 1942 also includes a second flange 1950 (i.e., a second force element) that also forms a piston-like structure having an o-ring 1952 to sealingly separate an actuation chamber 1954 (FIGS. 20 and 21) from an actuator reference chamber 1956 (FIGS. 19 and 21). The balancing chamber 1948 and the actuation chamber 1954 are fluidly coupled to the annulus pressure chamber 1934 via a fluid passage or line 1960. A solenoid check valve 1962 is disposed between the actuation chamber 1954 and the fluid line 1960 to control the flow of hydraulic fluid therebetween. Solenoid check valve 1962 is preferably normally open. When energized, solenoid check valve 1962 closes and prevents the discharge of hydraulic fluid from the actuation chamber 1954 into the annulus pressure chamber 1934. When closed, solenoid check valve 1962 still allows hydraulic fluid to flow into the actuation chamber 1954.

To store energy associated with the area of first flange 1944 and the area of second flange 1955, the actuator ram 1942 is provided with a low pressure chamber 1964. In the illustrated example, the low pressure chamber is filled with air, initially at atmospheric pressure. To sealingly capture the air within the air chamber 1964, the probe system 1902 is provided with a piston rod 1966 inserted in the air chamber 1964, and the actuator ram 1942 is provided with o-rings 1968 that sealingly engage the piston rod 1966.

As shown in FIG. 19, the actuator 1941 includes the internal pressure chamber 1926, the piston 1928, the internal fluid port 1932, the actuator ram 1942, the balancing chamber 1948, and the actuator reference chamber 1956. In the illustrated example, the actuator 1941 is configured to work with the compensator 1933 to store energy based on differences between the annulus pressure $A_p$, the internal pressure $I_p$, and atmospheric pressure associated with the air stored in the air chamber 1964. As described in greater detail below, the actuator 1941 uses the stored energy to extend the measurement probe 1904 and/or retract the drawdown piston 1906 to draw the formation fluid 1920 into the probe 1904.

Figure 22:
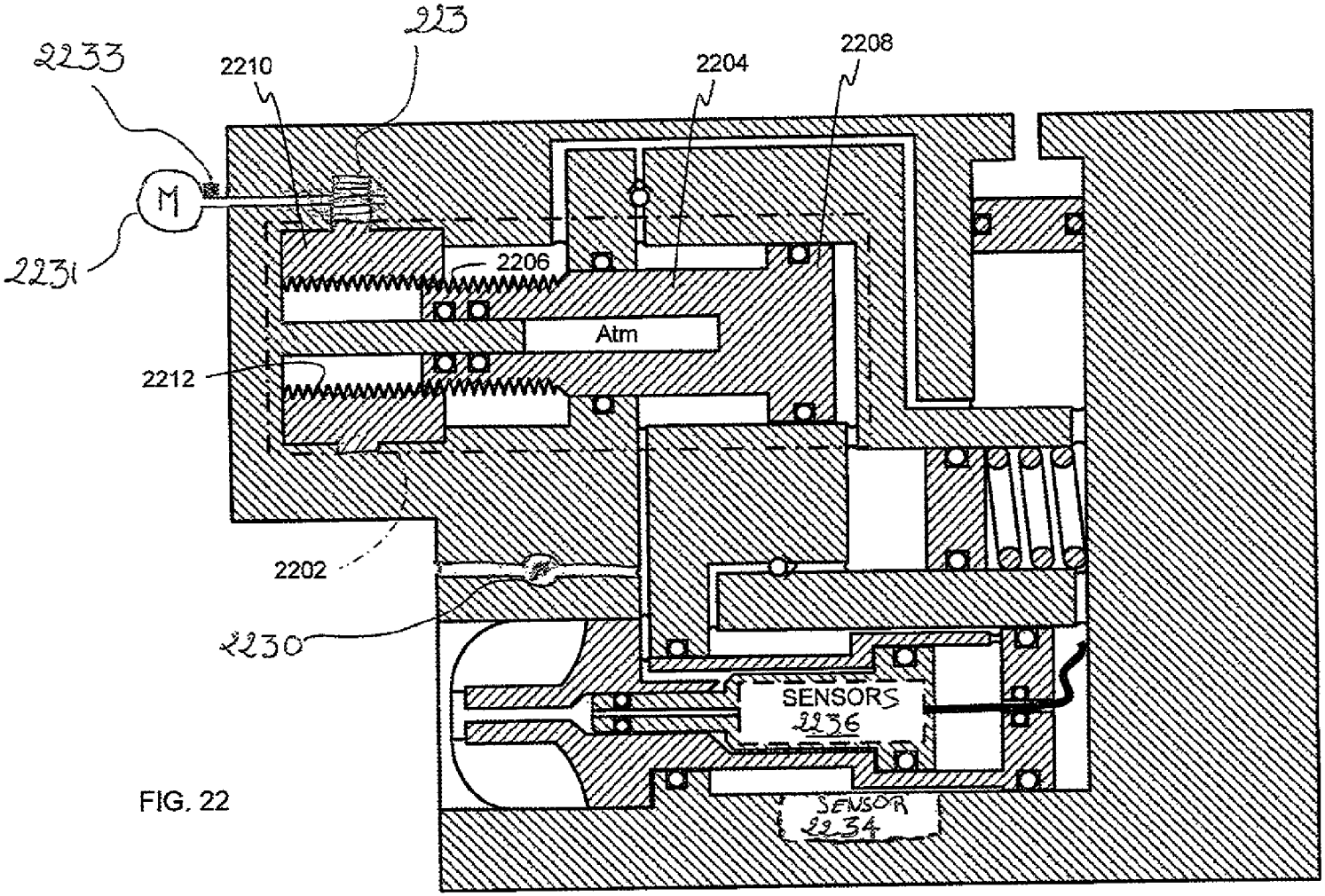
FIG. 22 depicts an alternative example implementation of the example probe system of FIGS. 19-21 using a motor and lead screw configuration.

In an alternative example implementation shown in FIG. 22, an actuator 2202 is implemented using a lead screw configuration. The actuator 2202 is provided with an actuator ram 2204 having an outer diameter threaded portion 2206 (e.g., a first force element) at a first end and a first flange 2208 (e.g., a second force element) at a second end. The actuator 2202 of FIG. 22 is provided with a nut 2210 with an inner diameter threaded portion 2212 that threadingly engages the outer diameter threaded portion 2206 of the actuator ram 2204. Instead of storing energy associated with the annulus pressure $A_p$ and the internal pressure $I_p$ (FIG. 19), the actuator 2202 uses a motor 2231 and an optional gear 2235 to rotate the nut 2210 and thus moving the actuator ram 2204. The motor can be activated and deactivated using an electronic control circuit (e.g., the electronics 218 of FIG. 2). The motor 2231 is preferably equipped with a rotary encoder 2233 for monitoring its position, and current sensors (not shown) for monitoring its torque. Measuring the motor position and currents allows, amongst other things, a precise control of the motor. The motor rotation may further be interpreted as a displaced volume and may be used for estimating the relative displacements of moving parts in a probe module.

Also shown in FIG. 22 is a pressure sensor 2230, measuring the differential pressure between the actuation chamber 1954 and the wellbore pressure. The signal generated by the sensor 2230 is preferably communicated to a downhole controller (such as controller 218). The controller 218 may utilize the signal from the sensor 2230, for example, to adjust the speed of the motor 2231. Thus, the controller 218 is capable of adjusting the extension rate of the probe 1904, or of the drawdown piston 1906.

In addition, the differential pressure between the actuation chamber 1954 and the wellbore pressure is related in part to the contact pressure of the probe packer 1914 against the wellbore wall. Thus, the controller 218 may be further capable of adjusting the contact pressure of the packer against the wellbore wall. In the embodiment of FIG. 22, the probe 1906 is instrumented with a displacement sensor 2234 for measuring the relative displacement of the probe in the retracting chamber. The displacement sensor may be one of a potentiometer or a linear encoder, or any other type of displacement sensor know in the art. The signal generated by the sensor 2234 may be used by a downhole controller (controller 218 for example) for adjusting the speed of the motor 2231. In other embodiments, the signal generated by the sensor 2234 may be used by a downhole controller (controller 218) for adjusting valves, such as valves 1494*a-b* or 1506*a-b*, which may be effectuated by utilizing a pulse width modulator controller. Thus, the controller 218 may adjust the position and/or speed of the probe 1904.

In the embodiment of FIG. 22, the probe 1906 is also instrumented with displacement and pressure sensors in sensor block 2236. The displacement measurement may be used for measuring the drawdown piston speed or position with respect to the probe. This measurement may also be used for controlling the tool operations, or for interpreting the pressure values recorded by the pressure sensor in sensor block 2236.

Although the displacement sensors and the pressure chamber are shown in FIG. 22 only, it should be understood that equivalent or similar sensor can be used in other embodiments of this disclosure. Also, although the pressure sensor is shown measuring the differential pressure between the actuation chamber 1954 and the wellbore pressure, other similar sensors may be used in other chambers for controlling the operation of the downhole tool.

Returning now to FIG. 19, to store energy for example to retract the measurement probe 1904 into the probe opening 1908, the probe system 1902 is provided with a retractor 1976. The retractor 1976 includes a piston 1978 having an o-ring 1980 that sealingly separates a retractor storage chamber 1982 (FIG. 20) from a retractor spring chamber 1984 (FIGS. 19 and 20). The retractor spring chamber 1984 includes a coil spring 1986 (FIGS. 19 and 20) inserted therein that provides a force against the piston 1978 in a direction generally indicated by arrow 1988 (FIG. 19).

To extend and retract the measurement probe 1904 based on the actuator 1941 and the retractor 1976, the probe system 1902 is provided with an extending chamber 1990 (FIG. 21) and a retracting chamber 1992 (FIGS. 19 and 21). The extending and retracting chambers 1990 and 1992 are sealingly separated by an o-ring 1993 that sealingly engages the probe 1904. The extending chamber 1990 is fluidly coupled to the actuation chamber 1954 (FIGS. 20 and 21) via a power fluid line 1994. The retracting chamber 1992 and the retractor storage chamber 1982 (FIG. 20) are fluidly coupled via a control fluid line 1996. A solenoid check valve 1998 is provided along the control fluid line 1996 to control the flow of hydraulic fluid between the retractor storage chamber 1982 and the retracting chamber 1992.

To protect the probe 1904 during a drilling operation, the retractor 1976 and the solenoid check valve 1998 are configured to cause the probe 1904 to remain in a retracted position. In particular, energy stored in the coil spring 1986 can be used to retract the probe 1904 and/or cause the probe 1904 to remain in a retracted position. In this manner, inadvertent, accidental, or unintentional extensions of the probe 1904 are substantially reduced or prevented due to, for example, a power failure. Ensuring that the probe 1904 remains in a retracted position prevents damage to the probe 1904 during a drilling operation that may otherwise occur if the probe 1904 were extended while a drill string (e.g., the drill string 102 of FIG. 1) moved during a drilling operation. For example, in the event of a power failure, the solenoid check valve 1962 closes allowing fluid to flow in one direction from the retractor storage chamber 1982 (FIG. 20) to the retracting chamber 1992 via the flow line 1996. As the energy stored in the coil spring 1986 causes the coil spring 1986 to push against the piston 1978, the piston 1978 causes fluid to flow from retractor storage chamber 1982 to the retracting chamber 1992, which causes the volume of the retracting chamber 1992 to increase and/or prevents the volume of the retracting chamber 1992 from decreasing. In turn, the probe 1904 retracts and/or remains in a retracted position for at least the duration of the power failure.

To extend and retract the drawdown piston 1906 relative to the probe 1904, the probe 1904 and the drawdown piston 1906 form a drawdown piston actuating chamber 2002 (FIG. 21) and a drawdown piston control chamber 2004 (FIGS. 19 and 21). The drawdown piston 1906 is provided with an o-ring 2006 (FIGS. 19 and 21) that sealingly engages an inner wall of the probe 1904 to sealingly separate the drawdown piston actuating and control chambers 2002 and 2004.

To receive the probe 1904 when the probe 1904 is retracted, the probe system 1902 is provided with a back chamber 2008. The probe 1904 is provided with an o-ring 2010 to sealingly separate the back chamber 2008 from the retracting chamber 1992 and the drawdown piston control chamber 2004. The back chamber 2008 is fluidly coupled to the retractor spring chamber 1984 via an annulus pressure ($A_p$) fluid line 2012 (FIGS. 20 and 21) and the retractor spring chamber 1984 is fluidly coupled to the annulus pressure chamber 1934 via another annulus pressure ($A_p$) fluid line 2014 (FIGS. 20 and 21).

Figure 23:
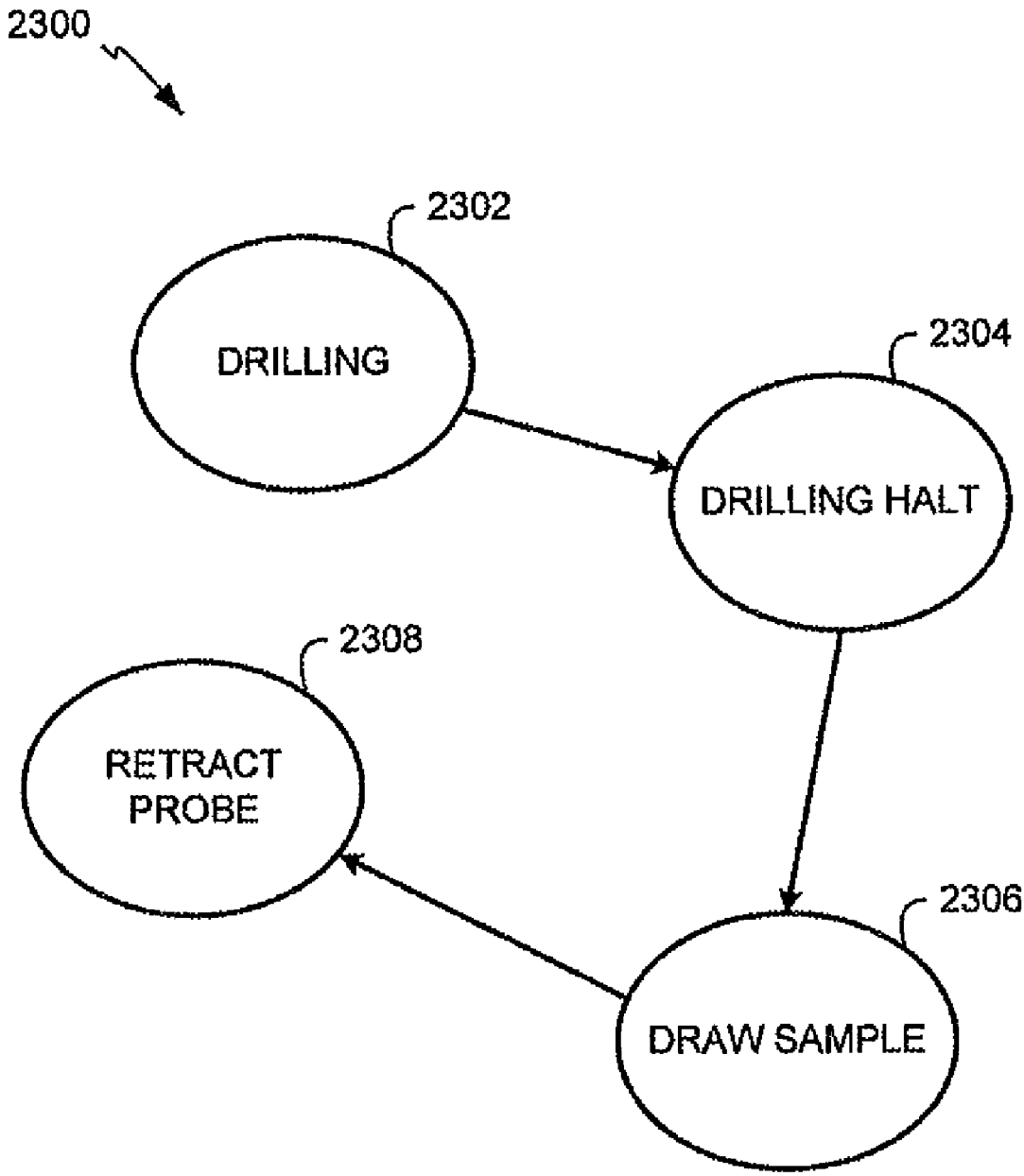
FIG. 23 depicts a state diagram of a drilling operation that represents an example method to operate the example probe system of FIGS. 19-21.

FIG. 23 depicts a state diagram of a drilling operation 2300 that represents an example method to operate the example probe system 1902 of FIGS. 19-21. In a drilling state 2302 of the drilling operation 2300, while a drill bit (e.g., the drill bit 106) is drilling into a formation (e.g., the formation F of FIG. 1), the example measurement probe 1904 is in a retracted or home position as shown in FIG. 19. That is, the probe 1904 and the packer 1914 are substantially completely retracted within the probe opening 1908 so that they are below an outer surface of a pad (e.g., the outer surface 324 of the pad 308 of FIG. 3B). Alternatively, if the example probe system 1902 is implemented so that the probe 1904 extends through a stabilizer blade (e.g., the stabilizer blade 303 of FIGS. 3A and 3B) instead of a pad, the probe 1904 and the packer 1914 are below a stabilizer blade surface (e.g., the outer surface 320 of the stabilizer blade 303 of FIG. 3B).

Also during the drilling state 2302, drilling fluid (e.g., the drilling fluid 116 of FIG. 1) flows through a drill string internal passage (e.g., the internal fluid passage 238 of FIG. 2) creating a drill string internal pressure $I_p$ and drilling mud flows through the annulus 124 (FIG. 1) of the wellbore 102 (FIG. 1) creating an annulus pressure $A_p$. The internal fluid port 1932 receives the drilling fluid 116 and the annulus fluid port 1936 receives the drilling mud. During the drilling state 2302, the drill string internal pressure $I_p$ is higher than the annulus pressure $A_p$. This difference in pressures causes the actuator ram 1942 (FIG. 19) to shift toward the actuator reference chamber 1956 (FIG. 19) and becomes set in an armed state shown in FIG. 20. In the armed state of FIG. 20, the actuator 1941 (FIGS. 19 and 20) and the retractor 1976 (FIGS. 19 and 20) store energy to subsequently extend the probe 1904 and retract the drawdown piston 1906. In an alternative example implementation using the lead screw configuration of FIG. 22, instead of using the pressure difference between the drill string internal pressure $I_p$ and the annulus pressure $A_p$, the motor 2210 may be activated to move the actuator ram 2204.

As the actuator ram 1942 shifts toward the actuator reference chamber 1956 (FIGS. 19 and 21), hydraulic oil is expelled from the actuator reference chamber 1956 into the retractor storage chamber 1982 (FIG. 20) and hydraulic oil is also expelled from the balancing chamber 1948 (FIGS. 19 and 21) to the annulus reference chamber 1934 (FIGS. 19 and 20) causing the volumes of the actuator reference chamber 1956 and the balancing chamber 1948 (FIGS. 19 and 21) to be reduced. In addition, hydraulic oil flows into the actuation chamber 1954 (FIGS. 20 and 21) through the solenoid check valve 1962 (FIGS. 19-21) and the volume of the actuation chamber 1954 increases. The solenoid check valves 1962 and 1998 (FIGS. 19-21) remain closed (i.e., solenoid check valves are not energized and allow flow in only one direction). For example, the solenoid check valve 1962 remains closed to prevent hydraulic fluid flow from the actuation chamber 1954 to the annulus pressure chamber 1934 and/or the balancing chamber 1948 via the fluid line 1960. Keeping the solenoid check valve 1962 closed causes the actuator ram 1942 to remain armed as shown in FIG. 20 regardless of changes in the drill string internal pressure $I_p$ and/or the annulus pressure $A_p$. Also, the solenoid check valve 1962 remains closed to prevent hydraulic fluid flow from the retracting chamber 1992 (FIGS. 19-21) to the retractor storage chamber 1982 (FIG. 20). Keeping the solenoid check valve 1962 closed prevents the probe 1904 from extending and, instead, causes the probe 1904 to remain in the retracted position shown in FIGS. 19 and 20. In the event of a power failure, the solenoid check valve 1962 closes allowing fluid to flow in one direction from the retractor storage chamber 1982 to the retracting chamber 1992 via the flow line 1996 to cause the volume of the retracting chamber 1992 to increase and, in turn, cause the probe 1904 to retract and to remain in the retracted position for at least the duration of the power failure.

In a drilling halt state 2304, the drill bit 106 (FIG. 1) stops turning and the drill string internal pressure $I_p$ drops to become substantially equal to the annulus pressure $A_p$. During the drilling halt state 2304, the processor 146 (FIG. 1) may communicate a downlink command to an electronics system (e.g., the electronics system 214 of FIG. 2) to perform a measurement. The downlink command causes the probe system 1902 to enter a draw sample state 2306.

In the draw sample state 2306 and in response to the downlink command, the solenoid check valve 1998 (FIGS. 19-21) is opened (i.e., the solenoid check valve 1998 is energized) and the actuator ram 1942 moves toward the internal pressure chamber 1926 as shown in FIG. 21 as hydraulic fluid is expelled from the actuation chamber 1954 (FIGS. 20 and 21) into the extending chamber 1990 (FIG. 21) causing the probe 1904 to extend through the probe opening 1908 as shown in FIG. 21. In addition, the solenoid valve 1998 is opened (i.e., energized) to allow hydraulic fluid to flow from the retracting chamber 1992 (FIGS. 19 and 21) to the actuator reference chamber 1956 (FIGS. 19 and 21). In addition, some of the energy stored in the coil spring 1986 is used to force hydraulic fluid into the actuator reference chamber 1956.

As the probe 1904 extends and contacts a formation surface of the wellbore 102 (FIG. 1), a tip 2016 of the probe 1904 extends through the packer 1914 and penetrates the mud cake on the formation surface. When the probe 1904 is set against the formation surface (e.g., when the probe 1904 can extend no further), hydraulic pressure in the extending chamber 1990 (FIG. 21) increases and hydraulic fluid flows from the extending chamber 1990 into the drawdown piston actuating chamber 2002 (FIG. 21) causing the drawdown piston 1906 to move toward the drawdown piston control chamber 2004 (FIGS. 19 and 21). As the drawdown piston 1906 moves toward the drawdown piston control chamber 2004, hydraulic fluid flows from the drawdown piston control chamber 2004 to the retracting chamber 1992 (FIG. 21). In addition, the formation material 1920 (FIG. 21) is drawn through the formation fluid port 1922 into a drawdown chamber 2018 (FIG. 21) (i.e., a formation fluid chamber) of the probe 1940 and toward the sensor 1916. When the drawdown piston 1906 is fully retracted, the pressure in the drawdown chamber 2018 becomes substantially equal to the pore pressure ($P_p$) (i.e., the pressure of the formation material 1920 in the formation F of FIG. 1). To ensure that the probe 1904 extends and the drawdown piston 1906 retracts in the sequence described above, the resistance associated with extending the probe 1904 must be less than the resistance associated with retracting the drawdown piston 1906. For example, o-ring sizes and material composition can be selected to create suitable resistances.

When the measurement performed by the sensor 1916 is complete (e.g., when the stabilization of pressure in the drawdown chamber 1918 is detected or when a time threshold is reached), the probe system 1902 enters into a retract probe state 2308 (FIG. 19). In the retract probe state 2308, the solenoid check valve 1998 is closed (i.e., de-energized) and the solenoid check valve 1962 is opened (i.e., energized). Hydraulic fluid flows from the actuating chamber 2002 (FIG. 21) and the extending chamber 1990 (FIG. 21) to the annulus pressure chamber 1934. The energy remaining in the actuator 1941 (FIGS. 19 and 20) assists in expelling the hydraulic fluid to the annulus pressure chamber 1934.

Also, in the retract probe state 2308, stored energy remaining in the retractor 1976 is used to return the probe 1904 to the retracted or home position shown in FIG. 19 by pushing hydraulic fluid into the retracting chamber 1992 (FIGS. 19 and 21) and the drawdown piston control chamber 2004 (FIGS. 19 and 21). As the probe 1904 returns to the retracted position, the actuator ram 1942 returns to the starting position shown in FIG. 19 and the solenoid check valve 1962 is closed (i.e., de-energized).

Figure 24:
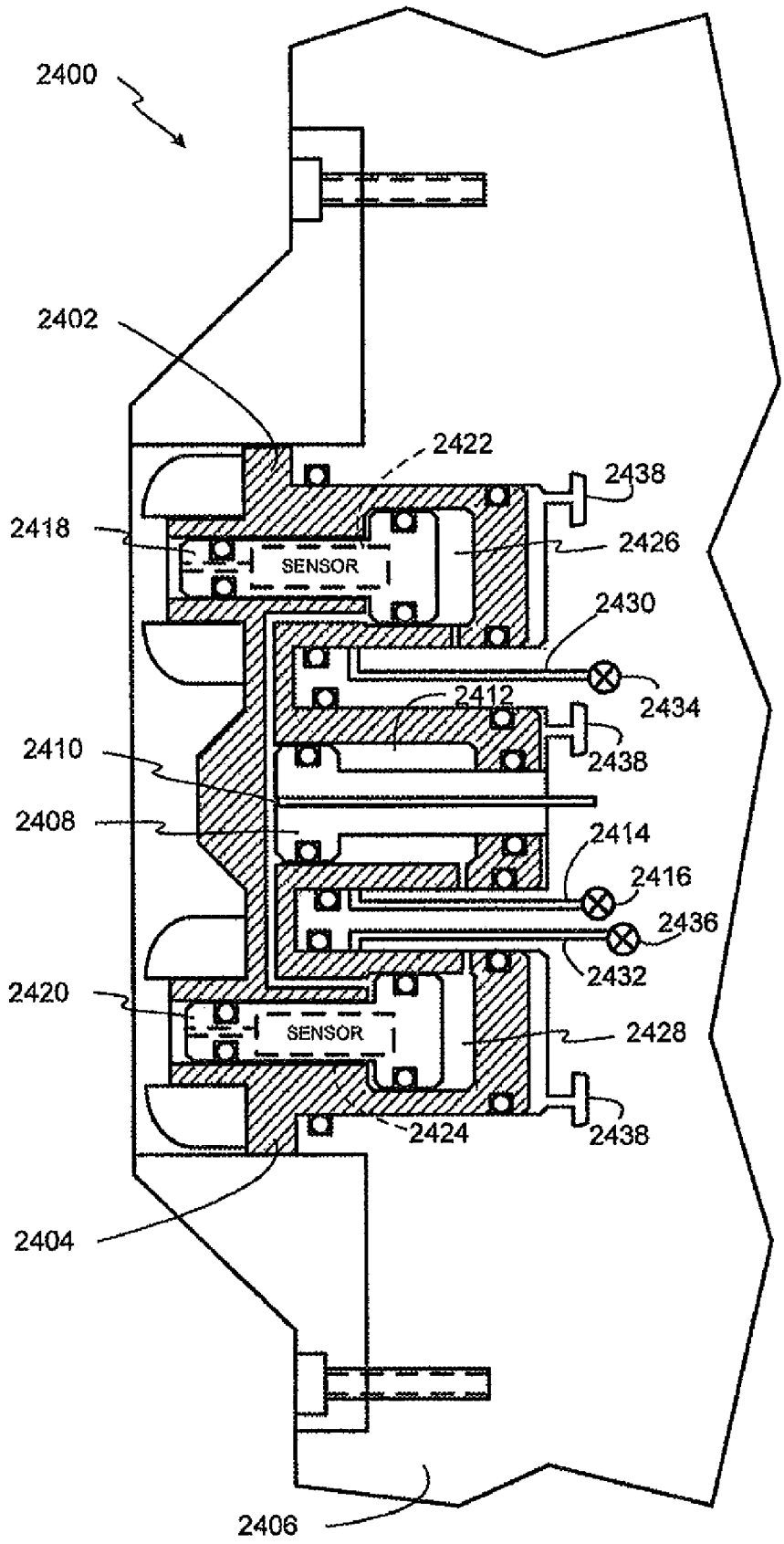
FIG. 24 depicts another example probe system implemented using a dual-probe configuration in which two probes are integrally formed so that they simultaneously extend and retract relative to a tool collar.

FIG. 24 depicts another example probe system 2400 implemented using a dual-probe configuration in which two probes 2402 and 2404 are integrally formed so that they extend and retract simultaneously relative to a tool collar 2406. The example probe system 2400 also includes an actuator ram 2408 to extend and retract the probes 2402 and 2404 relative to the tool collar 2406. A power fluid line 2410 extending through the actuator ram 2408 and the probes 2402 and 2404 provides hydraulic fluid for extending and retracting the probes 2402 and 2404. To control the extension and retraction of the probes 2402 and 2404, the probe system 2400 is provided with an actuator back chamber 2412 coupled to a probe control fluid line 2414 having a solenoid check valve 2416. The solenoid check valve 2416 can be opened (e.g., energized) to enable hydraulic fluid to flow out of the actuator back chamber 2412 allowing the hydraulic fluid flowing through the power fluid line 2410 to extend the probes 2402 and 2404 as the volume of the actuator back chamber 2412 decreases.

Each probe 2402 and 2404 of the example probe system 2400 includes a respective drawdown piston 2418 and 2420 and sensor 2422 and 2424. The drawdown pistons 2418 and 2420 extend and retract relative to the probes 2402 and 2404 to draw formation fluid into the probes 2402 and 2404. Each of the drawdown pistons 2418 and 2420 retracts into a respective drawdown piston control chamber 2426 and 2428. To control the retraction and extension of the drawdown pistons 2418 and 2420, for each of drawdown piston 2420 and 2422, the probe system 2400 is provided with a respective piston control fluid line 2430 and 2432. Each of the piston control fluid lines 2430 and 2432 is provided with a solenoid check valve 2434 and 2436. Opening (e.g., energizing) the solenoid check valves 2430 and 2432 causes hydraulic fluid to flow out of the drawdown piston control chambers 2426 and 2428 and through the piston control fluid lines 2430 and 2432. The hydraulic fluid provided via the power fluid line 2410 then causes the pistons 2412 and 2414 to be drawn or retracted into the drawdown piston control chambers 2426 and 2428 to draw formation fluid into the probes 2402 and 2404.

The probe system 2400 is also provided with annulus pressure ($A_p$) fluid lines 2438 that are fluidly coupled to a compensator (not shown) substantially similar or identical to the compensator 1933 of FIG. 19. The $A_p$ fluid lines 2438 provide hydraulic fluid at an annulus pressure to urge the probes 2402 and 2404 to extend as described above in connection with FIGS. 19-21 and 23.

In an example implementation, the power fluid line 2410, the control fluid lines 2414, 2430, and 2432, and the $A_p$ line 2438 can be connected to power fluid lines, control fluid lines, and $A_p$ fluid lines of the example probe system 1902 of FIGS. 19-21 to control the probes 2402 and 2404 and the pistons 2418 and 2420 as described above in connection with the example probe system 1902.

Figure 25:
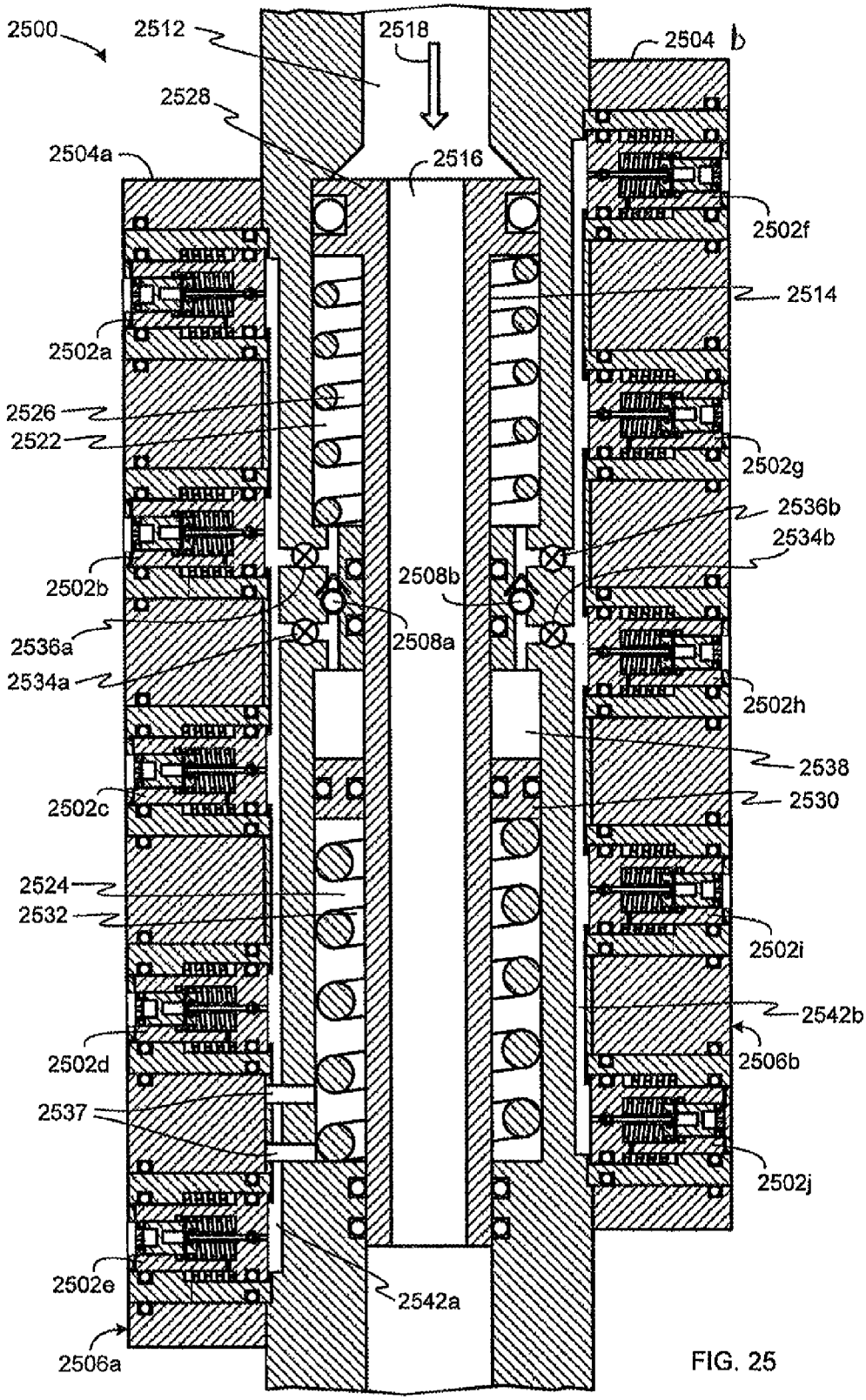
FIG. 25 depicts another example tool collar having a plurality of probes.

FIG. 25 depicts a portion of a tool collar 2500 having plurality of probes 2502*a-j* perform downhole measurements in connection with a drilling operation. Some or all of the probes 2502*a-j* may be configured to extend and retract relative to the tool collar 2500 to perform measurements. In the illustrated example, the probes 2502*a-j* are mounted in stabilizer blades 2504*a-b* (2504*b* not shown), which may be configured to spiral at least partially around the tool collar 2500. In other example implementations, the stabilizer blades 2504*a-b* may instead be implemented using pads that provide substantially similar or identical functionality as described above in connection with the pads 308 and 310.

In the illustrated example, the probes 2502*a-j* are mounted in respective ones of the stabilizer blades 2504*a-b* in groups of five. However, any other grouping quantities may be used. Implementing the stabilizer blades 2504*a-b* in spiral configurations about the tool collar 2500 causes each of the probes 2502*a-j* to be on a different horizontal and vertical plane. In this manner, each of the probes 2502*a-j* can perform a measurement (e.g., a pressure measurement) at a different elevation and radial location of a wellbore (e.g., the wellbore 102 of FIG. 1). The configuration shown in FIG. 25 enables substantially simultaneously collecting measurement information associated with different locations of the wellbore 102 spanning a surface of the wellbore 102 having a length substantially similar to the length of the stabilizer blades 2504*a-b*. Mounting the probes 2502*a-j* along the length of the stabilizer blades 2504*a-b* facilitates obtaining measurements associated with a small or thin target area of the wellbore 102 by reducing the amount of positioning accuracy required to position any single probe adjacent to the target area of interest. In addition, the illustrated probe mounting configuration enables acquiring relatively a more accurate formation property (e.g. formation pressure) because more measurement points spreading over a larger surface area of the wellbore 102 can be acquired.

To perform measurements (e.g., pressure measurements), each of the probes 2502*a-j* is provided with a drawdown piston chamber (e.g., the drawdown piston chamber 2624 of FIG. 26) described below in connection with FIG. 26. The measurement values can be stored in a memory (e.g., the FLASH memory 222 of FIG. 2). The measurement values can be transmitted to the surface or can be downloaded when the tool collar 2500 is returned to the surface. In some example implementations, the measurement values can be analyzed by a controller (e.g., the controller 218 of FIG. 2) while the tool collar 2500 is located in the wellbore 102.

During a drilling operation, the probes 2502*a-j* are kept retracted below outer surfaces 2506*a-b* of the stabilizer blades 2504*a-b*. The transmitter subsystem 150 (FIG. 1) can then communicate a command from the surface to an electronics system (e.g., the electronics system 214 of FIG. 2) associated with the tool collar 2500 to initiate a test sequence when, for example, drilling has been halted. In response to the command, the electronics system 214 can cause some or all of the probes 2502*a-j* to extend from the stabilizer blades 2504*a-b*. For example, the tool collar 2500 is provided with one-way check valves 2508*a-b* that can be communicatively coupled to the electronics system 214, and the electronics system 214 can open or close the one-way check valves 2508*a-b* to cause the probes 2502*a-j* to extend or retract.

To accumulate energy for extending the probes 2502*a-j*, the tool collar 2500 is provided with a tool collar fluid passageway 2512 and a mud piston 2514 configured to move along a length of the fluid passageway 2512. The mud piston 2514 includes a mud piston fluid passageway 2516 formed through and along a length of the mud piston 2514. During a drilling operation, drilling fluid (e.g., the drilling fluid 116 of FIG. 1) flows through the tool collar fluid passageway 2512 and the mud piston fluid passageway 2516 in a direction generally indicated by arrow 2518. The size (e.g., the diameter) of the mud piston fluid passageway 2516 is smaller than the size (e.g., the diameter) of the tool collar fluid passageway 2512 and provides fluid flow resistance when the drilling fluid 116 flows through the tool collar fluid passageway 2512. In turn, the fluid flow resistance provided by the mud piston fluid passageway 2516 causes the mud piston 2514 to move along the tool collar fluid passageway 2512 in the direction generally indicated by the arrow 2518.

The tool collar 2500 is provided with a first spring chamber 2522 and a second spring chamber 2524 located along the tool collar fluid passageway 2512. The first spring chamber 2522 includes a coil spring 2526 that engages a flange 2528 of the mud piston 2514, and the second spring chamber 2524 includes an annular accumulator piston 2530 sealingly engaged to the mud piston 2514 and a coil spring 2532 that engages the annular accumulator piston 2530. In the illustrated example, the coil spring 2532 has a spring force relatively greater (e.g., has a higher spring constant k) than the coil spring 2526, During a drilling operation, the mud piston 2514 is configured to generate energy based on the drilling fluid 116 that flows through the tool collar fluid passageway 2512, and the coil spring 2532 is configured to store the energy generated by the mud piston 2514 for subsequent use to extend some or all of the probes 2502*a-j*. In particular, the one-way check valves 2508*a-b* and valves 2534*a-b* and 2536*a-b* are closed during drilling so that hydraulic fluid from the first spring chamber 2522 can flow in only one direction to an accumulator chamber 2538 as the drilling fluid 116 flows through the tool collar fluid passageway 2512 causing the mud piston 2514 to move and compress the coil spring 2526. The hydraulic fluid expelled from the first spring chamber 2522 increases a volume of the accumulator chamber 2538 causing the annular accumulator piston 2530 to compress the coil spring 2532 causing the coil spring 2532 to store energy. As the annular accumulator piston 2530 moves toward the coil spring 2532, the annular accumulator piston 2530 expels drilling mud from the second spring chamber 2524 into the annulus 124 (FIG. 1) of the wellbore 102 via mud fluid ports 2537. The one-way check valves 2508*a-b* and the valves 2534*a-b* and 2536*a-b* prevent the hydraulic fluid from being expelled from the accumulator chamber 2538, which, in turn, causes the coil spring 2532 to remain in a compressed state to store energy.

In response to receiving a measurement sequence command, the electronics system 214 causes one or more of the valves 2534*a-b* to open to allow the coil spring 2532 to extend using the stored energy and move the annular accumulator piston 2530 to expel the hydraulic fluid from the accumulator chamber 2538 to fluid passageways 2542*a-b*. The fluid passageways 2542*a-b* are fluidly coupled to the probes 2502*a-j*, and the hydraulic fluid flows to the probes 2502*a-j* via the fluid passageways 2542*a-b* to cause the probes 2502*a-j* to extend. To retract the probes 2502*a-j*, the electronics system 214 opens the valves 2536*a-b* to enable hydraulic fluid to flow from the fluid passageways 2542*a-b* to the first spring chamber 2522.

Figure 26:
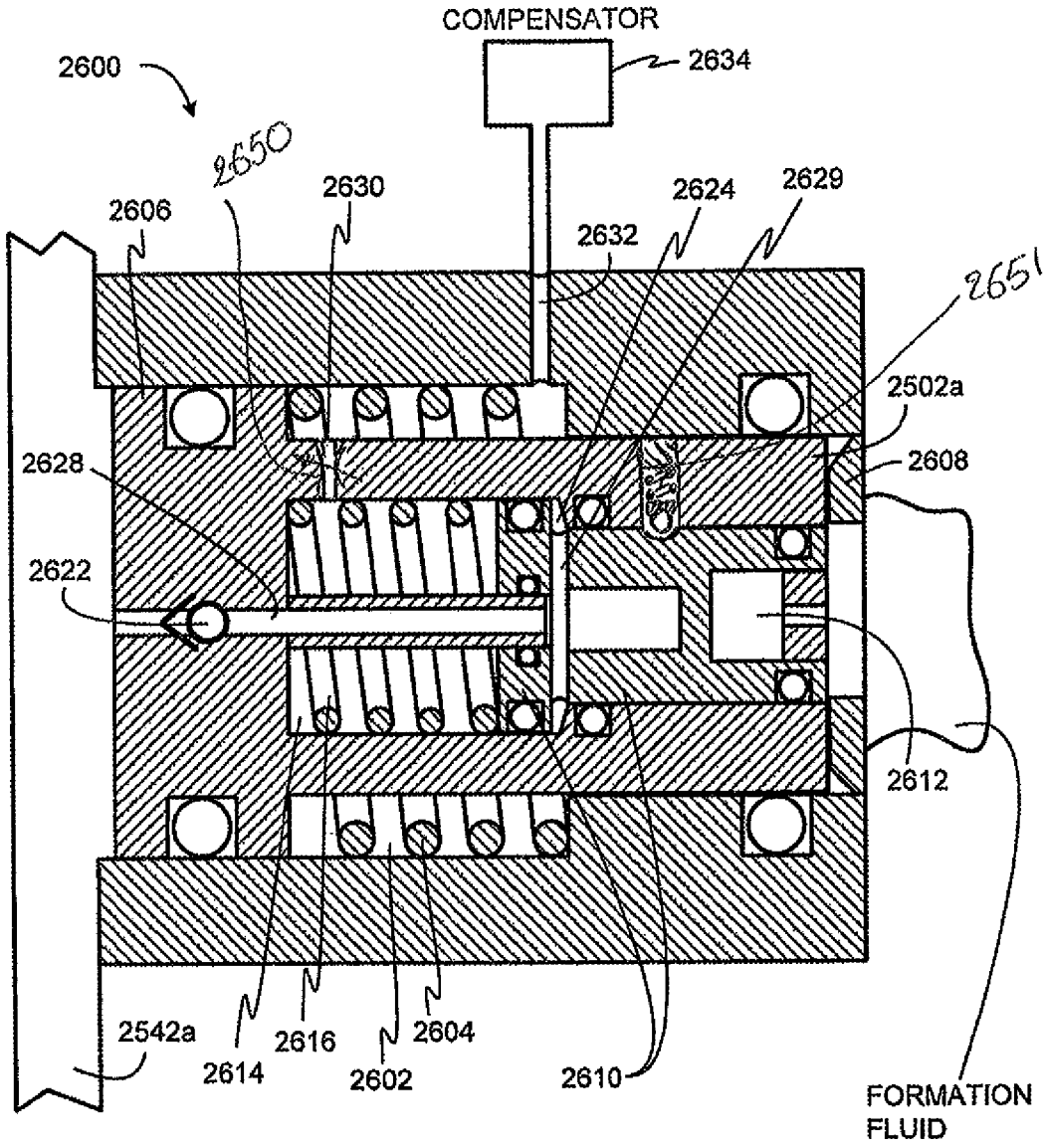
FIG. 26 depicts a probe assembly used to implement one of the probes of FIG. 25.

FIG. 26 depicts an example probe assembly 2600 having the probe 2502*a* of FIG. 25. To extend and retract the probe 2502*a*, the example probe assembly 2600 is provided with a probe spring chamber 2602 having a coil spring 2604 therein. When the probe 2502*a* extends, a flange 2606 of the probe 2502*a* compresses the coil spring 2604, which, in turn, stores energy. To form a seal between the probe 2502*a* and a formation surface of a wellbore, the probe 2502*a* is provided with a packer 2608 made of, for example, a substantially deformable elastomeric material configured to sealingly engage the formation surface when the probe 2502*a* is extended. To retract the probe 2502*a* when fluid is expelled from the fluid passageway 2452*a*, the stored energy in the coil spring 2604 causes the spring 2604 to extend and push the flange 2606, which, in turn, retracts the probe 2502*a*.

The probe assembly 2600 includes a drawdown piston 2610 in the probe 2502*a* configured to draw formation fluid. In the illustrated example, the drawdown piston 2610 includes a pressure sensor 2612 configured to measure a pressure of formation fluid. To draw the formation fluid, the probe 2502*a* is provided with a drawdown piston spring chamber 2614 having a coil spring 2616. The probe assembly 2600 also includes a check valve 2622 configured to control the flow of hydraulic fluid into and out of a drawdown piston chamber 2624. When the check valve 2622 is closed (e.g., de-energized), hydraulic fluid flows from the fluid passageway 2542*a* into the drawdown piston chamber 2624 via a fluid passageway 2628 and a fluid passageway 2629 formed through the drawdown piston 2610 causing the volume of the drawdown piston chamber 2624 to increase as the drawdown piston 2610 moves toward the coil spring 2616 causing the spring 2616 to compress and store energy. As the drawdown piston 2610 retracts toward the spring 2616, formation fluid is drawn into the pressure sensor 2612. The probe 2502*a* includes a fluid passageway 2630 that enables fluid to flow into and out of the drawdown piston spring chamber 2614 to enable increasing and decreasing the volume of the drawdown piston spring chamber 2614 to extend and retract the drawdown piston 2610. Optionally, the passageway 2630 is equipped with throttle valve 2650, which may be an adjustable throttle valve. The throttle valve 2650 may be used for controlling the rate at which the drawdown piston 2610 retracts. Also, the probe 2502*a* may include a detent 2651 for preventing the drawdown piston to retract until the pressure in the drawdown piston chamber 2624 has reached a sufficient level. The pressure in the drawdown piston chamber 2624 depends, in part, on the level of the contact force between the packer 2608 and the formation. Thus, the detent 2651 may be used for controlling the level of contact force at which the drawdown is initiated.

To extend the drawdown piston 2610 and expel the formation fluid from the pressure sensor 2612, the check valve 2622 is opened (e.g., energized) and the drawdown piston 2610 expels hydraulic fluid from the drawdown piston chamber 2624 to the fluid passageway 2452*a*. The probe assembly 2600 includes a fluid passageway 2632 that enables fluid to flow into and out of the probe spring chamber 2602 to enable increasing and decreasing the volume of the probe spring chamber 2602 to extend and retract the probe 2502*a*. The fluid passageway 2632 is fluidly coupled to a compensator chamber 2634 that holds the fluid that flows into and out of the probe spring chamber 2602 and the drawdown piston spring chamber 2614. The compensator chamber 2634 is substantially similar or identical to the compensator 1933 of FIG. 19 and can be used to sense an annulus pressure $A_p$.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. A system for testing a subterranean formation penetrated by a well, the system comprising:

a downhole tool configured to be coupled to a work string, the downhole tool comprising a tool body having a longitudinal bore for circulating a fluid and at least one aperture configured to receive at least one module;

a plurality of modules, each of the plurality of modules configured to be received by the at least one aperture, each of the plurality of modules further having at least one cavity configured for receiving a probe; and a plurality of probes, each of the plurality of probes having at least one orifice configured for testing the formation, wherein a first of the plurality of probes has a first configuration and a second of the plurality of probes has a second configuration.

2. A system as defined in claim 1, wherein the at least one aperture formed in the body comprises a plurality of apertures.

3. A system as defined in claim 1, further comprising a mandrel chassis and a fluid passage way between at least one module and the mandrel chassis.

4. A system as defined in claim 1, further comprising a mandrel chassis and a fluid passageway between the orifice of at least one probe and the mandrel chassis.

5. A system as defined in claim 1, wherein the tool body further comprises a portion configured to be coupled to a stabilizer subassembly.

6. A system as defined in claim 1, further comprising a sensor for measuring the position of at least one extendable probe relative to at least one of the modules, the sensor including at least one of a potentiometer and a linear encoder.

7. A system as defined in claim 6, further comprising a valve for regulating the extension of at least one extendable probe and a pulse width modulator controller coupled to the valve.

8. A system as defined in claim 7 further comprising a tool controller communicably coupled to the sensor and to the pulse width modulator controller.

9. A system as defined in claim 1, wherein the first probe comprises a drawdown piston slideably engaged with the probe orifice and a sensor for measuring the pressure at the probe orifice.

10. A system as defined in claim 9, further comprising a sensor for measuring the position of the drawdown piston relative to the first probe, the sensor including at least one of a potentiometer and a linear encoder.

11. A system as defined in claim 10 further comprising a valve for regulating the position of the drawdown piston relative to the first probe, a pulse width modulator controller coupled to the valve, and a tool controller communicably coupled to the sensor and the pulse width modulator controller.

12. A system as defined in claim 1, wherein the aperture in the tool body is configured to receive a plurality of the modules.

13. A system as defined in claim 12, wherein a cavity of a first module is oriented towards a first direction and a cavity of a second module is oriented towards a second opposite direction.

14. A system as defined in claim 1, wherein at least one module has a plurality of cavities, each cavity configured for receiving a probe.

15. A system as defined in claim 14, wherein a first cavity and a second cavity of the at least one module are oriented in the same direction.

16. A system as defined in claim 1, further comprising a motor disposed in the downhole tool, an actuation chamber fluidly coupled to at least one extendable probe, and a motor piston, wherein the motor piston is slideably engaged with the actuation chamber and kinetically coupled to the motor.

17. A system as defined in claim 16, further comprising a pressure sensor for measuring the pressure of a fluid in the actuation chamber.

18. A system as defined in claim 16, further comprising a rotary encoder disposed adjacent the motor for measuring the motor rotation.

19. The system of claim 16 further comprising:

a pressure sensor configured to measure the pressure of a fluid in the actuation chamber; and a rotary encoder disposed adjacent the motor for measuring the rotation of the motor.

20. A system for testing a subterranean formation penetrated by a well, comprising:

a downhole tool comprising a tool body having at least one aperture configured to receive at least one module;

a plurality of modules each configured to be received by the at least one aperture and having at least one cavity configured to receive a probe;

a plurality of probes each having at least one orifice configured for testing the formation, wherein a first of the plurality of probes has a first configuration and a second of the plurality of probes has a second configuration, and wherein the first probe comprises a drawdown piston slideably engaged with the at least one orifice and a sensor configured to measure the pressure at the probe orifice;

a motor disposed in the downhole tool;

an actuation chamber fluidly coupled to at least one extendable probe; and a motor piston slideably engaged with the actuation chamber and kinetically coupled to the motor.

21. A system, comprising:

a downhole tool comprising a tool body having a plurality of apertures;

a plurality of modules each configured to be received by a corresponding one of the plurality of apertures and having at least one cavity configured to receive a probe, wherein a first cavity of a first one of the plurality of modules is oriented towards a first direction and a second cavity of a second one of the plurality of modules is oriented towards a second direction that is substantially opposite from the first direction;

a plurality of probes each having at least one orifice configured for testing the formation, wherein a first one of the plurality of probes has a first configuration and a second one of the plurality of probes has a second configuration that is different from the first configuration, and wherein the first one of the plurality of probes comprises a drawdown piston slideably engaged with the probe orifice and a sensor for measuring the pressure at the probe orifice;

a sensor configured to measure the position of the drawdown piston relative to the first probe, the sensor including at least one of a potentiometer and a linear encoder;

a valve for regulating the position of the drawdown piston relative to the first probe;

a pulse width modulator controller coupled to the valve;

a tool controller communicably coupled to the sensor and the pulse width modulator controller;

a motor disposed in the downhole tool;

an actuation chamber fluidly coupled to at least one extendable one of the plurality of probes; and a motor piston slideably engaged with the actuation chamber and kinetically coupled to the motor.

* * * * *